US010569284B2

(12) United States Patent
Mareli et al.

(10) Patent No.: US 10,569,284 B2
(45) Date of Patent: Feb. 25, 2020

(54) SPRINKLER INCLUDING A ROTATION SPEED GOVERNING ASSEMBLY

(71) Applicant: NAANDANJAIN IRRIGATION LTD., Kibbutz Naan (IL)

(72) Inventors: Lior Eliahu Mareli, Rehovot (IL); Gal Regev, Moshav Ben-Shemen (IL)

(73) Assignee: NAANDANJAIN IRRIGATION LTD., Kibbutz, Na'an (IL)

( * ) Notice: Subject to any disclaimer, the term of this patent is extended or adjusted under 35 U.S.C. 154(b) by 125 days.

(21) Appl. No.: 15/459,743

(22) Filed: Mar. 15, 2017

(65) Prior Publication Data

US 2018/0264488 A1 Sep. 20, 2018

(51) Int. Cl.
*B05B 3/00* (2006.01)
*B05B 3/04* (2006.01)

(52) U.S. Cl.
CPC ..... *B05B 3/006* (2013.01); *B05B 3/005* (2013.01); *B05B 3/0486* (2013.01)

(58) Field of Classification Search
CPC ..... B05B 1/083; B05B 1/262; B05B 3/002; B05B 3/005; B05B 3/006; B05B 3/0486; B05B 3/063
USPC ..... 239/222.11, 222.21, 222.17, 252, 505
See application file for complete search history.

(56) References Cited

U.S. PATENT DOCUMENTS 4,379,976 A 4/1983 Pitchford et al.
4,453,673 A 6/1984 Icenbice
5,372,307 A 12/1994 Sesser
5,377,914 A * 1/1995 Christen ..... B05B 3/005 239/252
5,671,886 A * 9/1997 Sesser ..... B05B 3/005 239/222.21
8,998,109 B2 4/2015 Katzman et al.
2007/0246560 A1* 10/2007 Townsend ..... B05B 3/005 239/1

(Continued)

FOREIGN PATENT DOCUMENTS

WO 2010/016053 2/2010
WO 2016/132365 8/2016
WO WO-2016132365 A1 * 8/2016 ..... B05B 3/04

OTHER PUBLICATIONS

An English translation of an Office Action dated Oct. 17, 2017 which issued during the prosecution of Brazilian Patent Application No. PI0917506-7.

(Continued)

*Primary Examiner* — Cody J Lieuwen
(74) *Attorney, Agent, or Firm* — Sughrue Mion, PLLC

(57) ABSTRACT

A sprinkler including a fixed base defining a water inlet and a nozzle, a rotating assembly arranged for rotation relative to the fixed based about a rotation axis and including a water stream director, receiving a pressurized stream of water from the nozzle and directing it in a generally radially outward direction and a rotation speed governing assembly operatively associated with the rotating assembly and operative to intermittently reduce a speed of rotation of the rotating assembly, so as to thereby increase a radial range of the stream, the rotational speed governing assembly including a rotating enclosure rotating together with the rotating assembly and enclosing a viscous material, a static element and a moving element.

20 Claims, 49 Drawing Sheets

(56) References Cited

U.S. PATENT DOCUMENTS

| | | | | |
|---|---|---|---|---|
| 2008/0257982 | A1* | 10/2008 | Kah | B05B 15/70<br>239/222.11 |
| 2008/0277498 | A1* | 11/2008 | Townsend | B05B 1/26<br>239/222.17 |
| 2011/0114755 | A1* | 5/2011 | Katzman | B05B 3/005<br>239/222.17 |
| 2014/0263734 | A1* | 9/2014 | Kim | B05B 3/003<br>239/222.17 |

OTHER PUBLICATIONS

An International Search Report and a Written Opinion both dated Jun. 7, 2016, which issued during the prosecution of Applicant's PCT/IL2016/050193.

* cited by examiner

SPRINKLER INCLUDING A ROTATION SPEED GOVERNING ASSEMBLY

REFERENCE TO RELATED PATENTS AND PATENT APPLICATIONS

Reference is hereby made to U.S. Pat. No. 8,998,109 and to U.S. Reissue patent application Ser. No. 15/391,281, the disclosures of which are hereby incorporated by reference.

FIELD OF THE INVENTION

The present invention relates to sprinklers generally.

BACKGROUND OF THE INVENTION

Various types of sprinklers are known in the patent literature.

SUMMARY OF THE INVENTION

The present invention seeks to provide improved sprinklers.

There is thus provided in accordance with a preferred embodiment of the present invention, a sprinkler including a fixed base defining a water inlet and a nozzle, a rotating assembly arranged for rotation relative to the fixed base about a rotation axis and including a water stream director, receiving a pressurized stream of water from the nozzle and directing it in a generally radially outward direction and a rotation speed governing assembly operatively associated with the rotating assembly and operative to intermittently reduce a speed of rotation of the rotating assembly, so as to thereby increase a radial range of the stream, the rotational speed governing assembly including a rotating enclosure rotating together with the rotating assembly and enclosing a viscous material, a static element and a moving element.

Preferably, the static element includes a plurality of vanes operative to direct the viscous material toward the moving element, thereby increasing resistance to movement of the moving element relative to the static element.

In accordance with a preferred embodiment of the present invention the moving element includes a ring having at least one generally conical surface. Preferably, the moving element includes a ring having a plurality of protrusions arranged on a surface thereof at mutually azimuthally locations thereon. Additionally or alternatively, the moving element includes a ring having a plurality of protrusions arranged on a conical surface thereof at mutually azimuthally locations thereon.

In accordance with a preferred embodiment of the present invention the static element is arranged to define a rotation surface centered about the rotation axis and to define a support surface for the moving element, the support surface being centered about the rotation axis but lying in a plane which is not perpendicular to the rotation axis.

Preferably, the rotation speed governing assembly includes a top magnet supporting housing portion and a bottom magnet supporting housing portion. Additionally, the housing portions are removably mounted onto the fixed base.

In accordance with a preferred embodiment of the present invention the rotation speed governing assembly includes a rotating, azimuth responsive, multiple rotation speed governor assembly (RARMRSGA). Additionally, the rotating enclosure is fixedly mounted onto an axle and is arranged for rotational movement together with the rotating assembly about the rotation axis and relative to the fixed base.

In accordance with a preferred embodiment of the present invention a speed of rotation of the water stream director about the rotation axis is governed by the multiple rotation speed governor assembly, which rotates together therewith.

Preferably, the sprinkler also includes a ratcheted deflector, which is rotatably mounted for single direction, ratchet controlled rotation about the rotation axis relative to the fixed base.

In accordance with a preferred embodiment of the present invention the sprinkler also includes first and second magnets, arranged to have the same polarity, which are fixedly mounted in mutual coaxial arrangement at locations arranged about an axis parallel and radially spaced from the rotation axis onto the top and bottom magnet support housing portions.

Preferably, the fixed base includes an externally threaded hollow base portion having at least one nozzle retaining bayonet mount protrusion formed on a lower, outer cylindrical surface thereof and having a transverse recess and a top surface, the hollow base portion defining a nozzle-receiving bore for receiving the nozzle, above the nozzle-receiving bore there being formed a ring receiving and retaining seat, which is configured for fixed mounting therein of a low friction, low wear, ring and retention thereof by a plurality of snap fit fingers having undercut engagement edges. Additionally, a bottom of the nozzle is configured to define a bayonet connector rim portion including at least one cutout, at least one retaining surface including a protrusion, at least one sloping engagement surface, at least one sloping disengagement surface and at least one downward-facing engagement surface for removable bayonet engagement with at least one retaining bayonet mount protrusion of the fixed base.

In accordance with a preferred embodiment of the present invention the water stream director is formed with a low friction, low wear support and rotary engagement surface for engagement with the ring during operation of the sprinkler. Additionally, the engagement surface is defined by a protrusion having a pointed azimuthal clockwise end.

In accordance with a preferred embodiment of the present invention the ratcheted deflector includes a generally disk-like element including a generally planar, generally circular inner plate having a top surface, a bottom surface and a circumferential edge and having, extending outwardly from circumferential edge a plurality of mutually equally azimuthally spaced deflector portions, each of which defines a downward-facing deflector surface.

Preferably, the rotating, azimuth responsive, multiple rotation speed governor assembly includes a cover portion and a base portion, to which the cover portion is sealingly and fixedly attached and which together define the enclosure for containing the viscous fluid, which viscous fluid does not fully fill the enclosure. Additionally, the sprinkler also includes a magnet bearing centrifugal viscous material accelerator (MBCVMA) disposed within the enclosure, the MBCVMA having a central generally circularly cylindrical bore configured for mutually rotatable mounting of the MBCVMA onto a circularly cylindrical outer hub surface for relatively low friction rotation of the enclosure about the rotation axis, the MBCVMA having fixedly mounted therein a magnet.

In accordance with a preferred embodiment of the present invention the moving element includes an intermediate geared ring disposed within the enclosure intermediate the MBCVMA and an interior geared surface of the enclosure.

In accordance with a preferred embodiment of the present invention the MBCVMA is formed with a central generally circularly cylindrical bore, configured for mutually rotatable mounting of MBCVMA onto the enclosure for relatively low friction rotation of the enclosure about the axis relative to the MBCVMA. Additionally, the sprinkler includes a magnet fixedly mounted onto the MBCVMA.

In accordance with a preferred embodiment of the present invention the MBCVMA is formed with a plurality of radially outwardly and tangentially directed vanes for directing the viscous material within the enclosure radially outwardly from the MBCVMA towards the moving element and towards a circular array of radially inwardly facing gear teeth on the enclosure, such that the viscous material provides resistance to mutual displacement of the moving element and the enclosure as well as to mutual displacement of the moving element and the enclosure relative to the MBCVMA, thereby reducing a speed of rotation of the enclosure about the rotation axis.

Preferably, the magnet is located in a magnet receiving aperture located in a radially outwardly extending portion of the MBCVMA, which portion defines a radially outwardly directed engagement surface, which surface engages the moving element and urges and retains the moving element in gear engagement with an interior geared surface of the enclosure, wherein the radially outwardly directed engagement surface intermittently engages the moving element during rotation of the enclosure relative to the MBCVMA about the rotation axis. Additionally, the MBCVMA is formed with a radially outward extending spacer portion, which is azimuthally spaced from the radially outwardly extending portion and defines a radially outwardly directed engagement surface that preferably intermittently engages the moving element during rotation of the enclosure relative to the MBCVMA about the rotation axis, coincidentally in time with engagement of the outwardly directed engagement surface with the moving element. Additionally, the radially outwardly directed surfaces are formed with mutually circumferentially aligned recesses.

In accordance with a preferred embodiment of the present invention the static element includes a magnet bearing centrifugal viscous material accelerator and geared ring tilter (MBCVMAGRT). Additionally, the MBCVMAGRT includes a central generally circularly cylindrical bore configured for mutually rotatable mounting of the MBCVMAGRT onto the enclosure for relatively low friction rotation of enclosure about the rotation axis relative to the MBCVMAGRT. Preferably, the sprinkler also includes a magnet fixedly mounted onto the MBCVMAGRT.

Preferably, the sprinkler also includes an intermittently discretely tiltable geared ring (IDTGR) disposed within the enclosure, intermediate the MBCVMAGRT and an interior corner geared surface of the enclosure.

In accordance with a preferred embodiment of the present invention the MBCVMAGRT is formed with a central generally circularly cylindrical bore, configured for mutually rotatable mounting of the MBCVMAGRT onto the enclosure for relatively low friction rotation of the enclosure about the rotation axis relative to the MBCVMAGRT. Additionally or alternatively, the MBCVMAGRT is formed with a plurality of radially outwardly and tangentially directed vanes for directing the viscous material within the enclosure radially outwardly from the MBCVMAGRT towards the IDTGR and towards a circular array of radially inwardly facing corner gear teeth formed on the enclosure, such that the viscous material provides resistance to mutual displacement of the IDTGR and the enclosure as well as to mutual displacement of the IDTGR and the enclosure relative to the MBCVMAGRT.

Preferably, the MBCVMAGRT includes a plurality of vanes which collectively define an interrupted circumferential edge. Additionally, the plurality of vanes also collectively define a first interrupted circumferential surface and a second interrupted circumferential surface, which intersects the first interrupted circumferential surface along an interrupted line.

In accordance with a preferred embodiment of the present invention the interrupted circumferential surfaces and the interrupted line are each centered about an additional axis, which is angled with respect to the rotation axis and intersects the rotation axis. Additionally, the interrupted line lies in a plane perpendicular to the additional axis. Additionally, at every point along the interrupted line, portions of a section extending through the additional axis at such point and through the interrupted surfaces lie perpendicular to each other.

Preferably, a geometrical relationship of the additional axis and the rotation axis and thus a geometrical orientation of the interrupted circumferential surfaces and of the interrupted line is related to the geometry of the IDTGR and provides rotatable positioning and support thereto. Additionally, one of the interrupted circumferential surfaces provides a uniplanar tilted lower support surface for the IDTGR.

In accordance with a preferred embodiment of the present invention engagement of the MBCVMAGRT with the IDTGR provides intermittent tilting of the IDTGR, which intermittently slows rotation of the enclosure and of the water stream director.

In accordance with a preferred embodiment of the present invention the IDTGR is a generally circularly symmetric, generally flat ring having a circular outer circumference which is slightly less than that of a facing inner cylindrical wall of the enclosure. Additionally, the IDTGR has generally conical top and bottom-facing surfaces which are both tilted outwardly and upwardly with respect to the additional axis.

In accordance with a preferred embodiment of the present invention the IDTGR is formed with an array of teeth, which extend radially outwardly and each have a generally triangular cross section, the number of the teeth in the array being smaller than a number of corner gear teeth formed in the enclosure and the number of corner gear teeth is not an integer multiple of the number of the teeth in the array. Additionally, due to the tilted orientation of the IDTGR relative to a plane of the corner gear teeth only some of the teeth in the array engage the corner gear teeth at any point in the rotation of the enclosure about the rotation axis.

Preferably, the IDTGR includes a top facing surface including a plurality of generally uniformally azimuthally-spaced protrusions, a number of the plurality of protrusions being substantially less than the number of the teeth of the array and a number of the protrusions corresponding to a number of desired slow rotation portions desired per full 360 degree rotation of the enclosure. Additionally, engagement of the teeth of the array of the IDTGR with the inwardly facing corner gear teeth on the enclosure causes the IDTGR to rotate relative to MBCVMAGRT about the additional axis, thus requiring the IDTGR to sequentially tilt as it approaches each radially outwardly directed engagement protrusion, thereby encountering resistance from the viscous fluid, resulting in intermittent slowing of rotation of the water stream director. Additionally, the plurality of uniformally azimuthally-spaced protrusions on the IDTGR provides intermittent further slowing of the rotation of the enclosure at a plurality of azimuthal locations, whose azimuthal positions shift with each rotation, as a result of sequential intermittent engagement of each of the plurality of protrusions with the IDTGR engagement surface.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
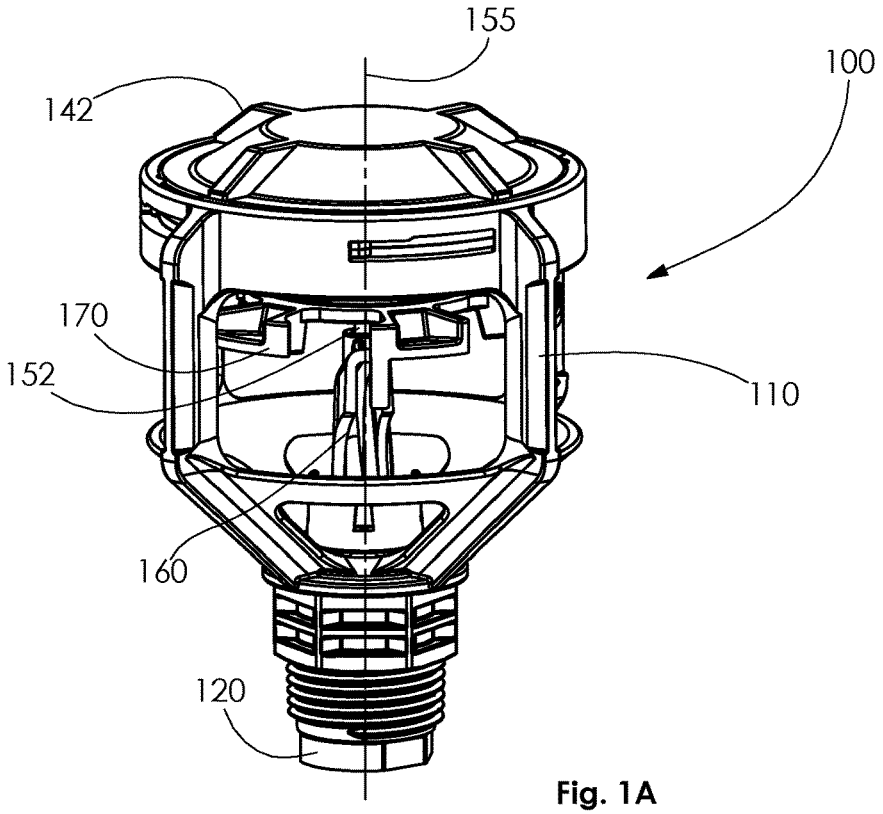
FIGS. 1A and 1B are respective simplified perspective and side view illustrations of a sprinkler, constructed and operative in accordance with a preferred embodiment of the present invention.
Figure 1B:
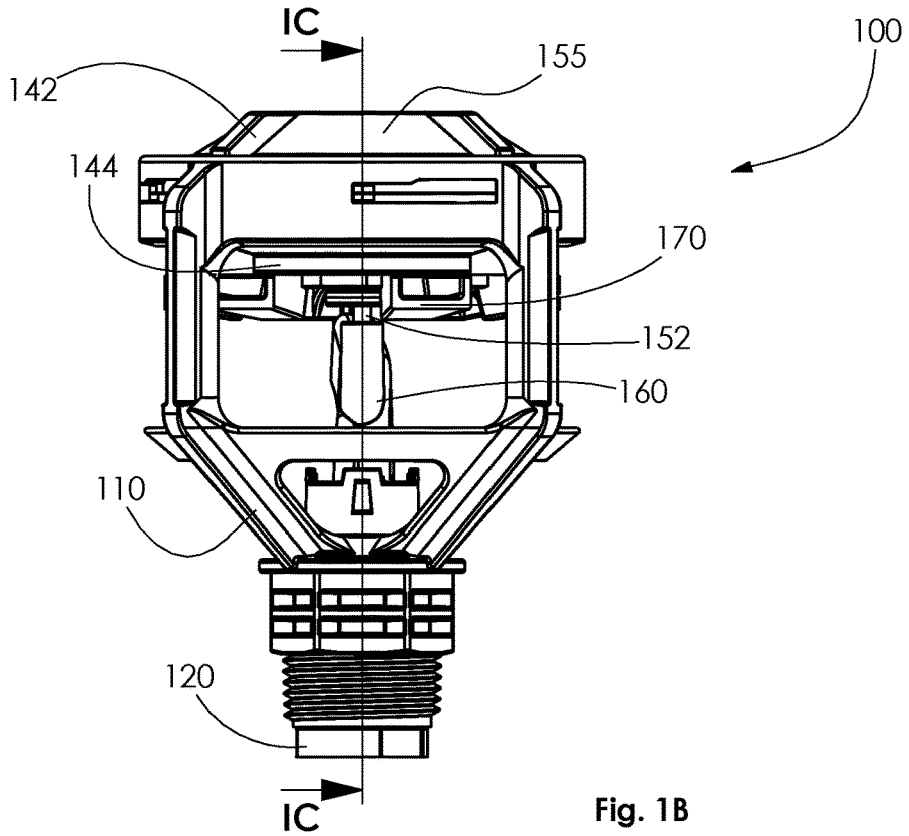
Figure 1C:
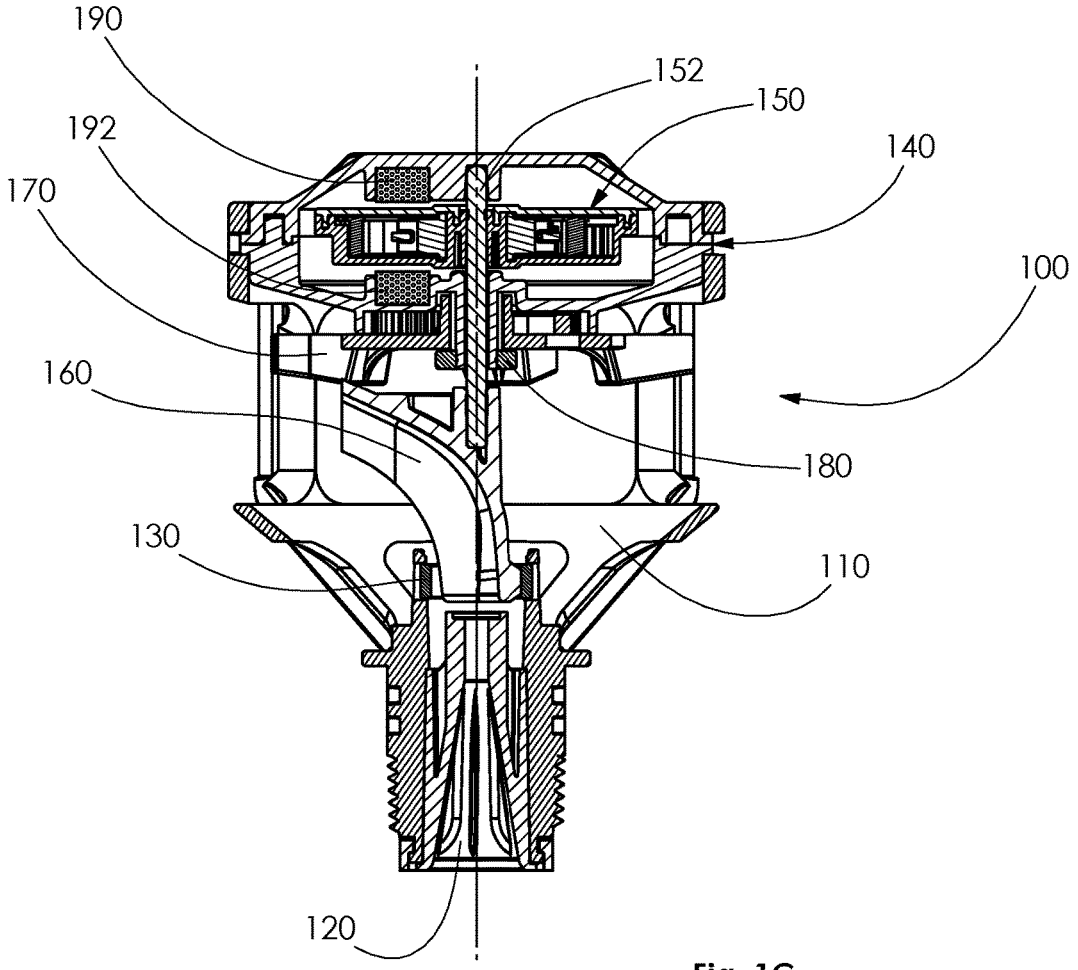
FIG. 1C is a simplified sectional view illustration of the sprinkler of FIGS. 1A & 1B, taken along lines IC-IC of FIG. 1B.
Figure 2:
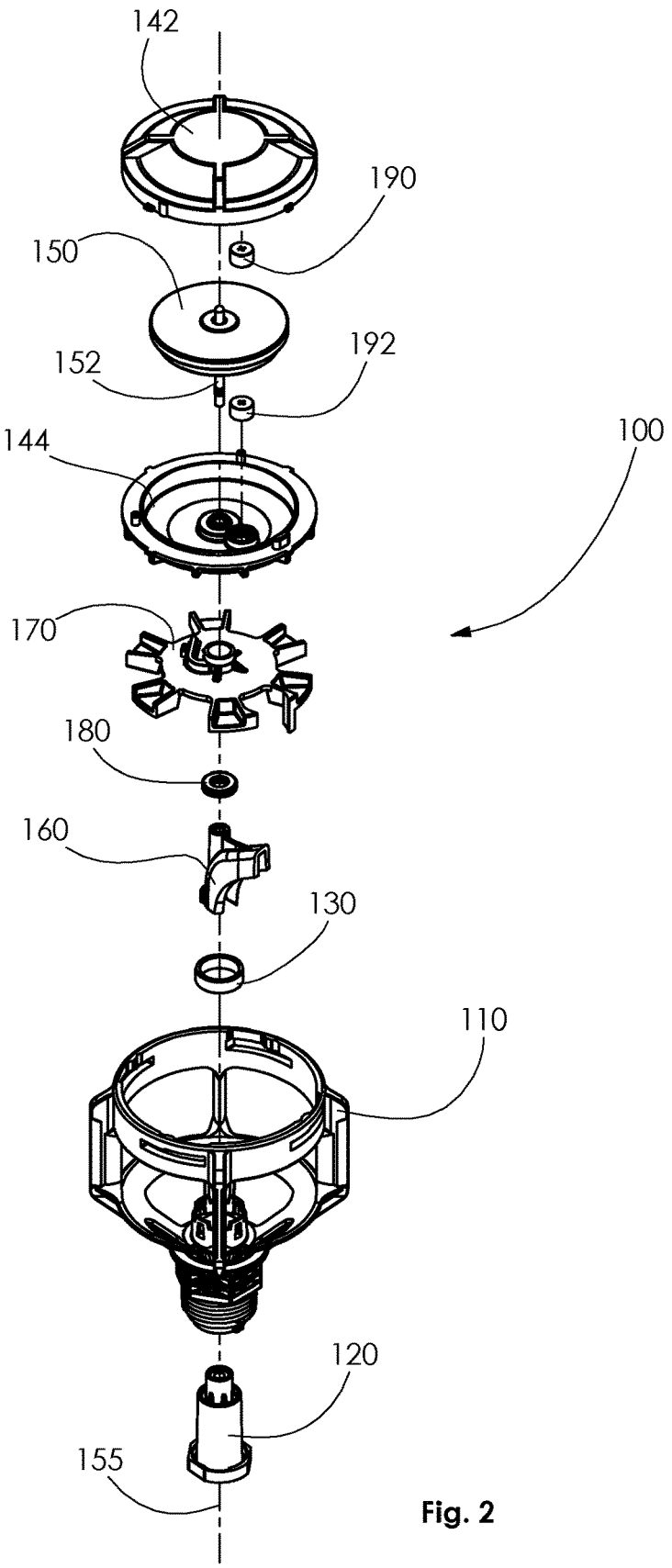
FIG. 2 is a simplified exploded view illustration of the sprinkler of FIGS. 1A-1C.

Reference is now made to FIGS. 1A and 1B, which are respective simplified perspective and side view illustrations of a sprinkler, constructed and operative in accordance with a preferred embodiment of the present invention, FIG. 1C, which is a simplified sectional view illustration of the sprinkler of FIGS. 1A & 1B, taken along lines IC-IC of FIG. 1B, and to FIG. 2, which is a simplified exploded view illustration of the sprinkler of FIGS. 1A-1C.

As seen in FIGS. 1A, 1B and 2, there is provided a sprinkler 100, including a body portion 110, which is described hereinbelow in detail with reference to FIGS. 3A-3E. A nozzle portion 120, which is described hereinbelow in detail with reference to FIGS. 4A-4E, is preferably removably and replaceably mounted onto body portion 110. A low friction, low wear, ring 130, preferably formed of a ceramic material, such as alumina, is preferably fixedly mounted onto body portion 110.

It is appreciated that sprinkler 100 preferably is employed in the upstanding operative orientation shown in FIG. 1A. Accordingly, orientational terms such as top, bottom, upper, lower, upward, downward, above, below, clockwise and counterclockwise are to be understood with reference to the orientation shown in FIG. 1A.

A housing portion 140, preferably comprising a top magnet supporting housing portion 142, which is described hereinbelow in detail with reference to FIGS. 9A-9D, and a bottom magnet supporting housing portion 144, which is described hereinbelow in detail with reference to FIGS. 8A-8D, is preferably removably mounted onto body portion 110, as by a bayonet-type mounting.

It is a particular feature of the present invention that disposed within housing portion 140 there is provided a rotating, azimuth responsive, multiple rotation speed governor assembly (RARMRSGA) 150, which is described hereinbelow in detail with reference to FIGS. 10A-10E, which is fixedly mounted onto a splined axle 152 and is arranged for rotational movement about a vertical axis 155 relative to housing portion 140 and to body portion 110.

Also fixedly mounted onto splined axle 152 is a rotating deflector 160, which is described hereinbelow in detail with reference to FIGS. 5A-5C, which receives a pressurized flow of water from nozzle portion 120 along axis 155 and deflects it radially and azimuthally while being rotated thereby about axis 155. It is a particular feature of the present invention that the speed of rotation of deflector 160 about axis 155 relative to body portion 110 is governed by multiple rotation speed governor assembly 150, which rotates together with deflector 160.

As described further hereinbelow, multiple rotation speed governor assembly 150 is operative to intermittently reduce the speed of rotation of deflector 160 about axis 155 and thereby increase a radial range of a water stream output from sprinkler 100.

Figure 6A:
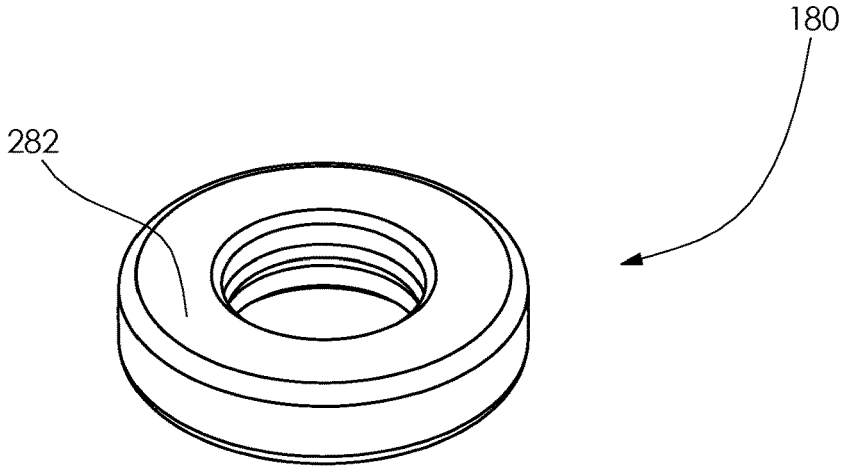
FIGS. 6A, 6B and 6C are, respectively, simplified perspective view, plan view and sectional illustrations of a retaining ring forming part of the sprinkler of FIGS. 1A-2, FIG. 6C being taken along lines VIC-VIC in FIG. 6B.
Figure 6B:
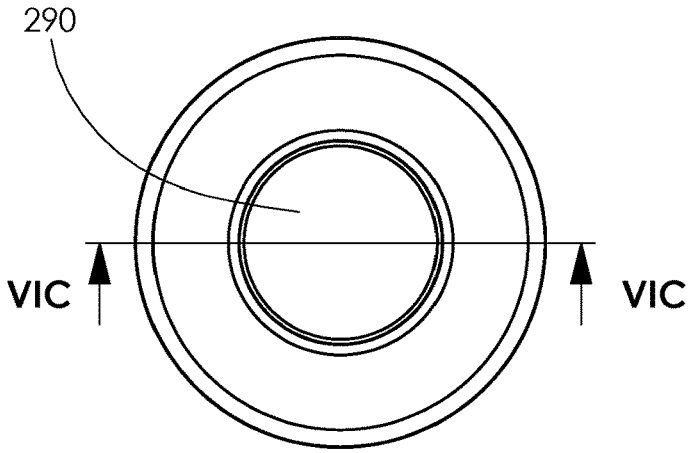
Figure 6C:
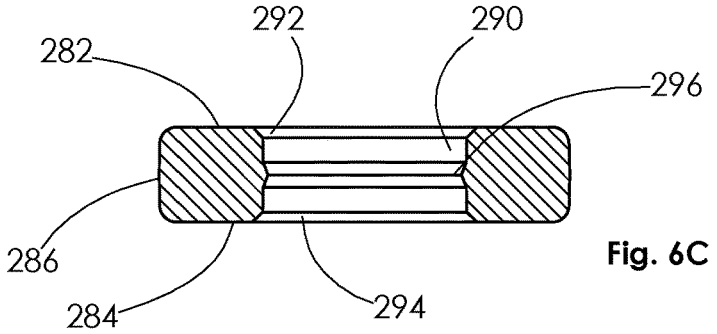
Figure 7A:
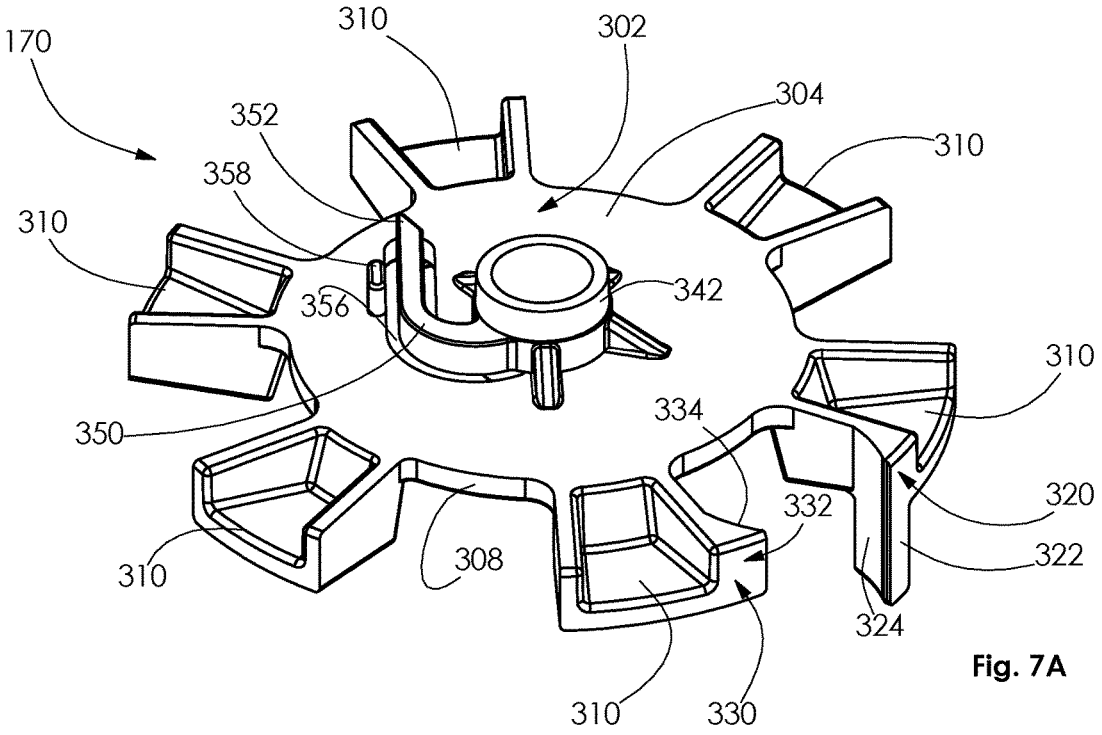
FIGS. 7A, 7B, 7C and 7D are, respectively, simplified top and bottom perspective views, top plan view and sectional illustrations of a ratcheted deflector, forming part of the sprinkler of FIGS. 1A-2, FIG. 7D being taken along lines VIID-VIID in FIG. 7C.
Figure 7B:
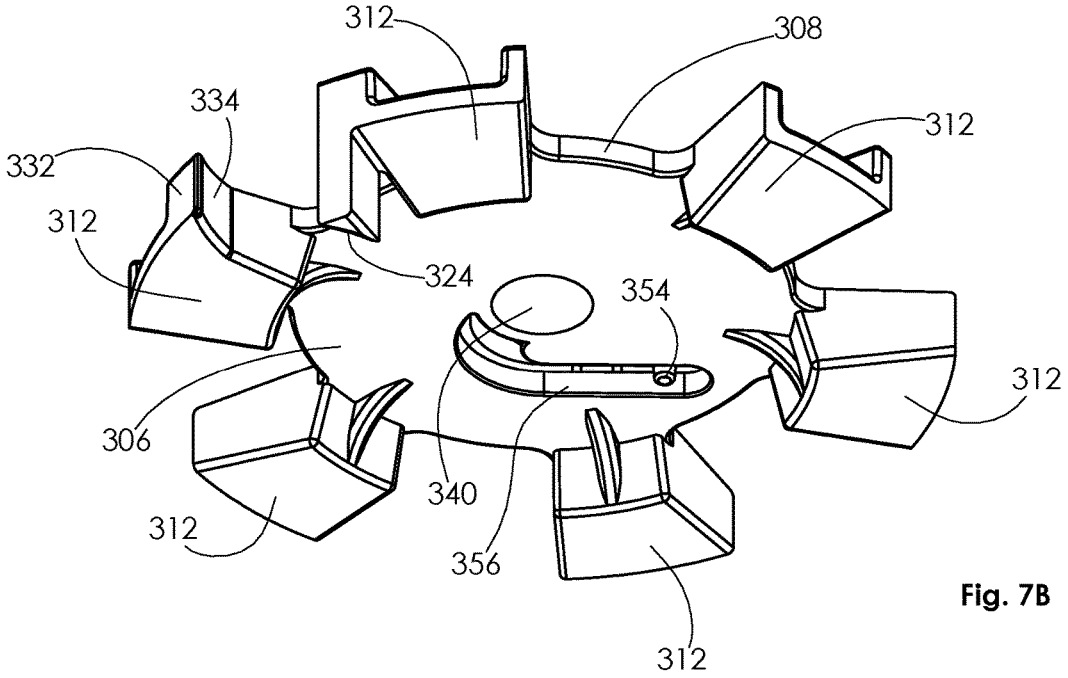
Figure 7C:
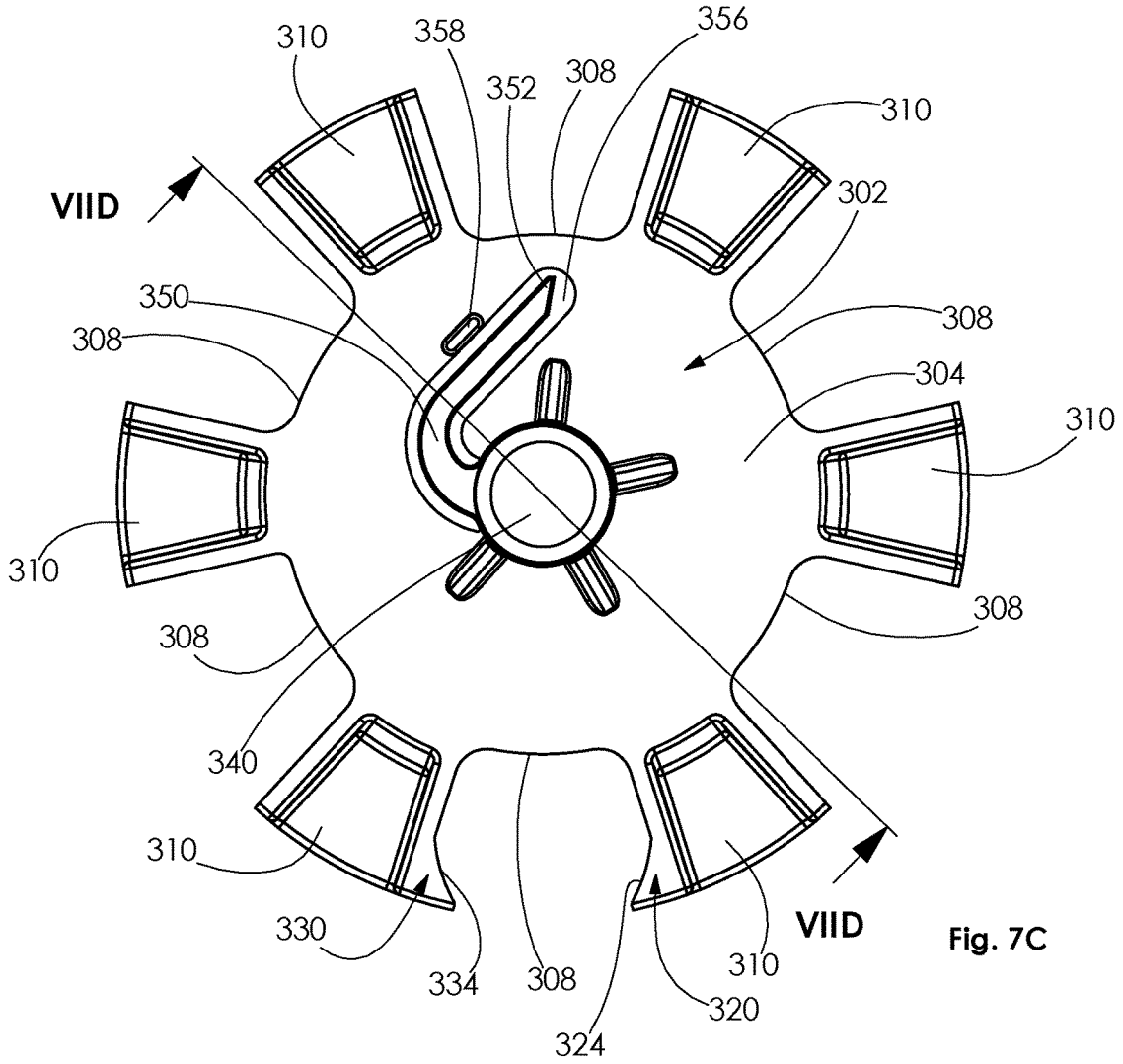
Figure 7D:
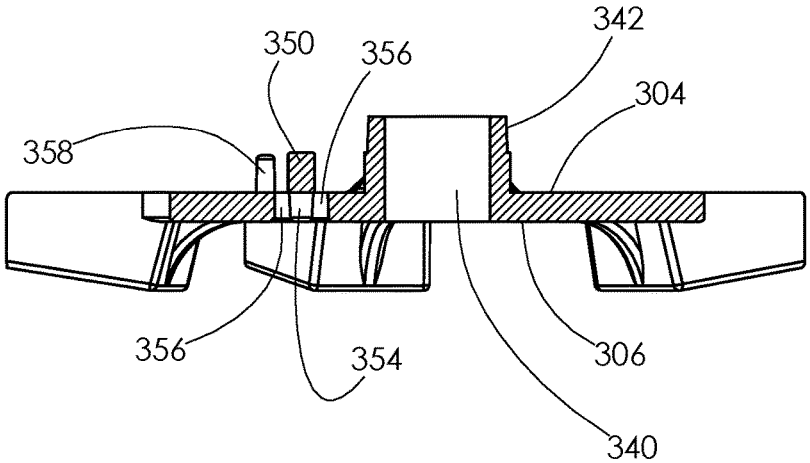

A ratcheted deflector 170, which is described hereinbelow in detail with reference to FIGS. 7A-7C, is rotatably mounted for single direction, ratchet controlled rotation relative to housing portion 140 and is retained in ratchet engagement with bottom magnet supporting housing portion 144 of housing portion 140 by a retaining ring 180, which is described hereinbelow in detail with reference to FIGS. 6A-6C. Retaining ring 180 is apertured to accommodate a lower axle locating portion of bottom magnet supporting housing portion 144 and is fixedly mounted thereonto.

Magnets 190 and 192, preferably arranged to have the same polarity, are fixedly mounted in mutual coaxial arrangement at locations arranged about an axis parallel and radially spaced from axis 155 onto respective top and bottom magnet support housing portions 142 and 144. Preferably, magnets 190 and 192 are cylindrical neodymium magnets having a diameter of 8 mm and a height of 5 mm. As described further hereinbelow, magnets 190 and 192 provide a dampening of the rotary motion of RARMRSGA 150 and deflector 160 about axis 155.

Figure 3A:
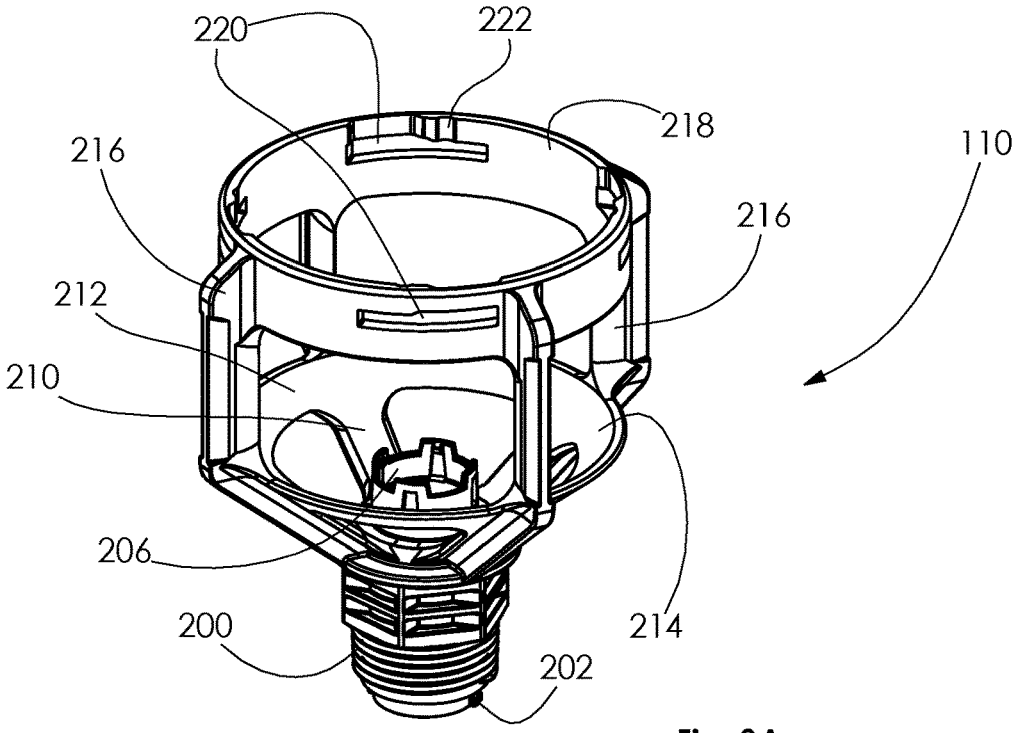
FIGS. 3A, 3B, 3C, 3D and 3E are, respectively, simplified pictorial view, side view, and first, second and third sectional illustrations of a body portion of the sprinkler of FIGS. 1A-2, taken along respective lines IIIC-IIIC, IIID-IIID and IIIE-IIIE in FIG. 3B.
Figure 3B:
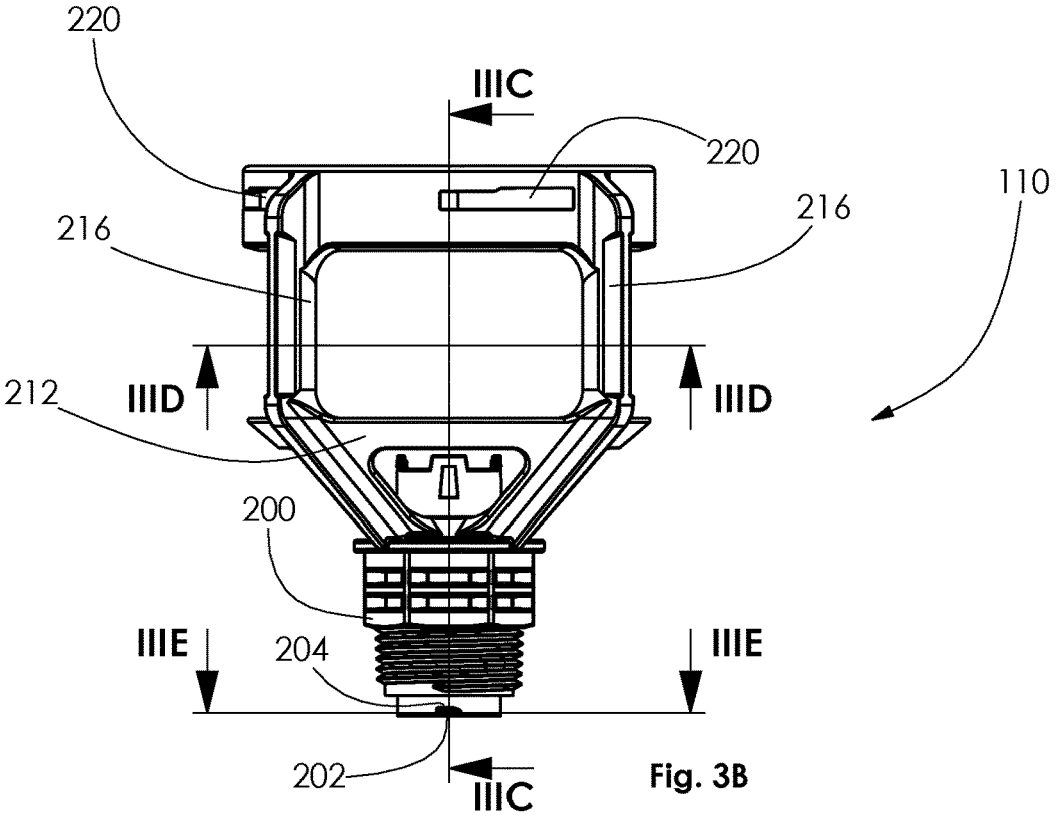
Figure 3C:
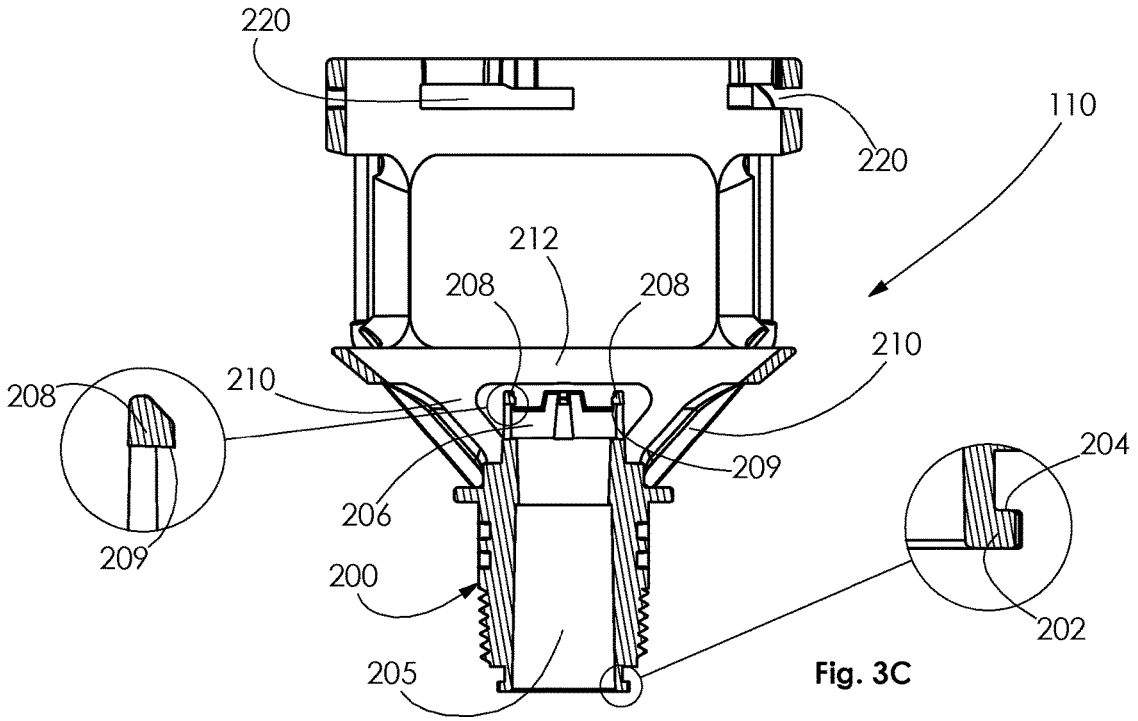
Figure 3D:
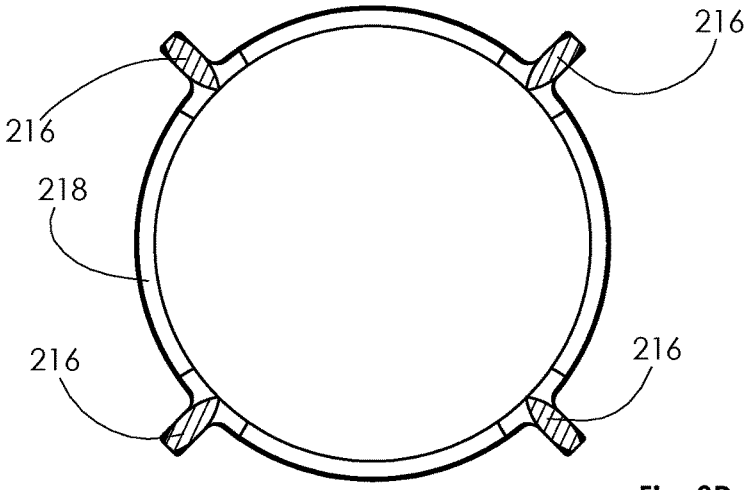

Reference is now made to FIGS. 3A, 3B, 3C, 3D and 3E, which are respectively simplified pictorial view, side view, and first, second and third sectional illustrations of body portion 110 of the sprinkler of FIGS. 1A-2, the sectional views taken along respective lines IIIC-IIIC, IIID-IIID and IIIE-IIIE in FIG. 3B.

As seen in FIGS. 3A-3E, body portion 110 preferably comprises an externally threaded hollow base portion 200 preferably having at least one nozzle retaining bayonet mount protrusion 202 formed on a lower, outer cylindrical surface thereof and having a transverse recess 203 and a top surface 204. Hollow base portion 200 preferably defines a nozzle-receiving bore 205 for receiving nozzle portion 120 (FIGS. 1A-2). Above nozzle-receiving bore 205 is preferably formed a ring receiving and retaining seat 206, which is configured for fixed mounting therein of low friction, low wear, ring 130 and retention thereof by a plurality of snap fit fingers 208 having undercut engagement edges 209.

Extending upwardly and radially outwardly from base portion 200 are a plurality of support arms 210, which preferably are joined by a ring portion 212 having a generally upwardly and radially outwardly conical upper ring surface 214. Extending upwardly from ring surface 214 and radially outwardly therefrom are a plurality of upstanding arms 216 which terminate at a circumferential ring 218. Ring 218 preferably is formed with a plurality of bayonet mounting slots 220 arranged for removably bayonet mounting of housing portion 140 (FIGS. 1A-2) onto circumferential ring 218. In accordance with a preferred embodiment of the present invention a pair of protrusion retaining sockets 222 are provided for securely retaining corresponding protrusions 490 of top magnet supporting housing portion 142. (FIGS. 9A-9D).

Figure 4A:
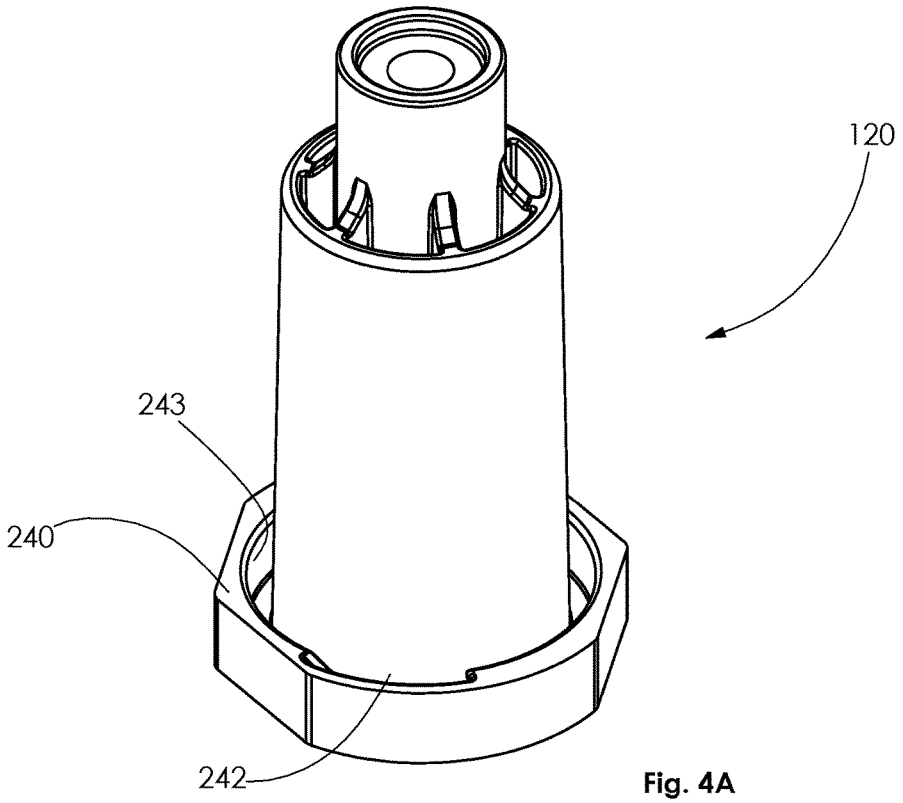
FIGS. 4A, 4B, 4C, 4D and 4E are, respectively, simplified pictorial view, side view, first and second sectional illustrations of a nozzle portion of the sprinkler of FIGS. 1A-2, taken along respective lines IVC-IVC, IVD-IVD in FIG. 4B, and a third sectional illustration taken along lines IVE-IVE in FIG. 4D.
Figure 4B:
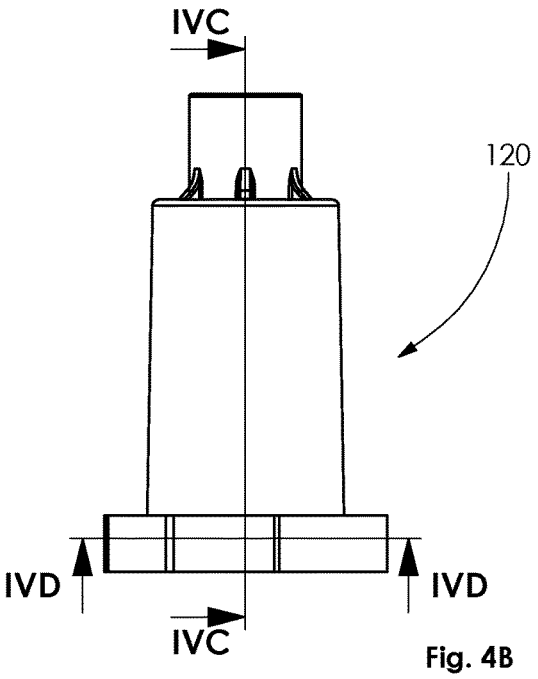
Figure 4C:
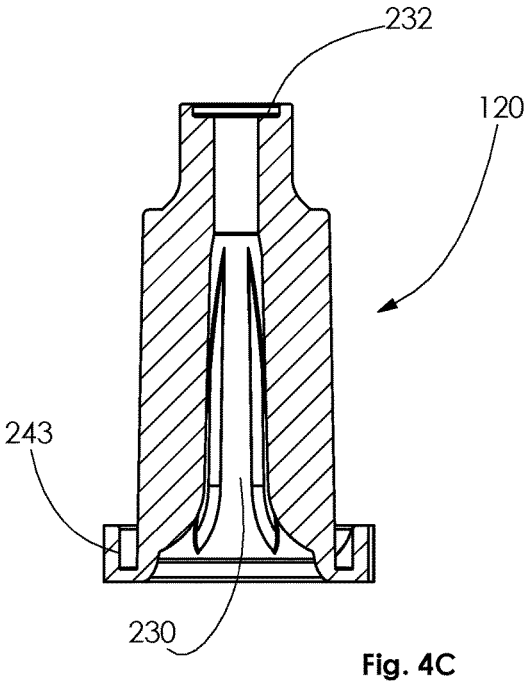
Figure 4D:
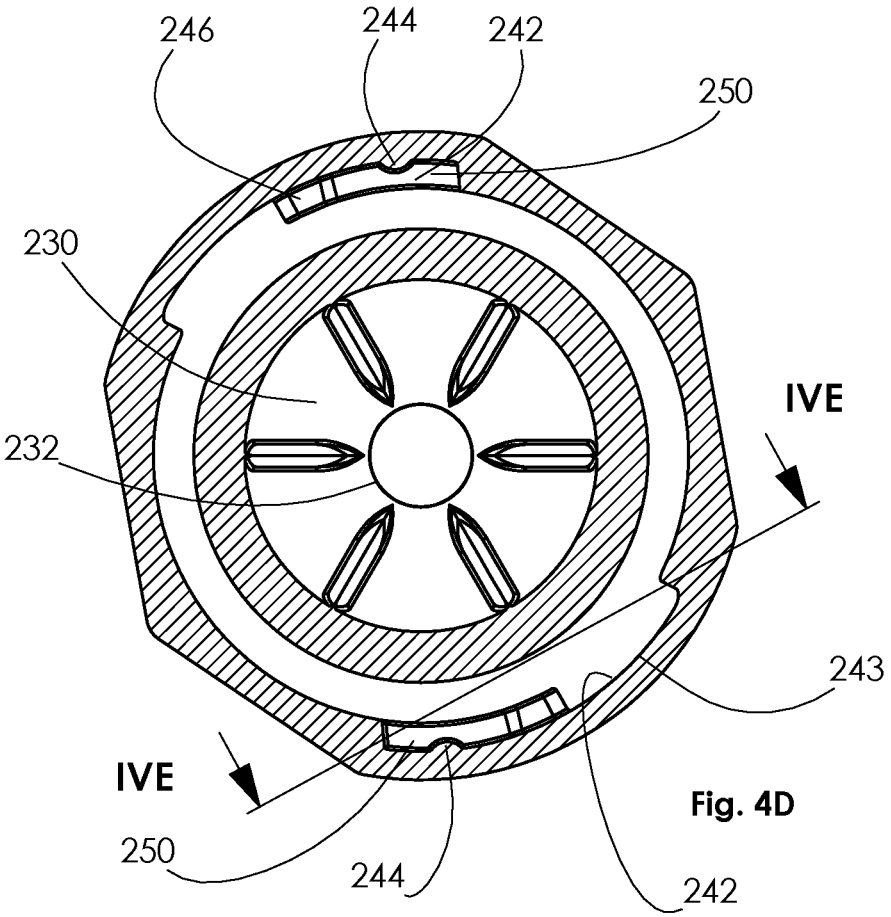
Figure 4E:
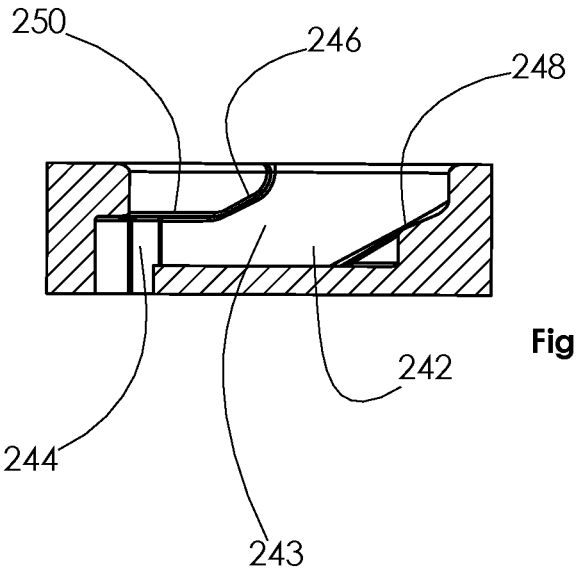

Reference is now made to FIGS. 4A, 4B, 4C, 4D and 4E, which are, respectively, simplified pictorial view, side view, first and second sectional illustrations of nozzle portion 120 of the sprinkler of FIGS. 1A-2, taken along respective lines IVC-IVC, IVD-IVD in FIG. 4B, and a third sectional illustration taken along lines IVE-IVE in FIG. 4D.

As seen in FIGS. 4A-4E, nozzle portion 120 comprises a generally cylindrical, but preferably slightly conical element arranged to removably fit into bore 205 of body portion 110 and defines a central, axial, generally conical water pathway 230, preferably having a recessed outlet 232. It is a particular feature of an embodiment of the invention that the bottom of nozzle portion 120 is configured to define a bayonet connector rim portion 240 including at least one cutout 242, at least one retaining surface 243 including a protrusion 244, at least one sloping engagement surface 246, at least one sloping disengagement surface 248 and at least one downward-facing engagement surface 250 for removable bayonet engagement with at least one retaining bayonet mount protrusion 202 of body portion 110.

Figure 5A:
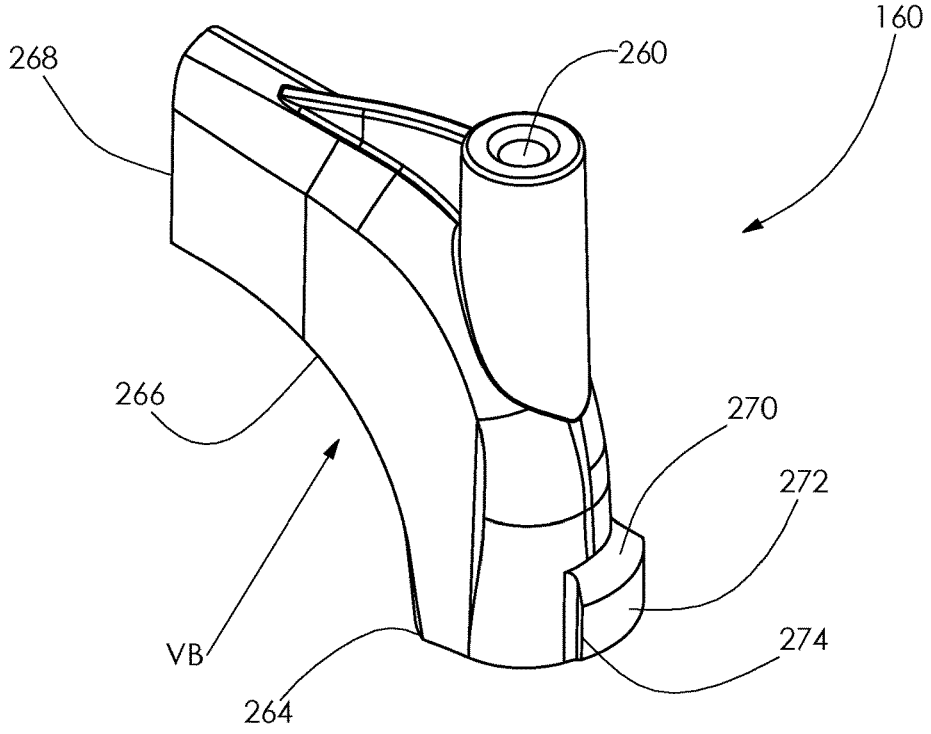
FIGS. 5A, 5B, 5C and 5D are, respectively, simplified first and second pictorial views of a rotating deflector portion of the sprinkler of FIGS. 1A-2, FIG. 5B being taken along an arrow VB in FIG. 5A, a plan view, taken along an arrow VC in FIG. 5B, and a partial sectional view, taken along lines VD-VD in FIG. 5C.
Figure 5B:
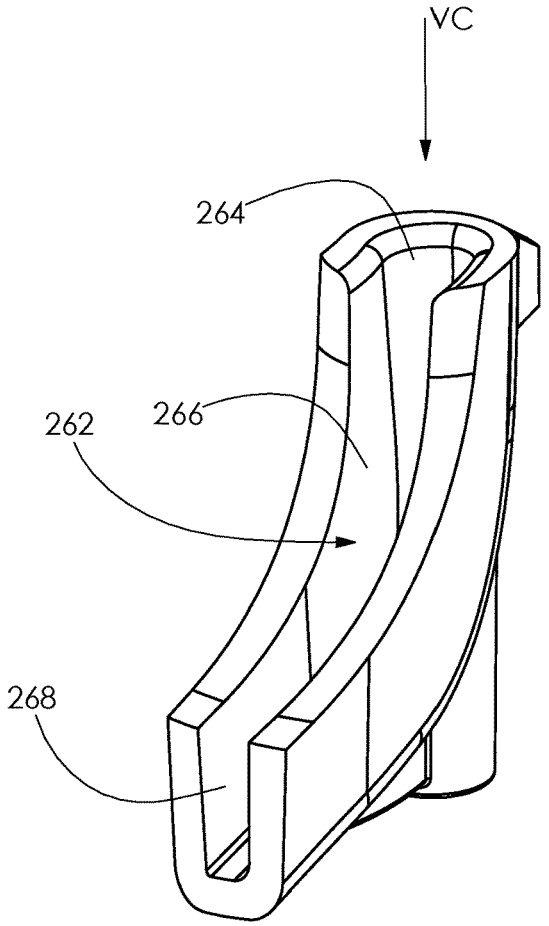
Figure 5C:
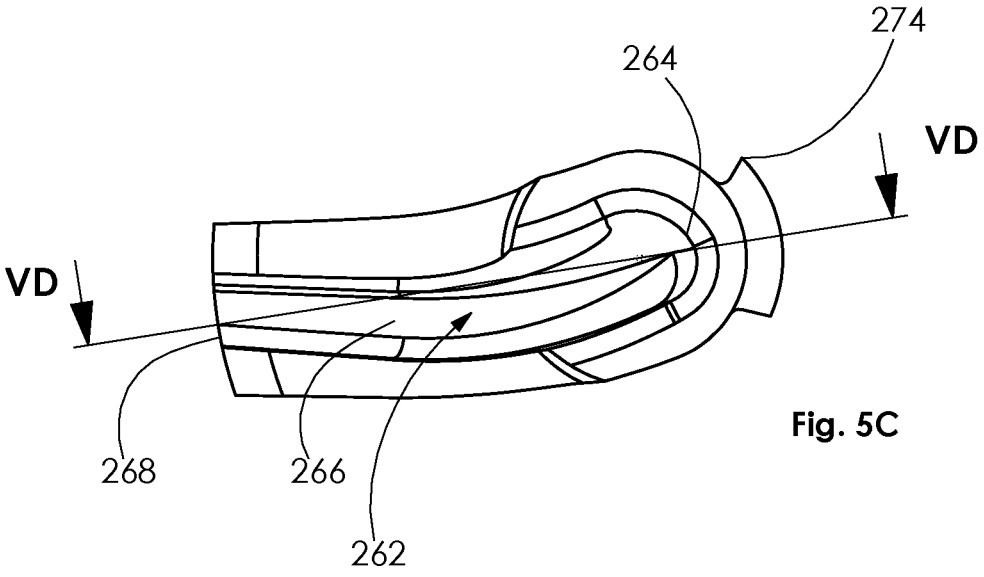
Figure 5D:
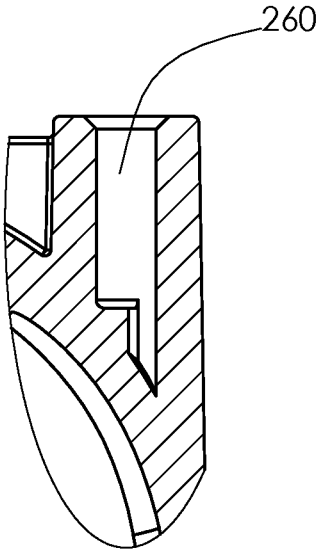

Reference is now made to FIGS. 5A, 5B, 5C and 5D, which are, respectively, simplified first and second pictorial views of rotating deflector portion 160 of the sprinkler of FIGS. 1A-2, FIG. 5B being taken along an arrow VB in FIG. 5A, a plan view, taken along an arrow VC in FIG. 5B, and a partial sectional view taken along lines VD-VD in FIG. 5C.

As seen in FIGS. 5A-5D, rotating deflector portion 160 defines a bore 260 for fixedly receiving splined axle 152 and a water flow path 262 which is curved in three-dimensions from an inlet end 264, which receives a generally vertical pressurized flow of water from nozzle portion 120, through an upwardly outwardly and tangentially curved portion 266 to an outlet end 268, which directs a stream of pressurized water in a direction having upward, outward and tangential components relative to an imaginary cylinder along axis 155.

It is a particular feature of an embodiment of the present invention that adjacent to inlet end 264 and on an outer back surface thereof, there is provided a protrusion 270 defining a low friction, low wear support and rotary engagement surface 272 for engagement with ring 130 during operation of the sprinkler. It is an additional particular feature of a preferred embodiment of the present invention that protrusion 270 is formed with a pointed azimuthal clockwise end 274 in the sense of FIGS. 1A and 5A.

Reference is now made to FIGS. 6A, 6B and 6C, which are, respectively, simplified perspective, plan and sectional illustrations of retaining ring 180 forming part of the sprinkler of FIGS. 1A-2, FIG. 6C being taken along lines VIC-VIC in FIG. 6B.

As seen in FIGS. 6A-6C, retaining ring 180 is generally in the shape of a generally circular cylindrical disk having a generally circular flat top surface 282, a generally circular flat bottom surface 284 and a generally circular cylindrical outer surface 286, which joins top and bottom surfaces 282 and 284 at rounded edges. Formed at the center of retaining ring 180 is an axial bore 290, which defines a tapered edge 292 with respect to top surface 282 and a tapered edge 294 with respect to bottom surface 284. Disposed generally midway between top surface 282 and bottom surface 284 is an inwardly facing annular protrusion 296, preferably having a generally triangular cross section.

Reference is now made to FIGS. 7A, 7B, 7C and 7D, which are, respectively, simplified top and bottom perspective view, top plan view and sectional illustrations of ratcheted deflector 170, forming part of the sprinkler of FIGS. 1A-2, FIG. 7D being taken along lines VIID-VIID in FIG. 7C.

As seen in FIGS. 7A-7D, ratcheted deflector 170 comprises a generally disk-like element including a generally planar, generally circular inner plate 302 having a top surface 304, a bottom surface 306 and a circumferential edge 308. Extending outwardly from circumferential edge 308 are a plurality of mutually equally azimuthally spaced deflector portions 310, each of which defines a downward-facing deflector surface 312. One of deflector portions 310, here designated by reference numeral 320, is preferably formed with a downwardly extending counterclockwise rotational drive impact portion 322 defining an impact surface 324. An adjacent one of deflector portions 310, here designated by reference numeral 330, is preferably formed with a clockwise rotational drive impact portion 332 defining an impact surface 334, which generally faces impact surface 324. The provision of impact surfaces 324 and 334, which are sequentially impacted by a pressurized water stream, together with a ratchet mechanism, which is described hereinbelow, provides stepwise intermittent counterclockwise rotation of ratcheted deflector 170.

Generally circular inner plate 302 is formed with a central aperture 340, which is surrounded by a collar portion 342 extending about aperture 340 above top surface 304 of inner plate 302. Extending radially and azimuthally outwardly from collar portion 342 above inner plate 302 is a flexible ratchet finger 350 having a pointed outer end 352 and a downwardly extending protrusion 354. Flexible ratchet finger 350 is generally surrounded by a peripheral cut-out formed in inner plate 302, which defines a range of permissible displacement of flexible ratchet finger 350 by defining a slot 356 in which downwardly extending protrusion 354 is located. An upwardly extending stop protrusion 358 extending upwardly from central plate 302 adjacent slot 352 also serves to limit the range of permissible displacement of flexible ratchet finger 350.

Figure 8A:
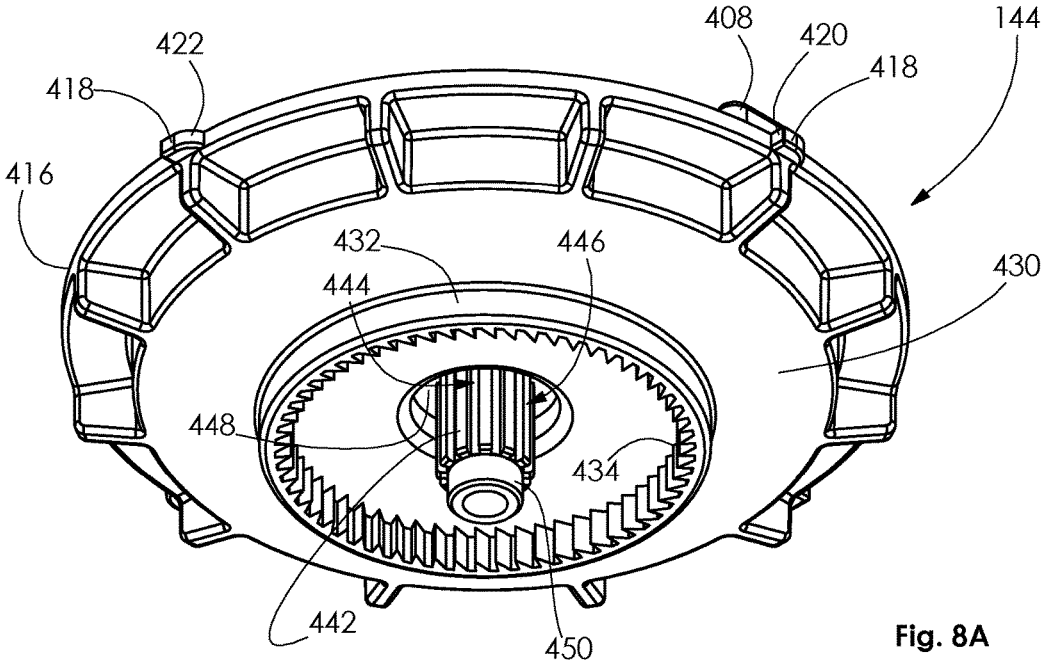
FIGS. 8A, 8B, 8C, 8D and 8E are, respectively, simplified top and bottom perspective view, top and bottom plan view and sectional illustrations of a bottom magnet supporting housing portion, forming part of the sprinkler of FIGS. 1A-2, FIG. 8E being taken along lines VIIIE-VIIIE in FIG. 8C.
Figure 8B:
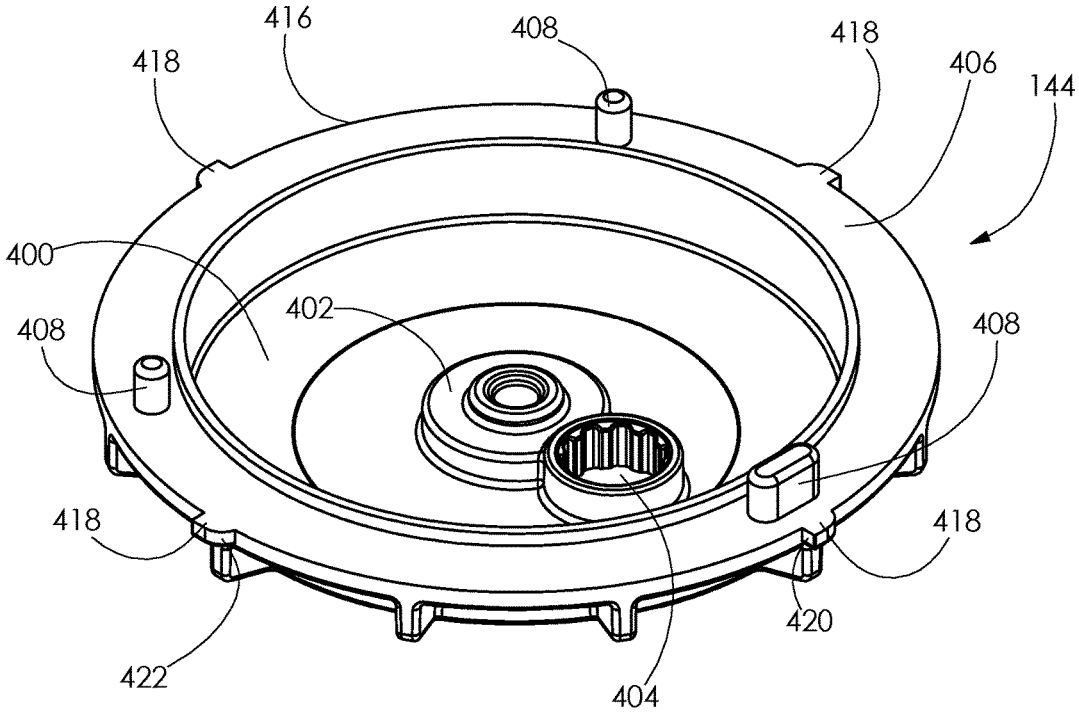
Figure 8C:
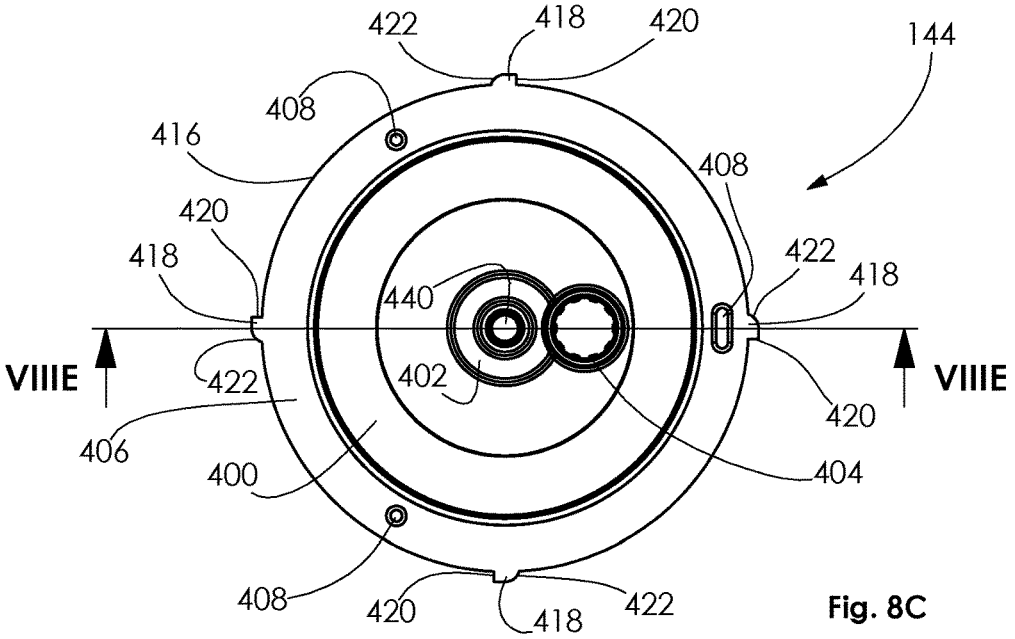
Figure 8D:
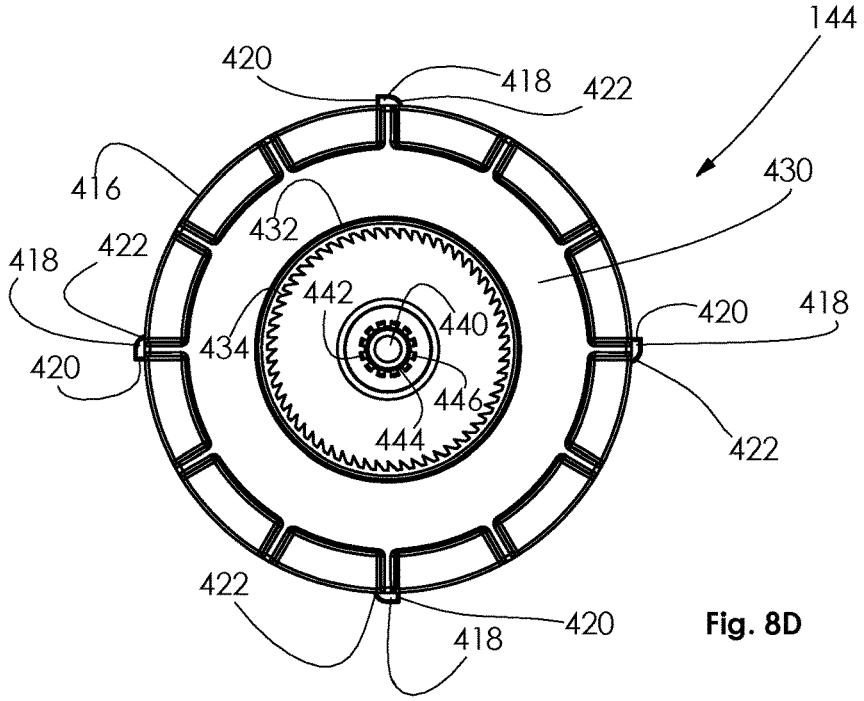
Figure 8E:
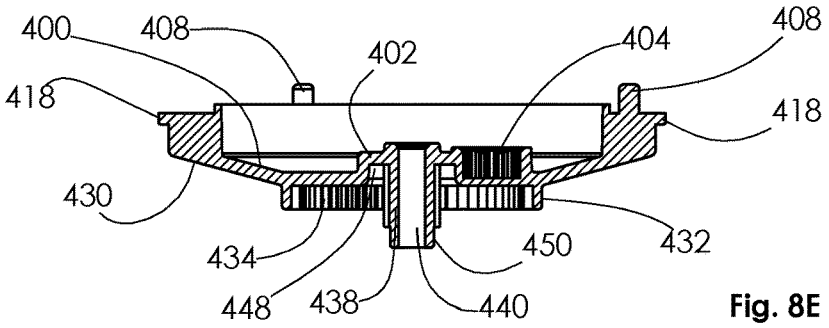

Reference is now made to FIGS. 8A, 8B, 8C, 8D and 8E, which are, respectively, simplified top and bottom perspective, top and bottom plan and sectional illustrations of bottom magnet supporting housing portion 144, forming part of the sprinkler of FIGS. 1A-2, FIG. 8E being taken along lines VIIIE-VIIIE in FIG. 8C. Bottom magnet supporting housing portion 144 is a generally but not entirely circular symmetric element having a generally circular symmetric inner surface 400 defining an apertured central hub 402 but having a single, preferably splined, magnet retaining socket 404 adjacent central hub 402.

A peripheral edge portion 406 of inner surface 400 includes a plurality of attachment protrusions 408, which are preferably not circular symmetric or identical, so as to ensure that mutual engagement of bottom magnet supporting housing portion 144 and top magnet supporting housing portion 142 can only take place in a predetermined mutual azimuthal relationship in which the magnets supported therein are mutually axially aligned.

A peripheral edge portion 416 of bottom magnet supporting housing portion 144 includes a plurality of radially outwardly extending removable engagement protrusions 418, each having a radially extending clockwise-facing edge 420 and a curved counterclockwise-facing edge 422.

Bottom magnet supporting housing portion 144 preferably includes a circularly symmetric outer surface 430 including a downwardly depending ring 432 having an inner-facing circular array of ratchet teeth 434 surrounding a central collar portion 438, which defines a downward extension of central hub 402 and defines together therewith a central axial bore 440. Central collar portion 438 is preferably formed with elongate splines 442 on a part 444 of a generally cylindrical outer surface 446 thereof, which part extends downwardly from a recessed downwardly facing annular surface 448 and terminates in a generally circular cylindrical outer end surface 450, which is tightly engaged by retaining ring 180.

Figure 9A:
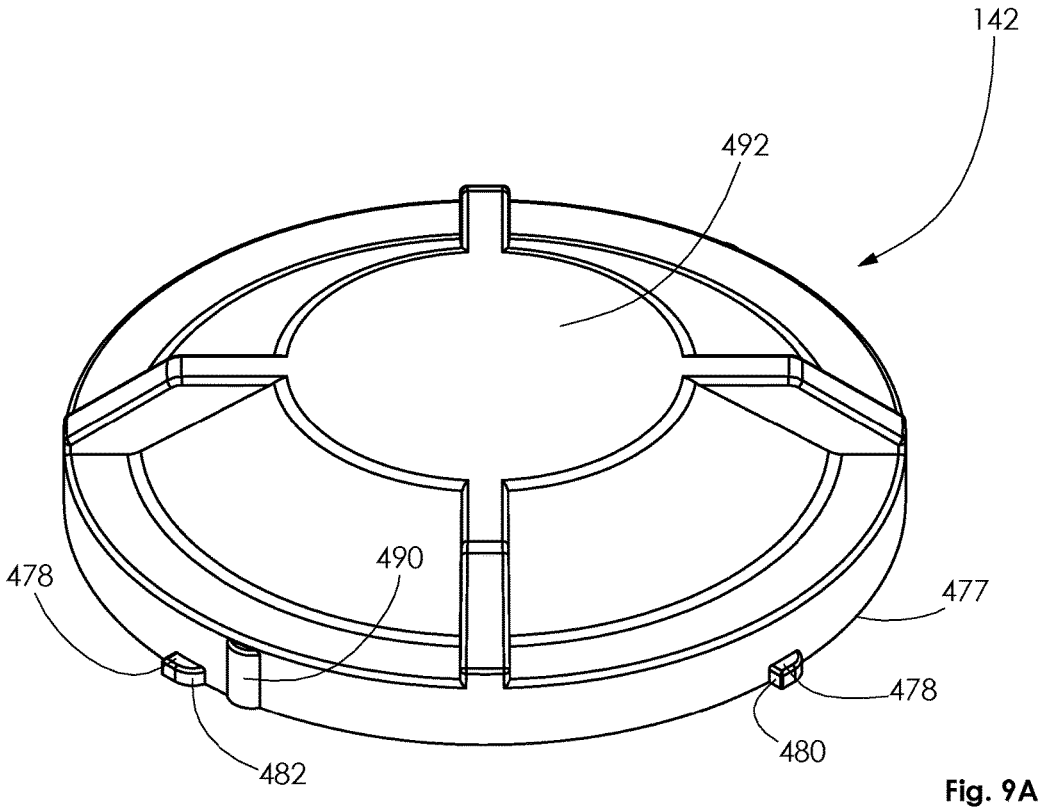
FIGS. 9A, 9B, 9C and 9D are, respectively, simplified top and bottom perspective views, bottom plan view and sectional illustrations of a top magnet supporting housing portion forming part of the sprinkler of FIGS. 1A-2, FIG. 9D being taken along lines IXD-IXD in FIG. 9C.
Figure 9B:
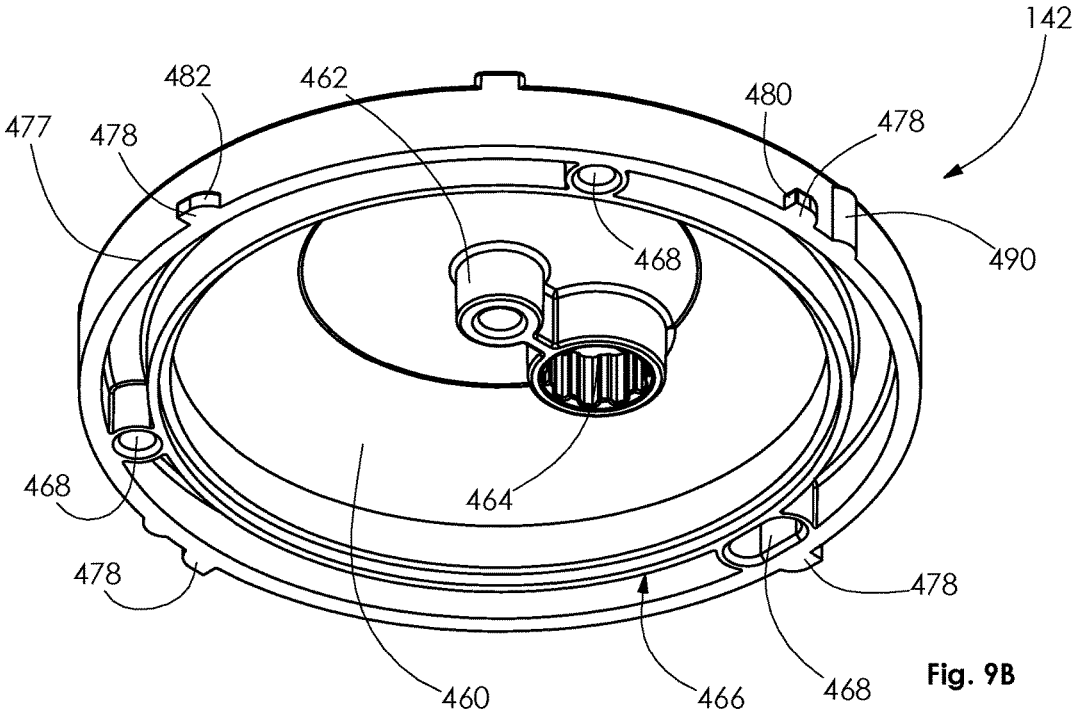
Figure 9C:
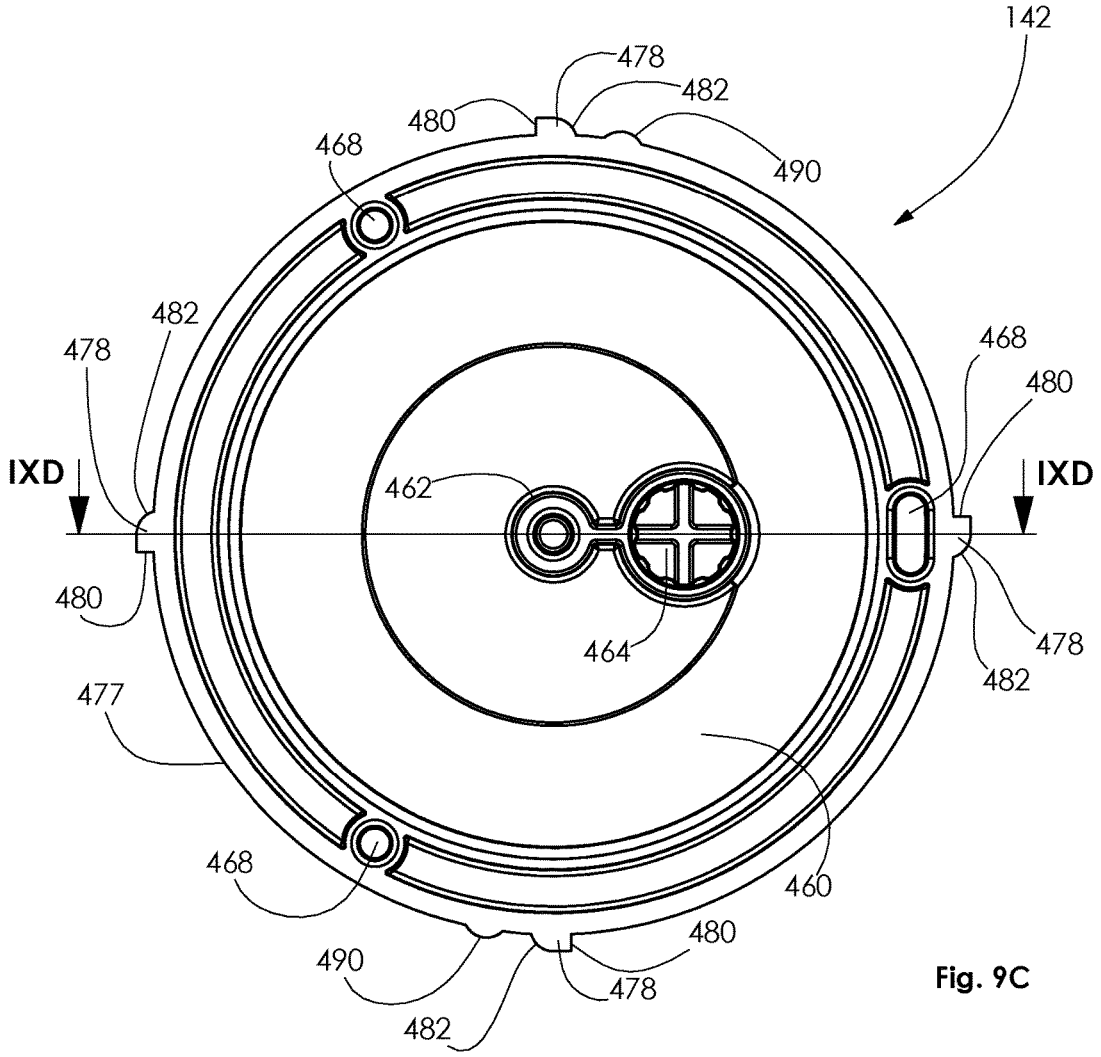
Figure 9D:
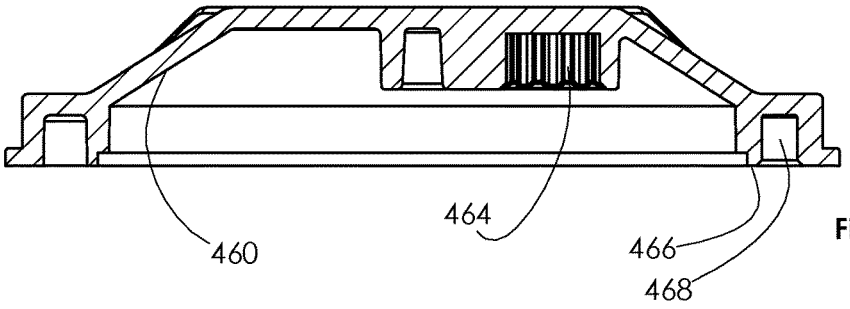

Reference is now made to FIGS. 9A, 9B, 9C and 9D, which are, respectively, simplified top and bottom perspective, bottom plan and sectional illustrations of top magnet supporting housing portion 142 forming part of the sprinkler of FIGS. 1A-2, FIG. 9D being taken along lines IXD-IXD in FIG. 9C.

Top magnet supporting housing portion 142 is a generally but not entirely circular symmetric element having a generally circular symmetric inner surface 460 defining an apertured central hub 462 but having a single, preferably splined, magnet retaining socket 464 adjacent central hub 462.

A peripheral edge portion 466 of inner surface 460 includes a plurality of attachment sockets 468 for receiving protrusions 408, which sockets and protrusions are preferably not circular symmetric or identical, so as to ensure that mutual engagement of bottom magnet supporting housing portion 144 and top magnet supporting housing portion 142 can only take place in a predetermined mutual azimuthal relationship in which the magnets supported therein are mutually axially aligned.

A peripheral edge portion 477 of top magnet supporting housing portion 142 includes a plurality of radially outwardly extending removable engagement protrusions 478, each having a radially extending clockwise-facing edge 480 and a curved counterclockwise-facing edge 482 and are preferably aligned with protrusions 418 (FIGS. 8A-8E) when the housing is assembled. In accordance with a preferred embodiment of the present invention, peripheral edge portion 477 of top magnet housing portion 142 also includes a plurality of elongate protrusions 490, each having a semicircular cross section, which removably engage corresponding sockets 222 formed in body portion 110.

Top magnet supporting housing portion 142 preferably includes a circularly symmetric outer surface 492.

Reference is now made to FIGS. 10A, 10B, 10C, 10D, 10E and 11, which are, respectively, simplified top and bottom perspective, top and bottom plan view illustrations, a side view illustration and an exploded view illustration of a first embodiment, here designated RARMRSGA 500, of a rotating, azimuth responsive, multiple rotation speed governor assembly (RARMRSGA) 150 forming part of the sprinkler of FIGS. 1A-2. As seen in FIGS. 10A-10E and 11, RARMRSGA 500 preferably includes a cover portion 502 and a base portion 504, to which the cover portion is sealingly and fixedly attached and which together define a sealed enclosure for containing a viscous fluid, typically polydimethylsiloxane, preferably having a viscosity of between 50,000 and 100,000 mPa·s. It is a particular feature of embodiments of the present invention that the viscous fluid does not fully fill the enclosure and that air is also present within the sealed enclosure.

Base portion 504 defines, inter alia, a central hub 506, arranged about axis 155 and having a central aperture 508 through which extends splined axle 152 in fixed relationship therewith. Central hub 506 preferably defines a generally circularly cylindrical outer hub surface 509.

Disposed within the enclosure defined by mutually sealed cover portion 502 and base portion 504 is a magnet bearing centrifugal viscous material accelerator (MBCVMA) 510, having a central generally circularly cylindrical bore 512 configured for mutually rotatable mounting of MBCVMA 510 onto circularly cylindrical outer hub surface 509 for relatively low friction rotation of base portion 504 about axis 155 relative to MBCVMA 510. A magnet 514, preferably a cylindrical neodymium magnet having a diameter of 8 mm and a height of 5 mm and arranged to have a polarity opposite to that of magnets 190 and 192, is fixedly mounted onto MBCVMA 510. Magnet 514 provides, together with magnets 190 and 192, dampening of the rotary motion of RARMRSGA 150 and deflector 160 about axis 155, similar to the magnet dampening provided in the sprinkler described in U.S. Pat. No. 8,998,109, the disclosure of which is hereby incorporated by reference.

An intermediate geared ring 520 is disposed within enclosure defined by mutually sealed cover portion 502 and base portion 504, intermediate MBCVMA 510 and an interior geared surface of base portion 504.

Figure 12A:
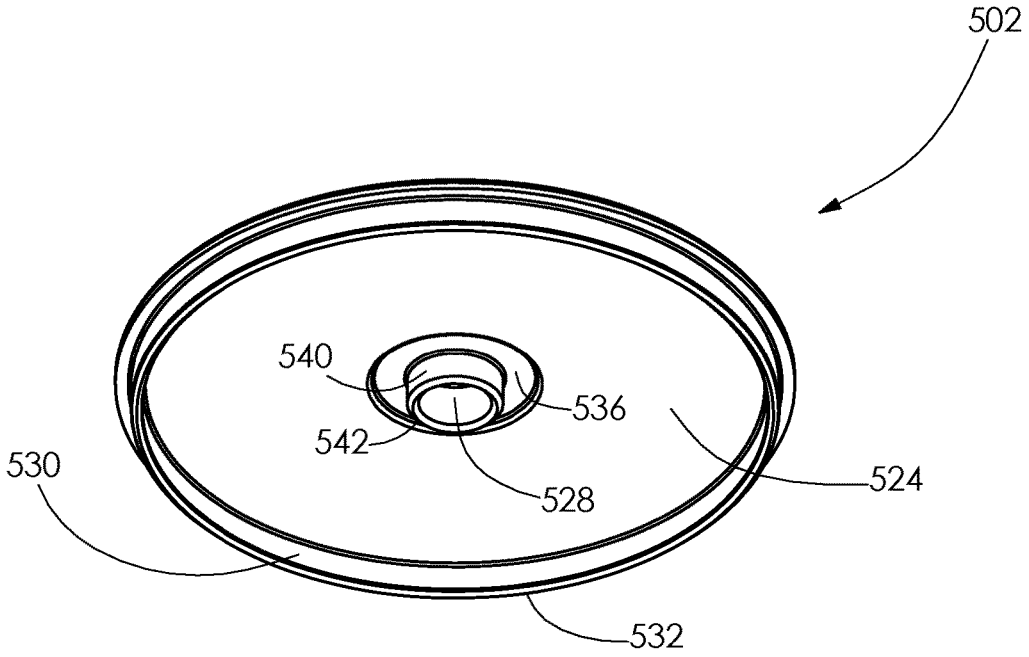
FIGS. 12A and 12B are simplified respective top and bottom perspective views of a cover portion of the rotating, azimuth responsive, multiple rotation speed governor assembly (RARMRSGA) of FIG. 11.
Figure 12B:
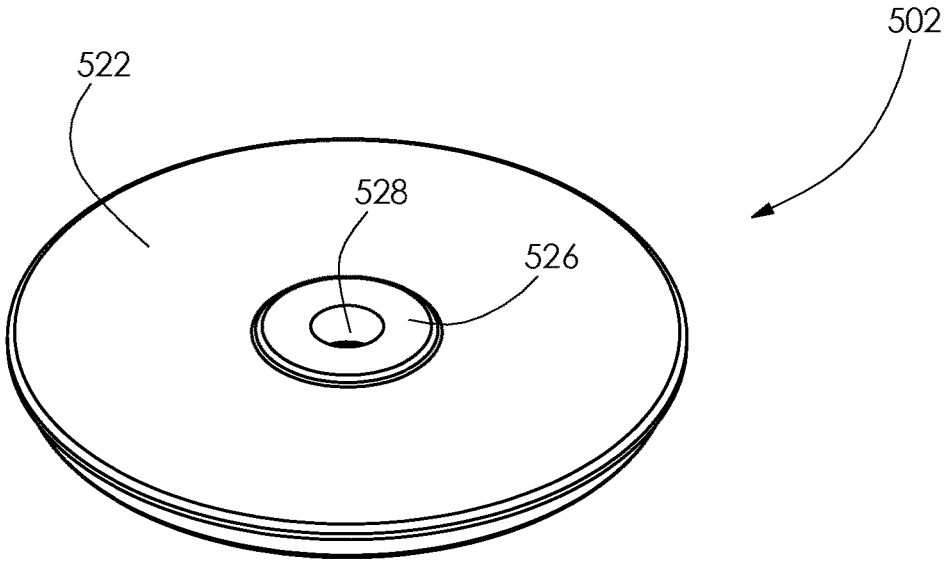

Cover portion 502 is illustrated in FIGS. 12A and 12B. As seen in FIGS. 12A and 12B, cover portion 502 includes a generally flat disk-like top surface 522 and a generally flat disk-like bottom surface 524. Generally flat top surface 522 preferably includes a raised hub surface 526 arranged circumferentially of a bore 528, which accommodates a portion of central hub 506 of base portion 504. Surrounding bottom surface 524 there is preferably provided a depending circular rim 530, having a depending edge 532, which is preferably configured for sealed ultrasonic welding to a corresponding edge of base portion 504.

Generally flat bottom surface 524 preferably includes a recessed hub surface 536 surrounding a depending circular rim 540, having a depending edge 542, which is preferably configured for sealed ultrasonic welding to a corresponding edge of base portion 504.

It is a particular feature of an embodiment of the present invention that splined axle 152 is preferably formed with a pair of axially mutually spaced, axially splined regions 544 and 546 as well as a circumferential recess 548. Axially splined region 544 and circumferential recess 548 are provided for fixed locking engagement between base portion 504 and splined axle 152 and axially splined region 546 is provided for axially removable mounting thereon of deflector 160.

Figure 10A:
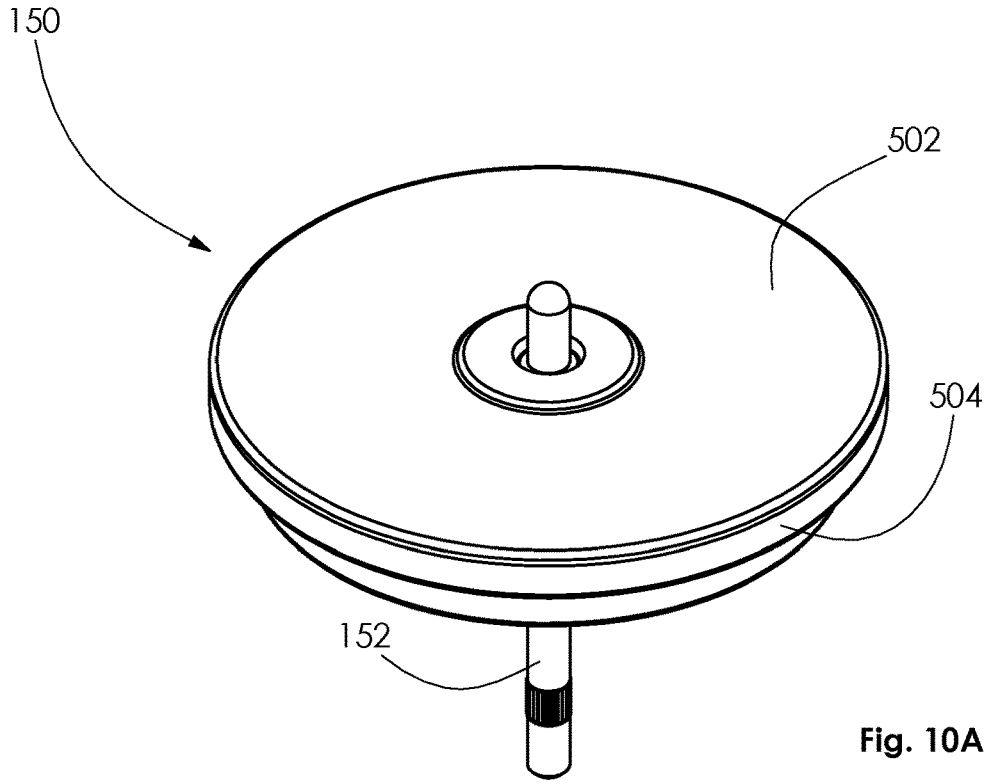
FIGS. 10A, 10B, 10C, 10D and 10E are, respectively, simplified top and bottom perspective view, top and bottom plan view illustrations and a side view illustration of a rotating, azimuth responsive, multiple rotation speed governor assembly (RARMRSGA) forming part of the sprinkler of FIGS. 1A-2.
Figure 10B:
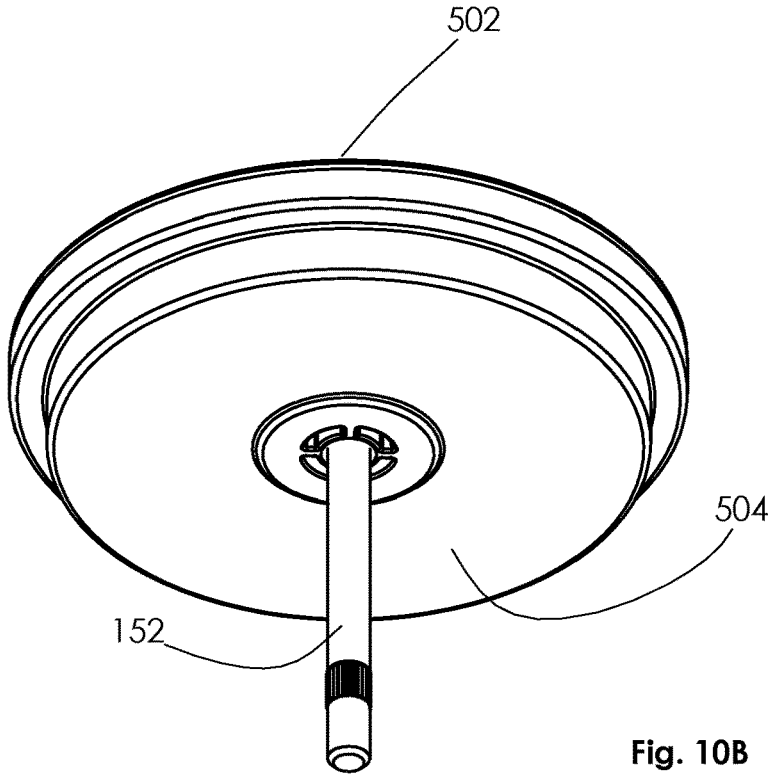
Figure 10C:
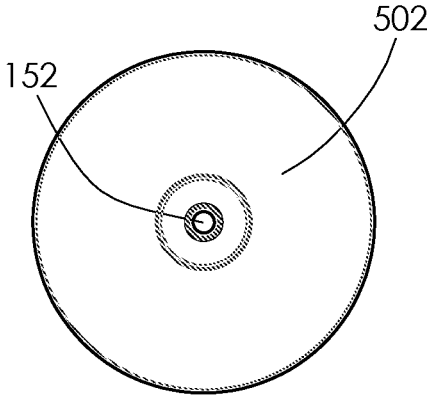
Figure 10D:
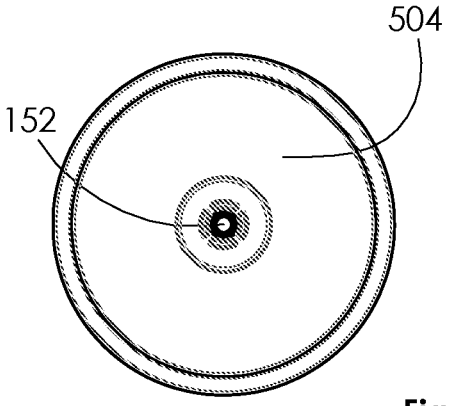
Figure 10E:
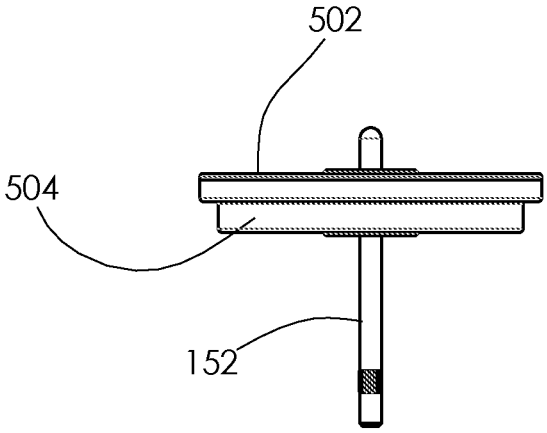
Figure 11:
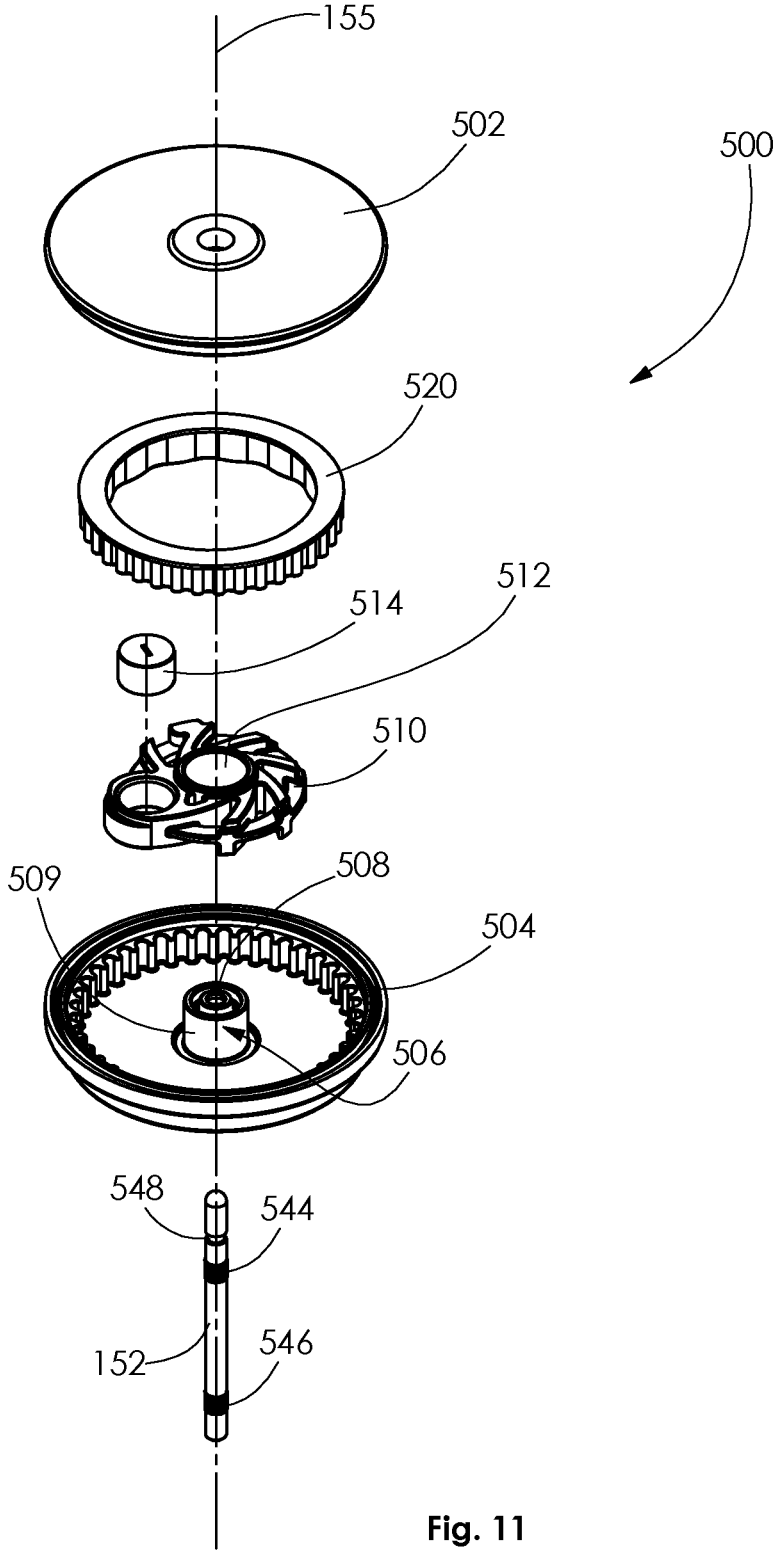
FIG. 11 is a simplified exploded view illustration of a first embodiment of a rotating, azimuth responsive, multiple rotation speed governor assembly (RARMRSGA) useful in the sprinkler of FIGS. 1A-2.
Figure 13A:
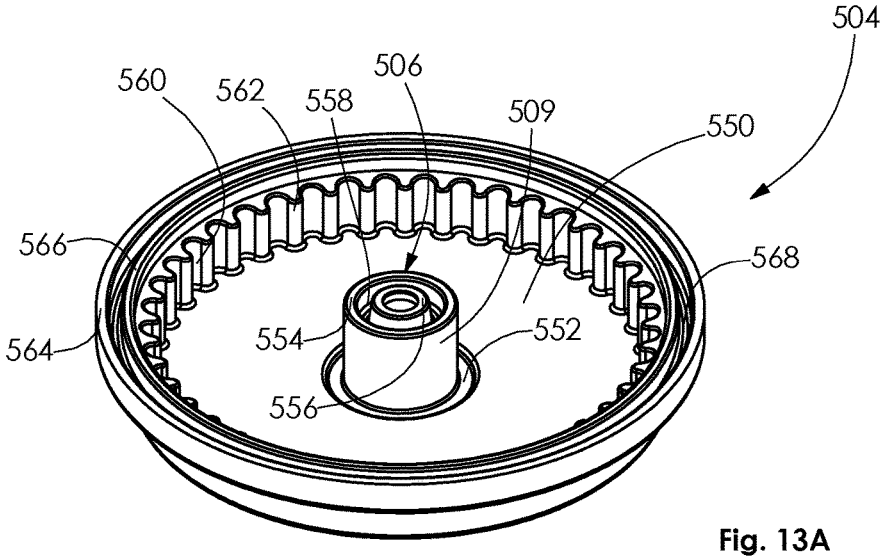
FIGS. 13A and 13B are simplified respective top perspective and top planar views of a base portion of the rotating, azimuth responsive, multiple rotation speed governor assembly (RARMRSGA) of FIG. 11.
Figure 13B:
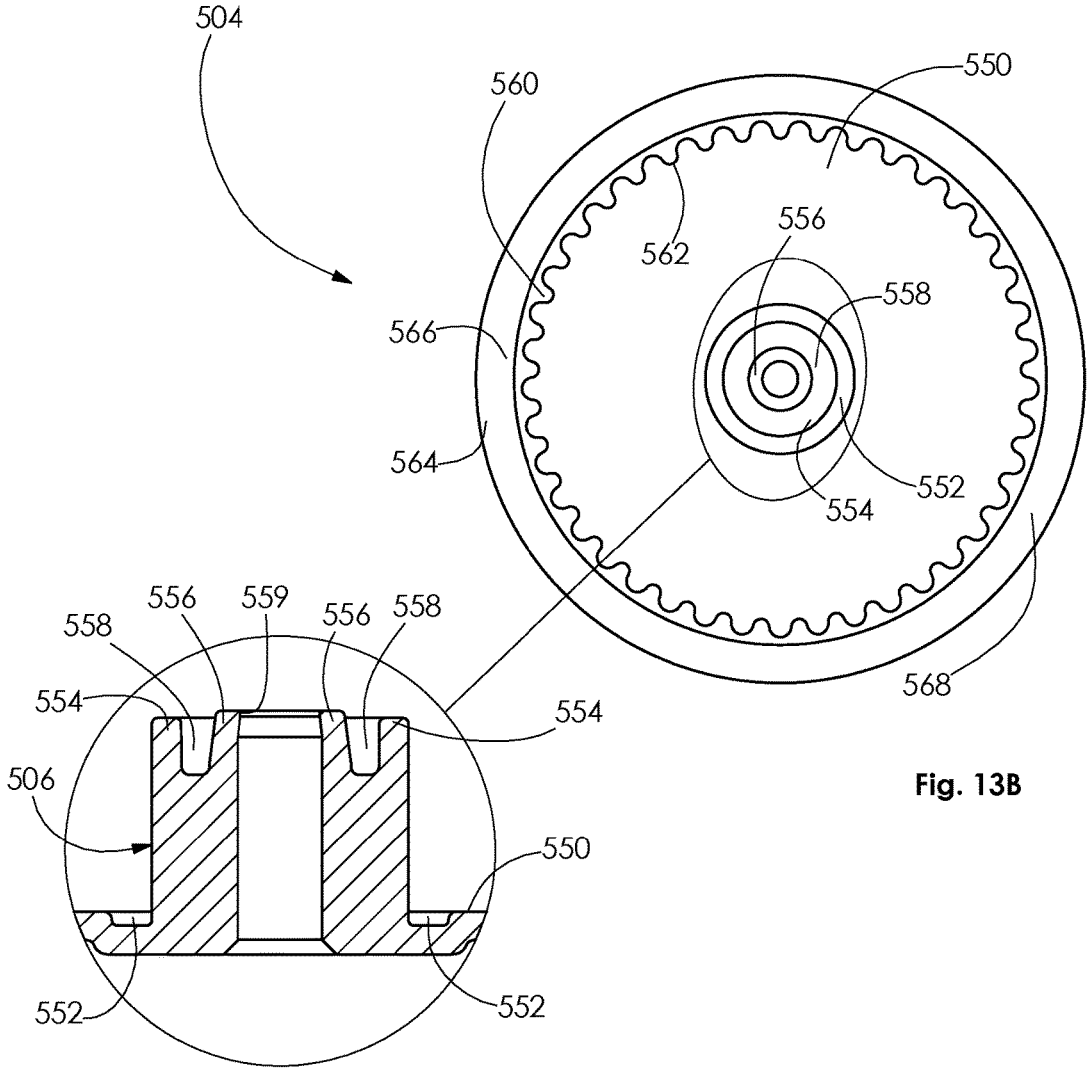

Base portion 504 is illustrated in FIGS. 13A and 13B. As seen in FIGS. 13A and 13B, base portion 504 includes a generally flat upward facing disk-like surface 550 surrounding a recessed central ring surface 552. Recessed central ring surface 552 surrounds central hub 506, which defines generally circularly cylindrical outer hub surface 509 (FIGS. 10A-11). Central hub 506 includes a pair of concentric mutually radially spaced upwardly directed rims 554 and 556, which define therebetween a recess 558. Upon ultrasonic sealing of cover portion 502 to base portion 504, circular rim 540 of cover portion 502 becomes welded to rims 554 and 556 about bore 528, thereby filling recess 558.

It is a particular feature of an embodiment of the present invention that rim 556 includes at least one radially inwardly directed portion 559 which extends in fixed axial locking engagement with circumferential recess 548 of splined axle 152.

A circular array 560 of radially inwardly facing gear teeth 562 surrounds surface 550 and is in turn surrounded by a pair of concentric mutually spaced upwardly directed rims 564 and 566, which define therebetween a recess 568. Upon ultrasonic sealing of cover portion 502 to base portion 504, circular rim 530 of cover portion 502 becomes welded to rims 564 and 566 of base portion 504, thereby filling recess 568.

Figure 14A:
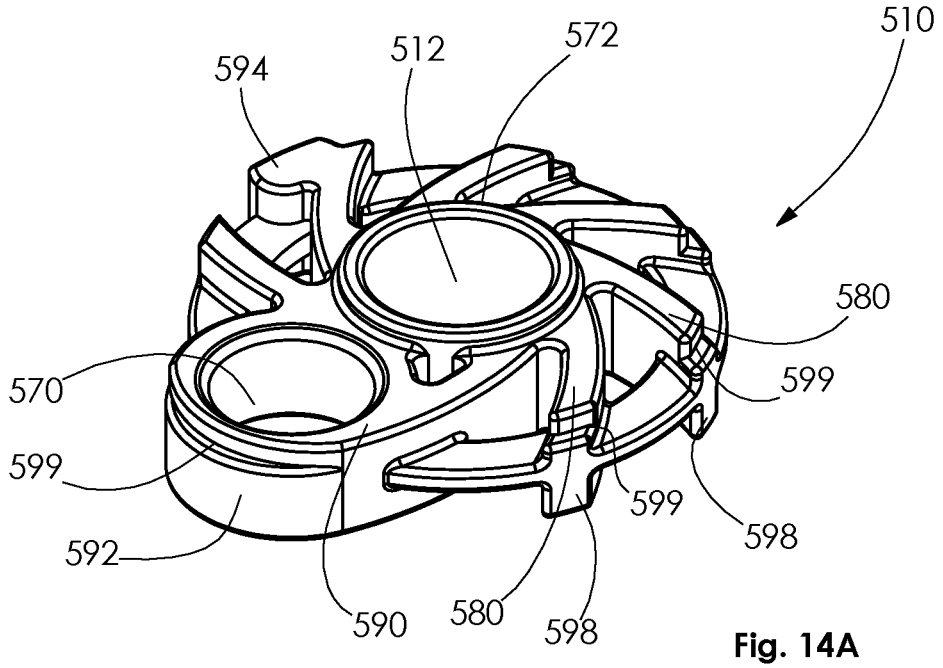
FIGS. 14A, 14B, 14C, 14D and 14E are, respectively, simplified top and bottom perspective, top and bottom plan view illustrations and a side view illustration of a magnet bearing centrifugal viscous material accelerator (MBCVMA), forming part of the rotating, azimuth responsive, multiple rotation speed governor assembly (RARMRSGA) of FIG. 11.
Figure 14B:
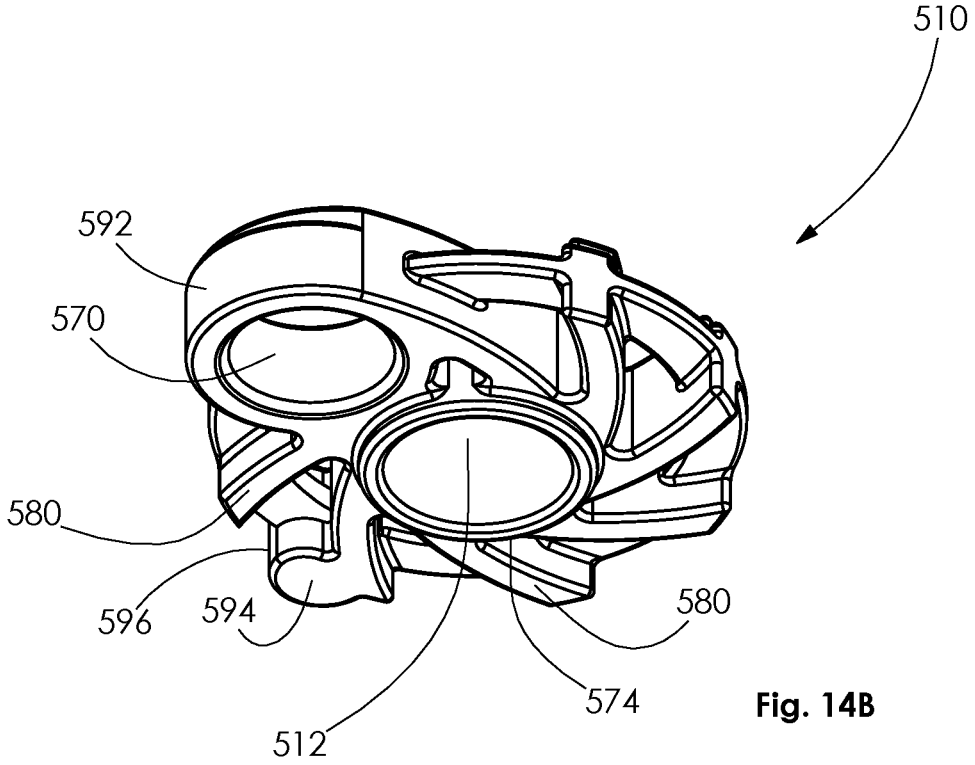
Figure 14C:
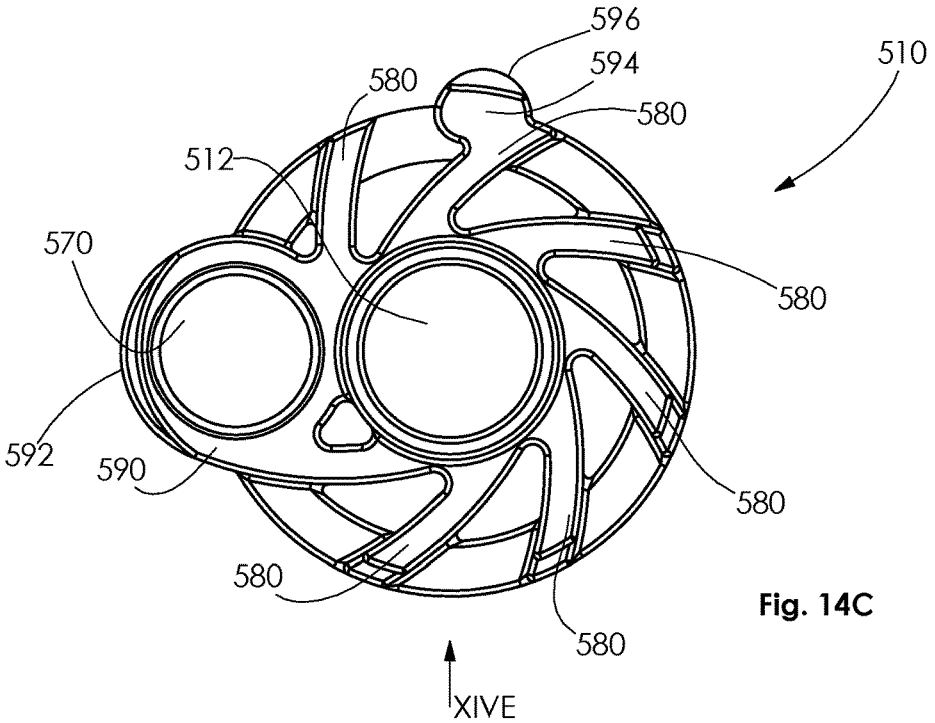
Figure 14E:
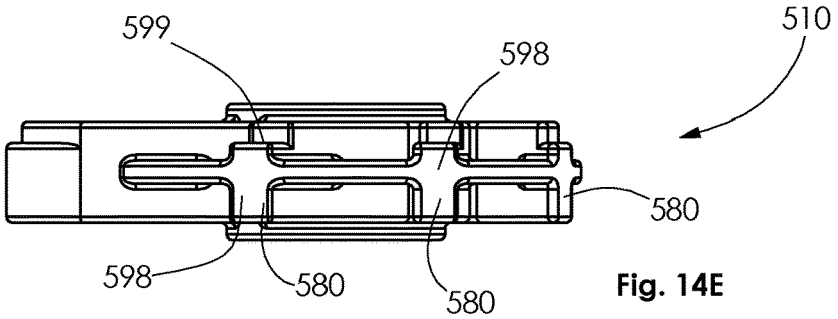
Figure 14D:
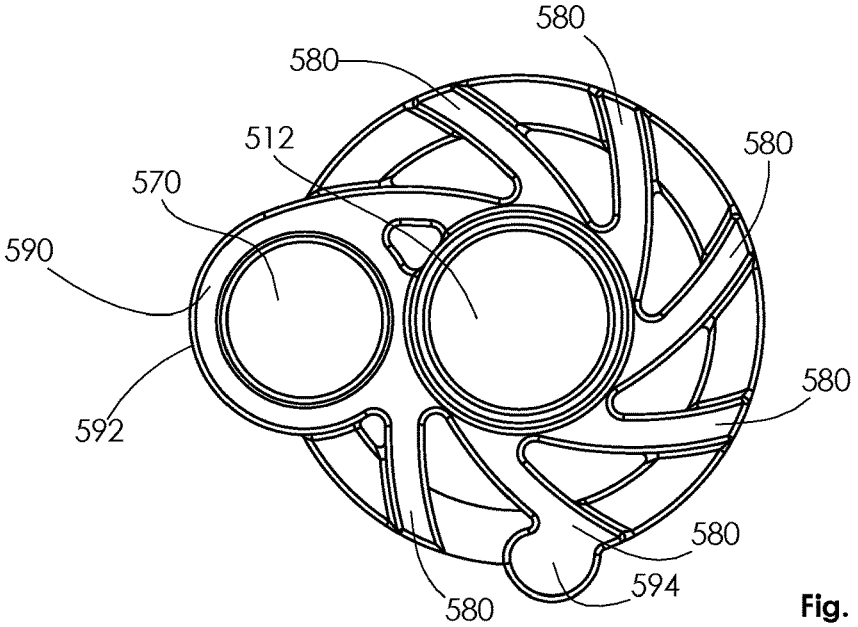

Reference is now made to FIGS. 14A, 14B, 14C, 14D and 14E, which are, respectively, simplified top and bottom perspective, top and bottom plan view illustrations and a side view illustration of magnet bearing centrifugal viscous material accelerator (MBCVMA) 510, forming part of the rotating, azimuth responsive, multiple rotation speed governor assembly (RARMRSGA) of FIGS. 10A-11. FIG. 14E is taken along an arrow XIVE in FIG. 14C.

As noted above with reference to FIGS. 10A-11, MBCVMA 510 is formed with a central generally circularly cylindrical bore 512, configured for mutually rotatable mounting of MBCVMA 510 onto circularly cylindrical outer hub surface 509 of base portion 504 for relatively low friction rotation of base portion 504 about axis 155 relative to MBCVMA 510. Magnet 514 (shown in FIG. 11, not shown in FIGS. 14A-14E), preferably a cylindrical neodymium magnet having a diameter of 8 mm and a height of 5 mm and arranged to have a polarity opposite to that of magnets 190 and 192, is fixedly mounted onto MBCVMA 510 at a magnet receiving aperture 570. It is appreciated that MBCVMA 510 is preferably formed with a pair of axially protruding ring surfaces 572 and 574 for relatively low friction rotational engagement between MBCVMA 510 and respective cover portion 502 and base portion 504 of RARMRSGA 500.

It is a particular feature of an embodiment of the present invention that MBCVMA 510 is formed with a plurality of radially outwardly and tangentially directed vanes 580, whose purpose is to direct the viscous material within the enclosure radially outwardly from MBCVMA 510 towards intermediate geared ring 520 and towards circular array 560 of radially inwardly facing gear teeth 562 on base portion 504, such that the viscous material provides resistance to mutual displacement of intermediate ring 520 and base portion 504 as well as to mutual displacement of intermediate ring 520 and base portion 504 relative to MBCVMA 510, which is generally static. This resistance reduces the speed of rotation of the base member 504 and thus of shaft 512 about axis 155.

As seen in FIGS. 14A-14E, magnet receiving aperture 570 is preferably located in a radially outwardly extending portion 590 of MBCVMA 510 which defines a radially outwardly directed engagement surface 592, which engages intermediate geared ring 520 and urges and retains intermediate geared ring 520 in gear engagement with an interior geared surface of base portion 504. As will be described hereinbelow in greater detail, radially outwardly directed engagement surface 592 intermittently engages intermediate geared ring 520 during rotation of base portion 504 relative to MBCVMA 510 about axis 155.

MBCVMA 510 is preferably formed with a radially outward extending spacer portion 594, azimuthally spaced from radially outwardly extending portion 590, preferably by approximately 90 degrees and more preferably by 98 degrees and defining a radially outwardly directed engagement surface 596 that preferably intermittently engages intermediate geared ring 520 during rotation of base portion 504 relative to MBCVMA 510 about axis 155, preferably coincidentally in time with engagement of outwardly directed engagement surface 592 with intermediate geared ring 520.

It is a further particular feature of an embodiment of the present invention that radially outwardly directed surfaces 592 and 596 and preferably also radially outwardly directed surfaces 598 of vanes 580 are formed with mutually circumferentially aligned recesses 599.

Figure 15A:
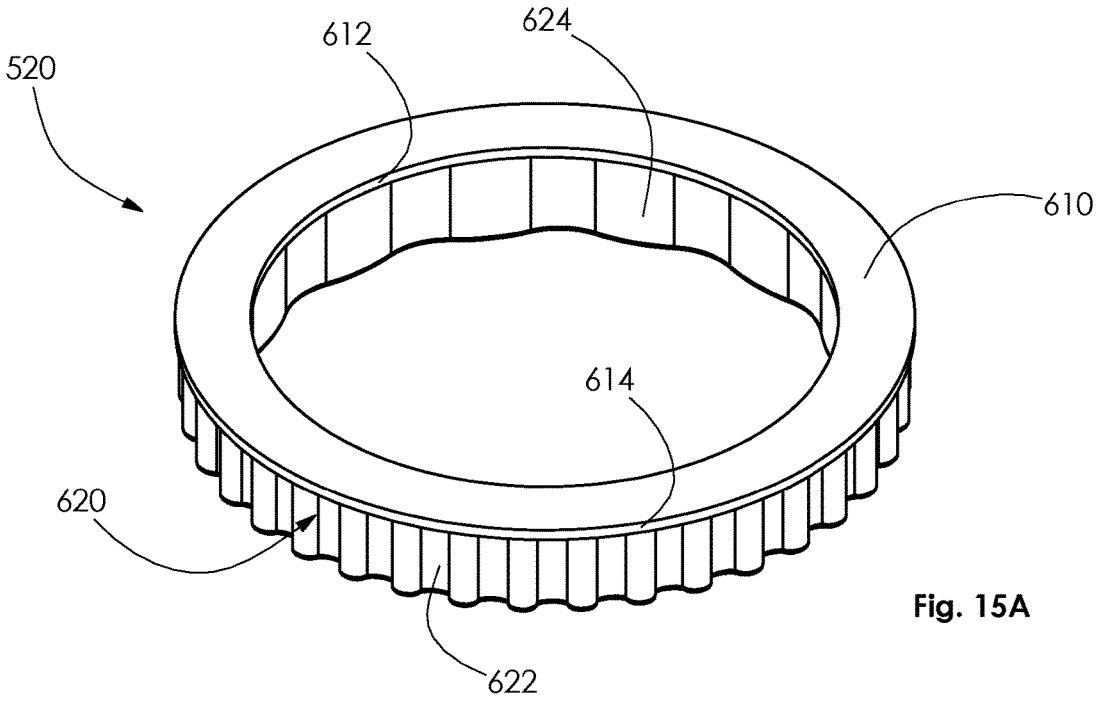
FIGS. 15A, 15B and 15C are, respectively, simplified top and bottom perspective and bottom plan view illustrations of a geared intermediate element, forming part of the rotating, azimuth responsive, multiple rotation speed governor assembly (RARMRSGA) of FIG. 11.
Figure 15B:
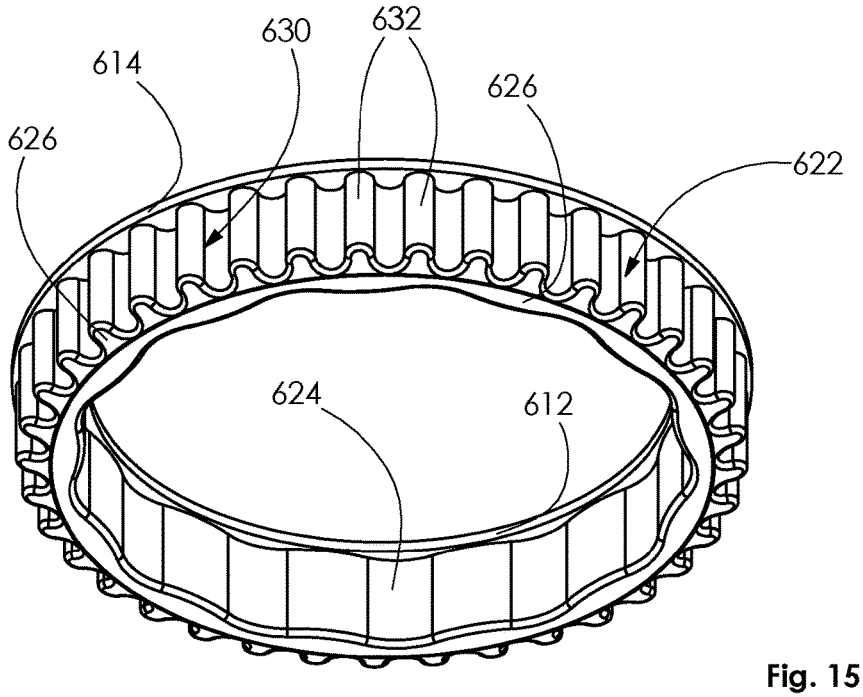
Figure 15C:
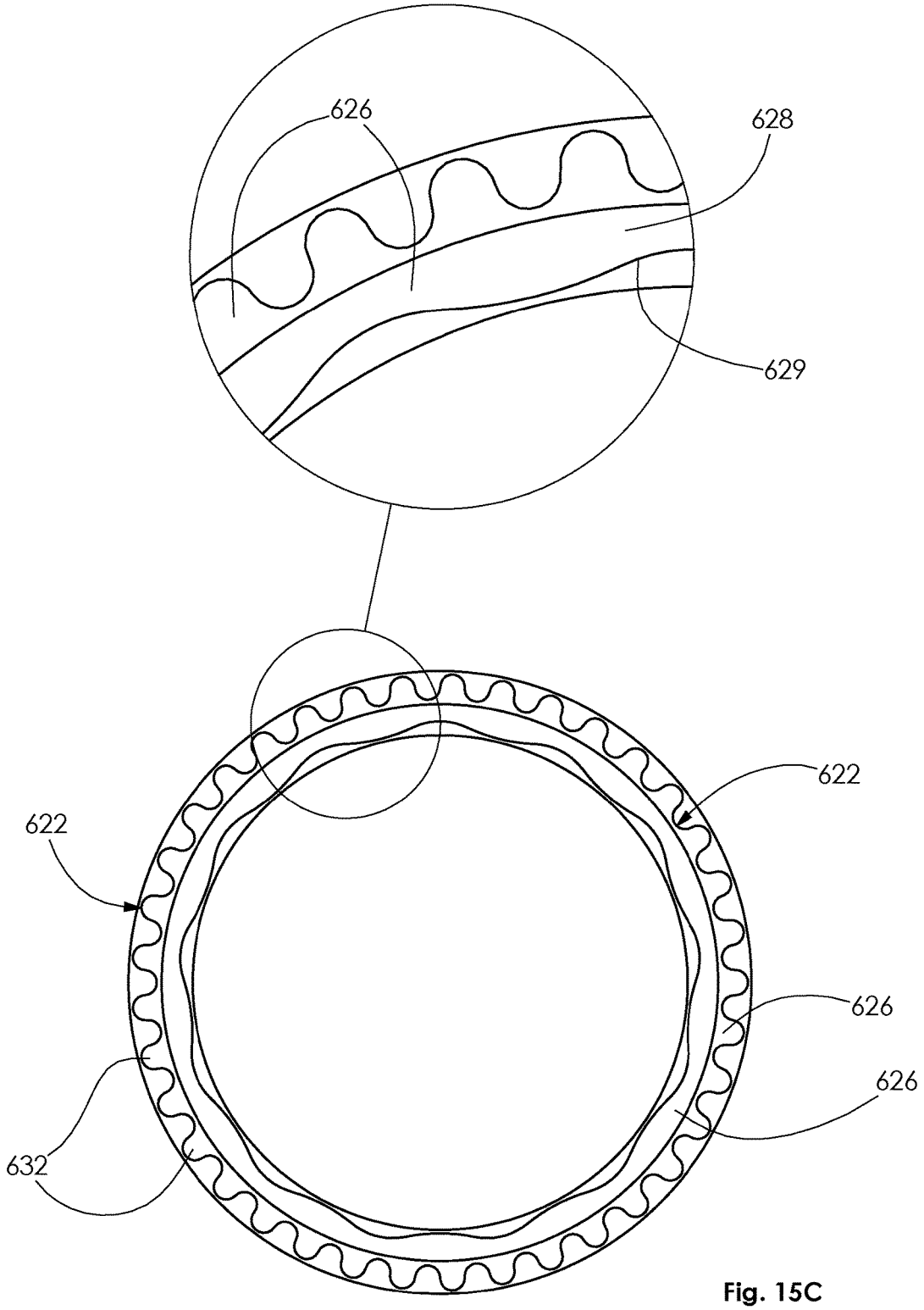

Reference is now made to FIGS. 15A, 15B and 15C, which are, respectively, simplified top and bottom perspective and bottom plan view illustrations of intermediate geared ring 520, forming part of the rotating, azimuth responsive, multiple rotation speed governor assembly (RARMRSGA) of FIG. 11. As seen in FIGS. 15A-15C, intermediate geared ring 520 is preferably an integrally formed plastic element including a generally flat top ring surface 610 extending between an inner circumferential circular rim 612 and an outer circumferential circular rim 614.

Underlying generally flat top ring surface 610 is a generally cylindrical portion 620 defining an outer toothed surface 622, an inner wavelike surface 624 and a tapered bottom surface 626, which defines a narrow rotational contact surface 628 having a wavelike inner edge 629. Inner wavelike surface 624 and wavelike inner edge 629 each define a plurality of hills which are separated by valleys. Outer toothed surface 622 preferably is formed with a circular array 630 of radially outwardly facing gear teeth 632, which are preferably configured to fully mesh with gear teeth 562 of array 560. The number of outwardly facing gear teeth 632 is preferably less than that of gear teeth 562 and the number of gear teeth 562 is not an integer multiple of the number of gear teeth 632. The outer diameter of circular array 630 is less than the inner diameter of circular array 560, such that only some of gear teeth 632 engage only some of gear teeth 562 at any given time, as seen in FIGS. 17B and 18A-18E.

Figure 3E:
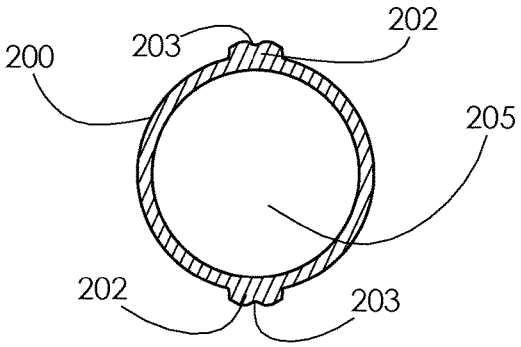
Figure 16A:
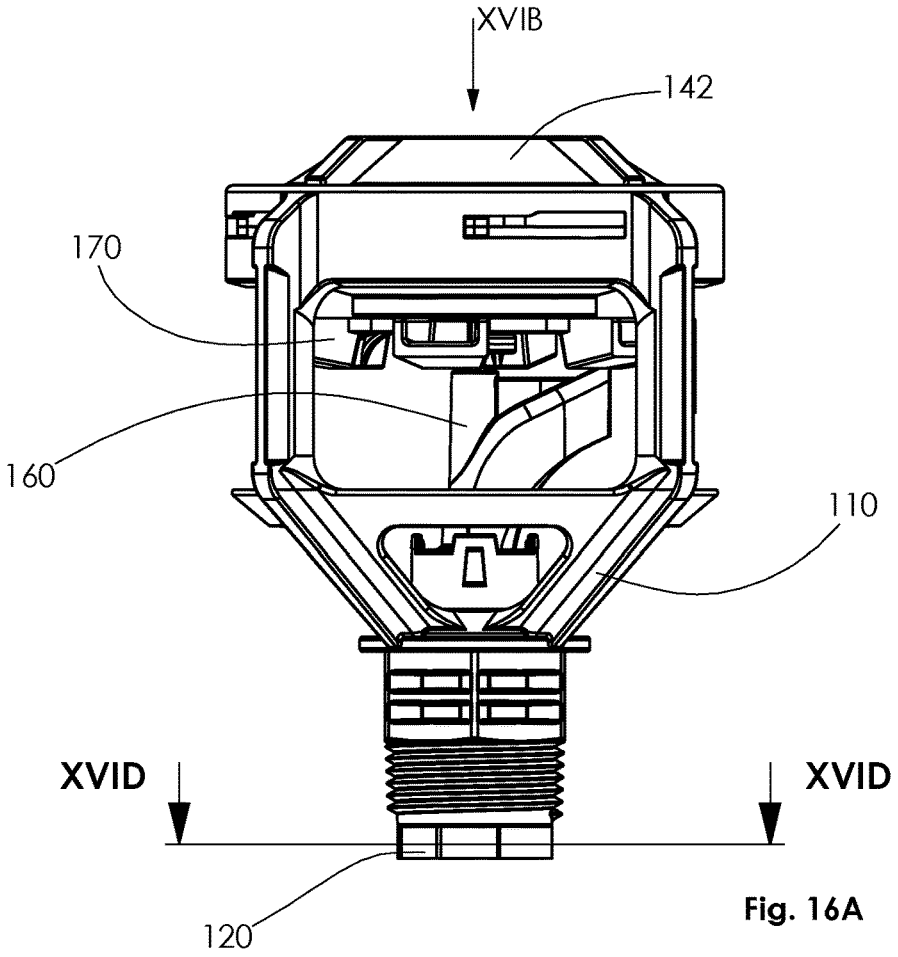
FIGS. 16A, 16B, 16C and 16D are, respectively, simplified side view, top view, side sectional view and sectional view illustrations of a subassembly of the nozzle portion of FIGS. 4A-4E and the housing portion of FIG. 3E, FIG. 16B, being taken along arrow XVIB in FIG. 16A, FIG. 16C being taken along lines XVIC-XVIC in FIG. 16B and FIG. 16D being taken along the lines XVID-XVID in FIG. 16A.
Figure 16B:
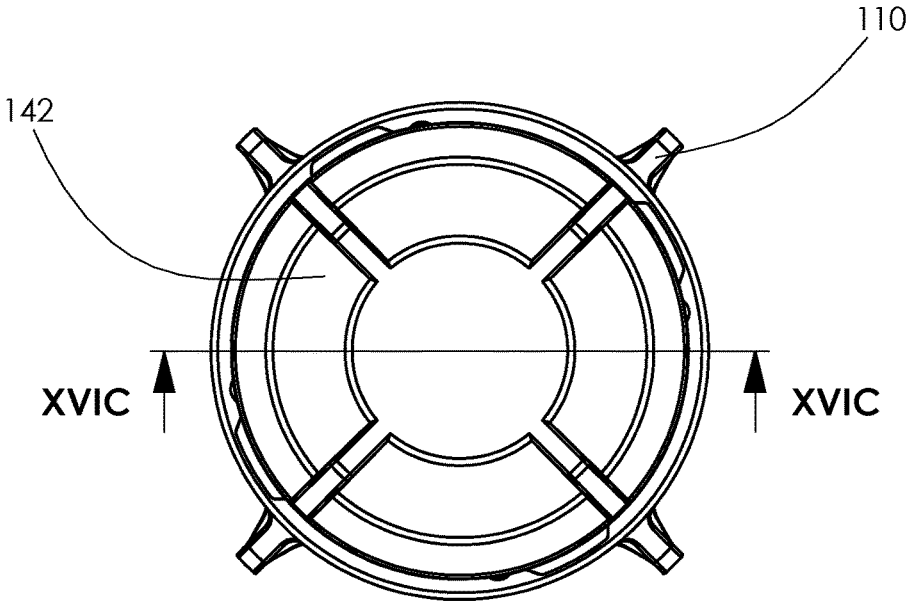
Figure 16C:
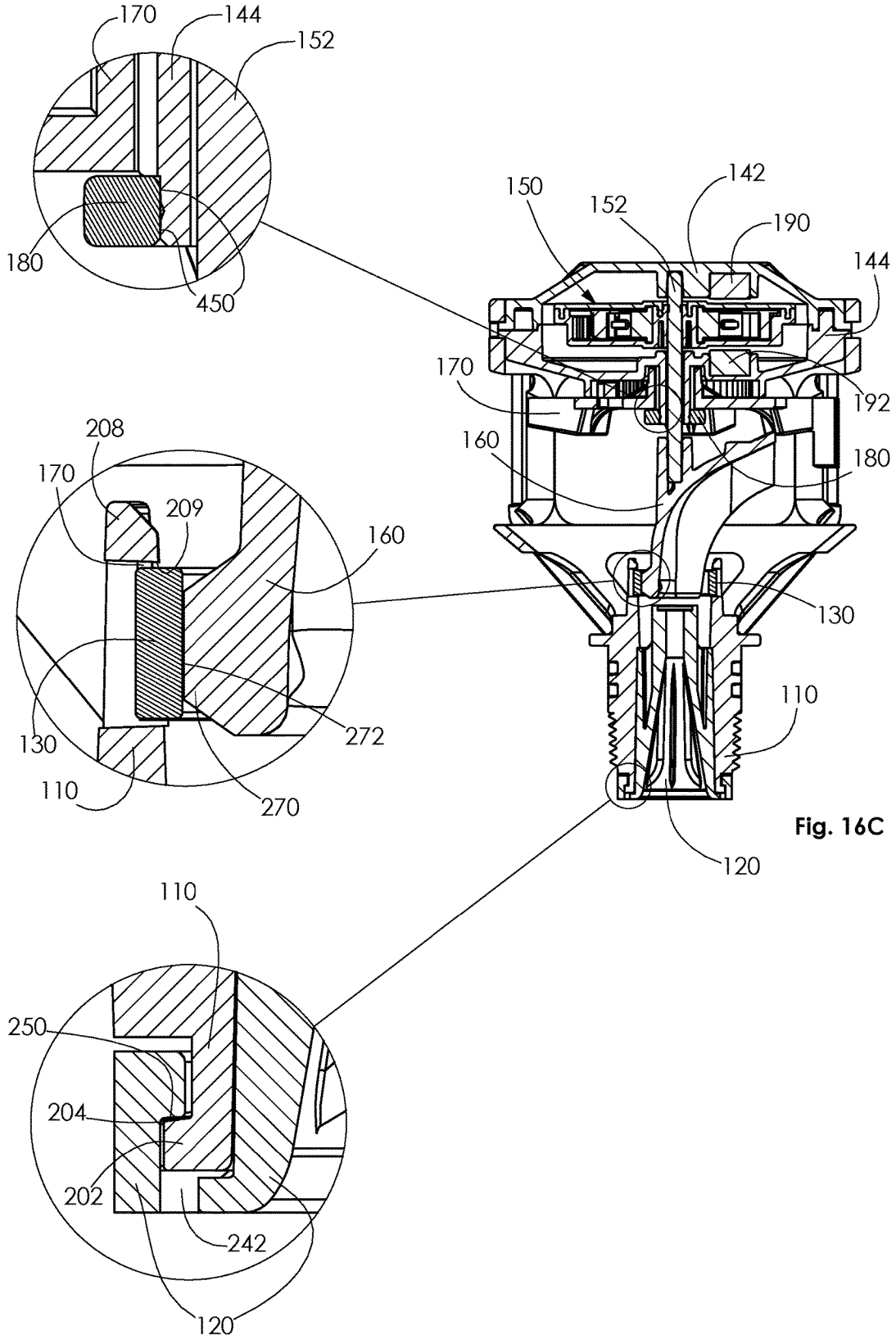
Figure 16D:
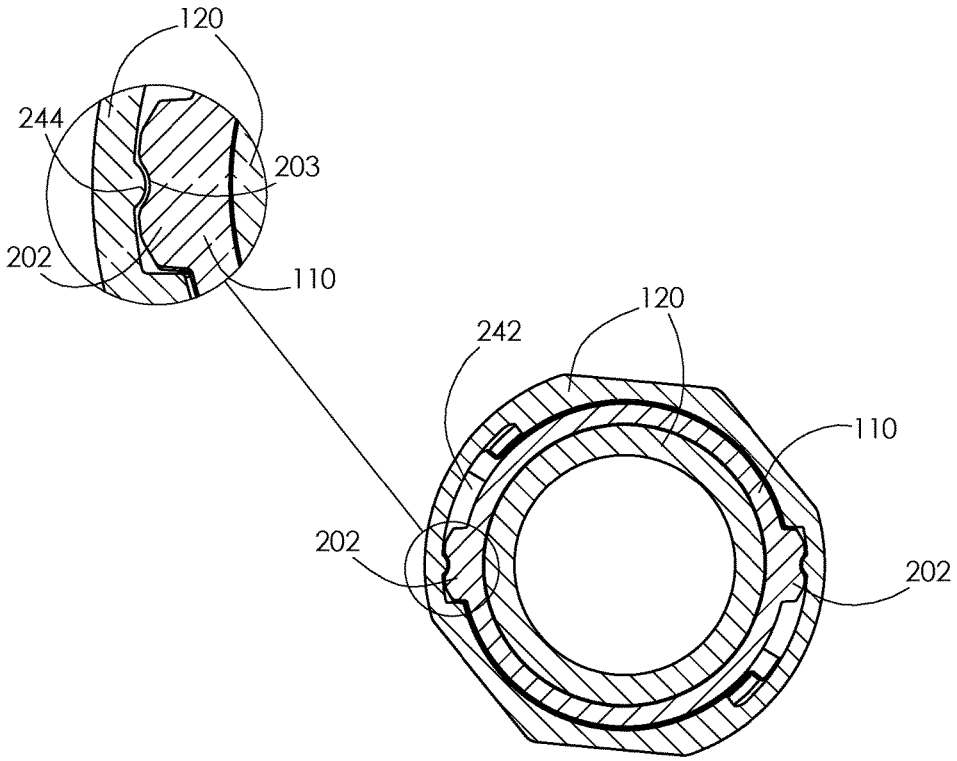

Reference is now made to FIGS. 16A, 16B, 16C and 16D, which are, respectively, simplified side view, top view, side sectional view and sectional view illustrations of a subassembly of the nozzle portion 120 of FIGS. 4A-4E and the housing portion 110 of FIG. 3E, FIG. 16B, being taken along arrow XVIB in FIG. 16A, FIG. 16C, being taken along the lines XVIC-XVIC in FIG. 16B and FIG. 16D being taken along the lines XVID-XVID in FIG. 16A. As seen in FIGS. 16A-16D, bayonet mounting of the nozzle portion 120 onto housing portion 110 provides anti-rotation mounting of protrusion 244 of the nozzle portion 120 in recess 203 of protrusion 202 of the housing portion 110, as seen particularly in an enlargement forming part of FIG. 16D, and, as seen particularly in an enlargement forming part of FIG. 16C, engagement between surface 204 of housing portion 110 and surface 250 of nozzle portion 120, in accordance with a particular feature of preferred embodiment of the present invention.

Also seen in another enlargement forming part of FIG. 16C is the low friction rotating engagement of low friction, low wear, support and rotary engagement surface 272 of protrusion 270 with low friction, low wear, ring 130, which is retained in ring receiving and retaining seat 206 by a plurality of snap fit fingers 208 having undercut engagement edges 209 in accordance with a particular feature of preferred embodiment of the present invention.

Additionally seen in yet another enlargement forming part of FIG. 16C is the fixed frictional engagement retaining ring 180 with surface 450 of bottom magnet supporting housing portion 144, in accordance with a particular feature of preferred embodiment of the present invention, thus rotationally retaining ratcheted deflector 170 against axial movement relative to bottom magnet supporting housing portion 144.

Figure 17A:
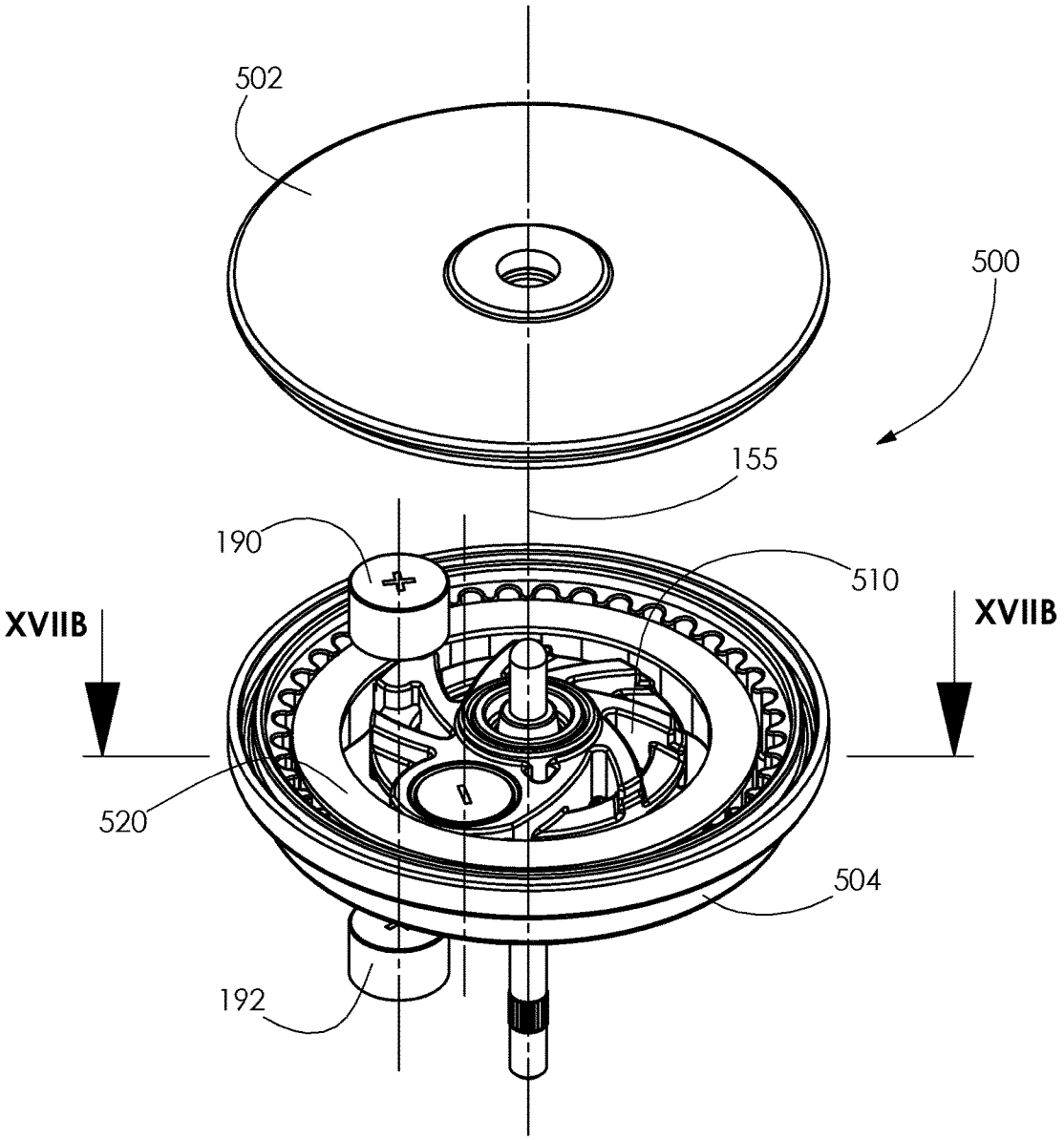
FIGS. 17A and 17B are, respectively, a simplified pictorial, partially exploded view illustration of the first embodiment of an rotating, azimuth responsive, multiple rotation speed governor assembly (RARMRSGA) shown in FIG. 11 and a simplified sectional illustration taken along lines XVIIB-XVIIB of FIG. 17A.
Figure 17B:
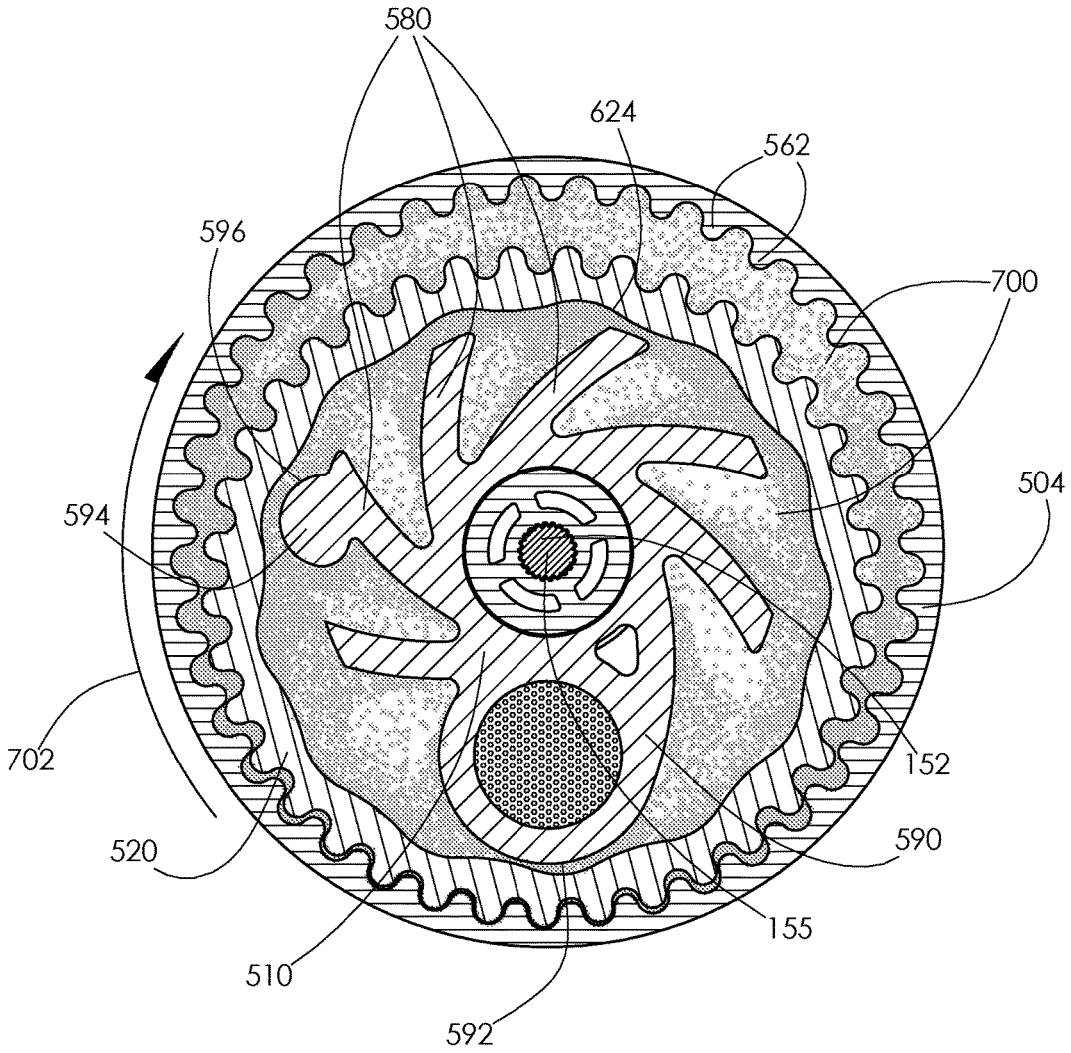

Reference is now made to FIGS. 17A and 17B, which are, respectively, a simplified pictorial, partially exploded view illustration of the first embodiment of a rotating, azimuth responsive, multiple rotation speed governor assembly (RARMRSGA) 500 shown in FIG. 11 and a simplified sectional illustration taken along lines XVIIB-XVIIB of FIG. 17A, and to FIGS. 18A, 18B, 18C, 18D and 18E, which are simplified illustrations of five stages in the operation of the rotating, azimuth responsive, multiple rotation speed governor assembly (RARMRSGA) of FIGS. 11 and 17A and 17B. It is appreciated that the five stages are typically equally mutually separated in time.

As described hereinabove with reference to FIGS. 10A-15C, RARMRSGA 500 preferably includes cover portion 502 and base portion 504, to which the cover portion is sealingly and fixedly attached and which together define a sealed enclosure for containing a viscous fluid, typically polydimethylsiloxane, preferably having a viscosity of between 50,000 and 100,000 mPa·s, the viscous fluid being designated by reference number 700. It is a particular feature of embodiments of the present invention that the viscous fluid does not fully fill the enclosure and that air is also present within the sealed enclosure.

Disposed within the enclosure defined by mutually sealed cover portion 502 and base portion 504 is magnet bearing centrifugal viscous material accelerator (MBCVMA) 510. Intermediate geared ring 520 is disposed within enclosure defined by mutually sealed cover portion 502 and base portion 504, intermediate MBCVMA 510 and interior geared surface of base portion 504.

As noted above with reference to FIGS. 10A-11, MBCVMA 510 is formed with a central generally circularly cylindrical bore 512, configured for mutually rotatable mounting of MBCVMA 510 onto circularly cylindrical outer hub surface 509 of base portion 504 for relatively low friction rotation of base portion 504 about axis 155 relative to MBCVMA 510. Magnet 514, preferably a cylindrical neodymium magnet having a diameter of 8 mm and a height of 5 mm and arranged to have a polarity opposite to that of magnets 190 and 192, is fixedly mounted onto MBCVMA 510 at magnet receiving aperture 570. As noted above, magnets 190 and 192 are fixedly mounted in mutual coaxial arrangement at locations arranged about an axis parallel and radially spaced from axis 155 onto respective top and bottom magnet support housing portions 142 and 144.

It is a particular feature of an embodiment of the present invention that MBCVMA 510 is formed with a plurality of radially outwardly and tangentially directed vanes 580, whose purpose is to direct the viscous material 700 within the enclosure radially outwardly from MBCVMA 510 towards intermediate geared ring 520 and towards circular array 560 of radially inwardly facing gear teeth 562 on base portion 504, such that the viscous material 700 provides resistance to mutual displacement of intermediate ring 520 and base portion 504 as well as to mutual displacement of intermediate ring 520 and base portion 504 relative to MBCVMA 510, which is generally static. This resistance reduces the speed of rotation of the base member 504 and thus of shaft 512 about axis 155.

As noted hereinabove and as seen in FIGS. 14A-14E, magnet receiving aperture 570 is preferably located in a radially outwardly extending portion 590 of MBCVMA 510 which defines a radially outwardly directed engagement surface 592, which engages intermediate geared ring 520 and urges and retains intermediate geared ring 520 in gear engagement with an interior geared surface of base portion 504. As will be described hereinbelow in greater detail with reference to FIGS. 18A-18E, radially outwardly directed engagement surface 592 intermittently engages intermediate geared ring 520 during rotation of base portion 504 relative to MBCVMA 510 about axis 155.

MBCVMA 510 is preferably formed with a radially outward extending spacer portion 594, azimuthally spaced from radially outwardly extending portion 590, preferably by approximately 90 degrees and preferably 98 degrees and defining a radially outwardly directed engagement surface 596 that preferably intermittently engages inner wavelike surface 624 of intermediate geared ring 520 during rotation of base portion 504 relative to MBCVMA 510 about axis 155, preferably coincidentally in time with engagement of outwardly directed engagement surface 592 with intermediate geared ring 520.

Figure 18A:
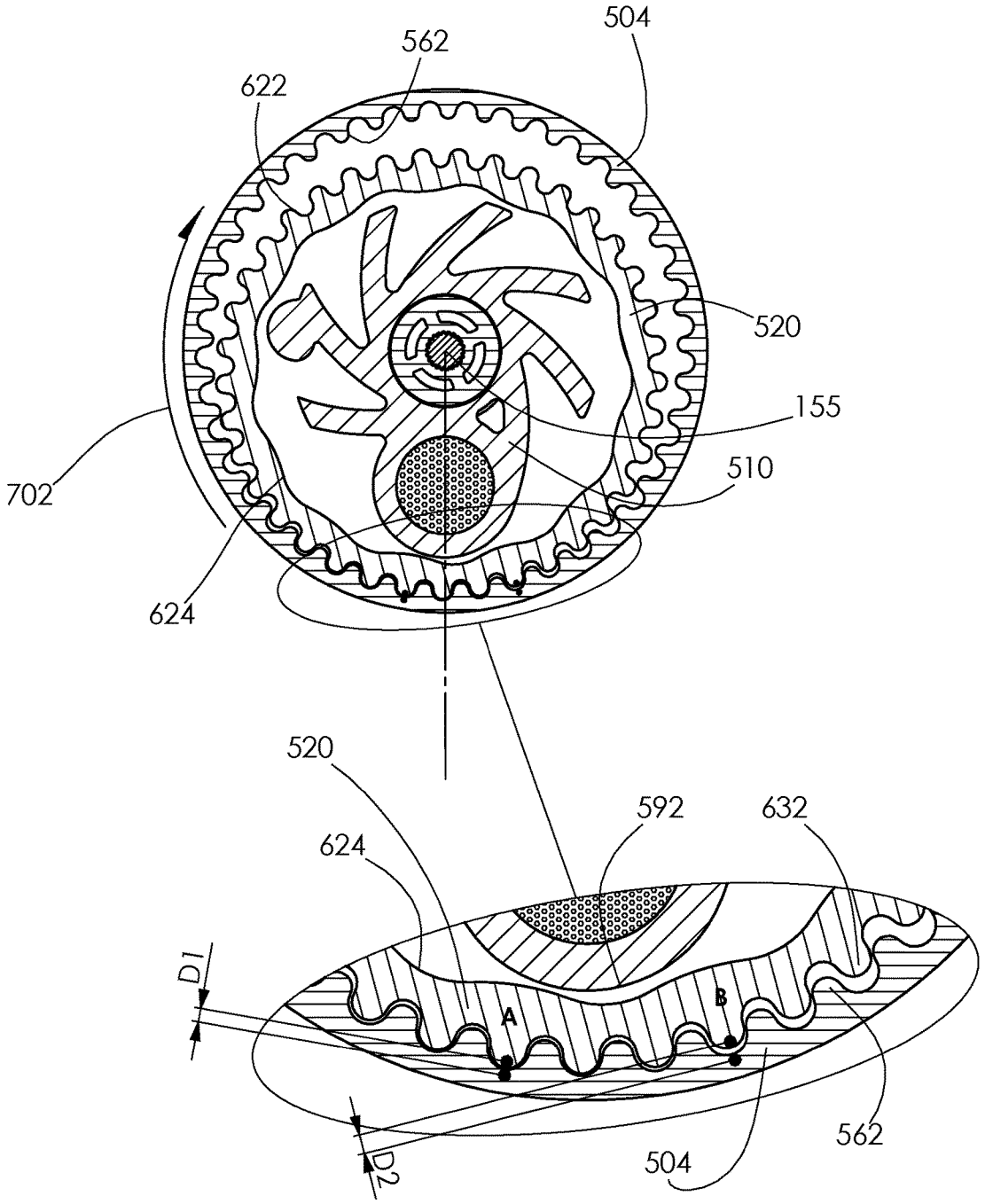
FIGS. 18A, 18B, 18C, 18D and 18E are simplified illustrations of five stages in the operation of the rotating, azimuth responsive, multiple rotation speed governor assembly (RARMRSGA) of FIGS. 11 and 17A and 17B, which stages are generally equally separated in time.

Reference is now made specifically to FIG. 18A, which shows the mutual orientations of MBCVM 510, intermediate geared ring 520 and base portion 504 at an arbitrary azimuthal orientation of base portion 504 with respect to MBCVM 510 about axis 155. In the mutual orientation of FIG. 18A, engagement surface 592 of MBCVMA has just disengaged from a trailing edge of a hill, designated A, defined by inner wavelike surface 624 of intermediate geared ring 520, with respect to a clockwise direction of rotation 702 of base portion 504 relative to MBCVM 510 about axis 155. It is seen that in the mutual orientation shown in FIG. 18A, the engaged gear teeth 632 and 562 of intermediate geared ring 520 and of base portion 504, respectively, which directly underlie the peak of hill A, are in close engagement, defining a minimum separation therebetween D1, which may be zero. It is also seen that in the mutual orientation shown in FIG. 18A, the engaged gear teeth 632 and 562 of intermediate geared ring 520 and of base portion 504, respectively, which directly underlie the peak of an adjacent hill B, which trails hill A with respect to rotation direction 702, are in nearly close engagement, defining a minimum separation therebetween D2, which is greater than D1. It is appreciated that the space between the engaged gear teeth is partially filled with viscous fluid 700.

It is appreciated that in the mutual orientation shown in FIG. 18A, the rotation speed of the base portion 504 is at a maximum due to the fact that the resistance to rotation of the base portion is at a minimum since surface 592 does not engage the intermediate geared ring 520.

Figure 18B:
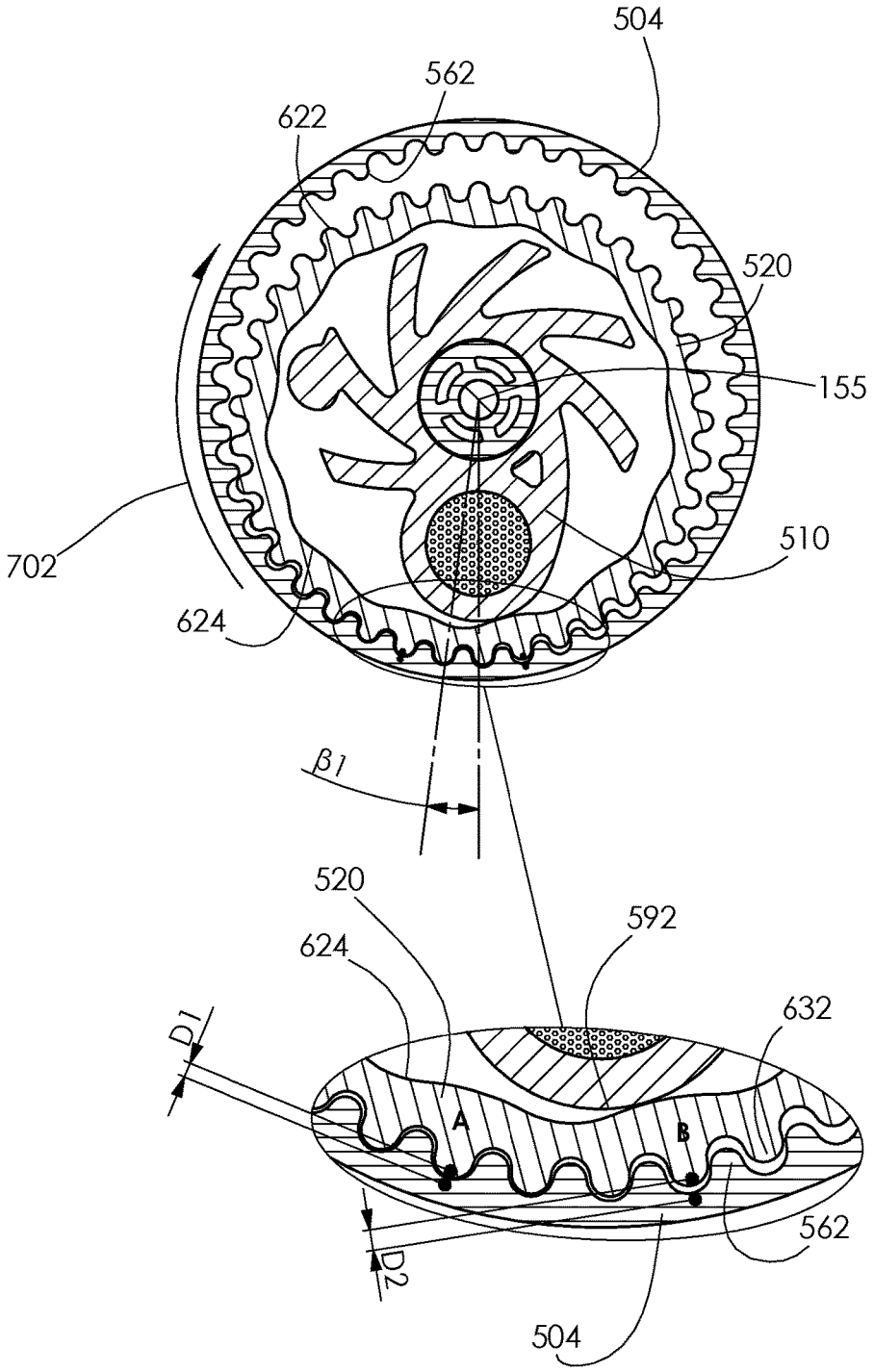

Reference is now made specifically to FIG. 18B, which shows the mutual orientations of MBCVM 510, intermediate geared ring 520 and base portion 504 at a stage wherein the base portion 504 is rotated along arrow 702 about axis 155 relative to MBCVMA 510 by an angle β1 , typically 7.5 degrees with respect to the mutual orientation shown in FIG. 18A. In the mutual orientation of FIG. 18B, engagement surface 592 of MBCVMA initially engages a leading edge of hill B with respect to rotation direction 702.

It is seen that in the mutual orientation shown in FIG. 18B, the engaged gear teeth 632 and 562 of intermediate geared ring 520 and of base portion 504, respectively, which directly underlie the peak of hill A remain in close engagement, defining minimum separation therebetween D1. It is also seen that in the mutual orientation shown in FIG. 18B, the engaged gear teeth 632 and 562 of intermediate geared ring 520 and of base portion 504 respectively, which directly underlie the peak of an adjacent hill B, which trails hill A with respect to rotation direction 702, remain in nearly close engagement, defining minimum separation therebetween D2.

It is appreciated that the space between the engaged gear teeth remains partially filled with viscous fluid 700. It is thus appreciated that notwithstanding the rotation of base portion 504 by angle β1, typically approximately 7.5 degrees, the mutual orientations of intermediate geared ring 520 and base portion 504 have not changed.

It is appreciated that during rotation of base portion 504 from the mutual orientation of the intermediate geared ring 520 and base portion 504 shown in FIG. 18A to the mutual orientation of the intermediate geared ring 520 and base portion 504 shown in FIG. 18B, the rotation speed of the base portion 504 remains at a maximum due to the fact that the resistance to rotation of the base portion is at a minimum since surface 592 does not yet engage the intermediate geared ring 520. It is further appreciated that immediately upon contact between surface 592 and the intermediate geared ring, the resistance to rotation of the base portion increases substantially, thus immediately slowing the rotation of the base portion 504.

Figure 18C:
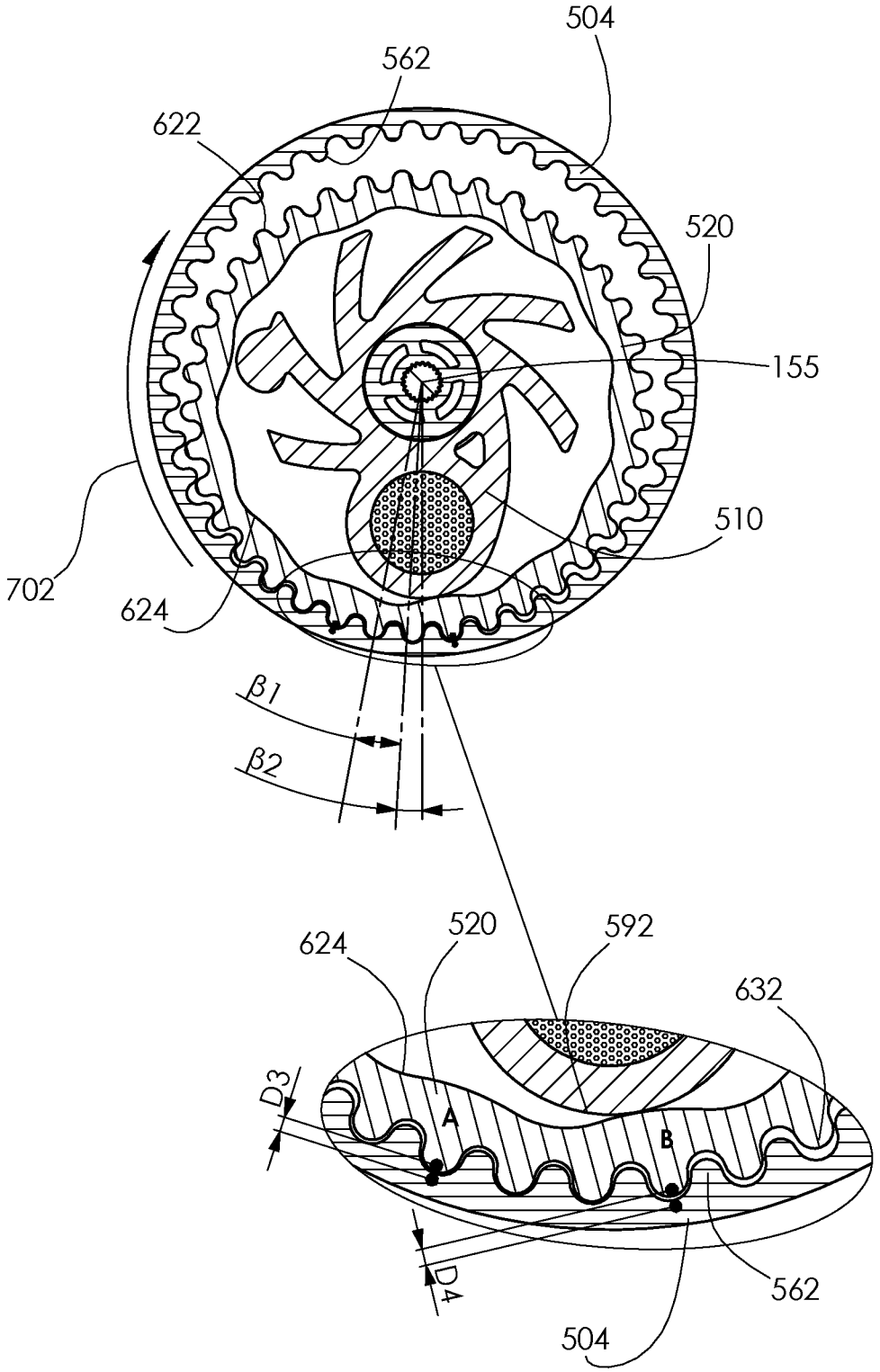

Reference is now made specifically to FIG. 18C, which shows the mutual orientations of MBCVM 510, intermediate geared ring 520 and base portion 504 at a stage wherein the base portion 504 is further rotated along arrow 702 about axis 155 relative to MBCVMA 510 by an angle β2, typically approximately 3.5 degrees with respect to the mutual orientation shown in FIG. 18B. In the mutual orientation of FIG. 18C, engagement surface 592 of MBCVMA 510 engages hill B and displaces the intermediate geared ring 520 relative to base portion 504 and relative to MBCVMA 510.

It is seen that in the mutual orientation shown in FIG. 18C, the engaged gear teeth 632 and 562 of intermediate geared ring 520 and of base portion 504, respectively, which directly underlie the peak of hill A have slightly separated, defining a minimum separation therebetween D3, which is greater than D1. It is also seen that in the mutual orientation shown in FIG. 18C, the engaged gear teeth 632 and 562 of intermediate geared ring 520 and of base portion 504, respectively, which directly underlie the peak of hill B are in closer engagement, defining a minimum separation therebetween D4, which is less than D2. It is appreciated that D3 and D4 are approximately the same.

It is appreciated that the space between the engaged gear teeth remains partially filled with viscous fluid 700. It is also appreciated that due to the rotation of base portion 504 by angle β2, typically approximately 3.5 degrees, and the displacement of the intermediate geared ring 520 relative to the base portion 504 produced by surface 592, the mutual orientations of intermediate geared ring 520 and base portion 504 have changed.

It is appreciated that in the mutual orientation shown in FIG. 18C, the rotation speed of the base portion 504 no longer remains at a maximum and is in fact at or near a minimum due to the fact that the resistance to rotation of the base portion 504 is at a maximum, as the result of the displacement of the intermediate geared ring 520 relative to base portion 504 and relative to MBCVMA 510 in the viscous fluid 700. It is further appreciated that angle β2 is less than angle β1, indicating that the speed of rotation of the base portion 504 between the orientations of FIGS. 18B and 18C is substantially less than the speed of rotation of the base portion 504 between the orientations of FIGS. 18A and 18B.

Figure 18D:
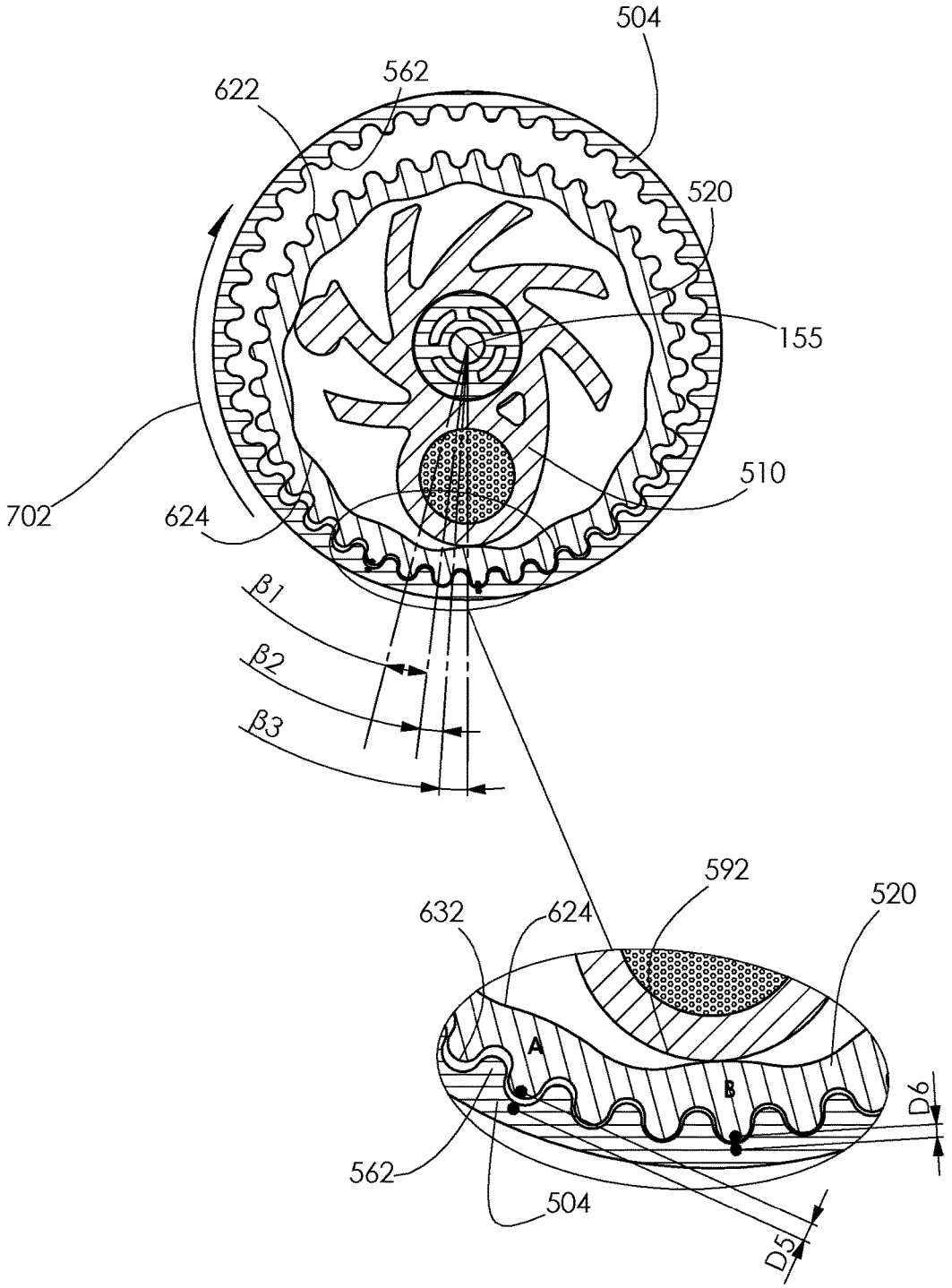

Reference is now made specifically to FIG. 18D, which shows the mutual orientations of MBCVM 510, intermediate geared ring 520 and base portion 504 at a stage wherein the base portion 504 is further rotated along arrow 702 about axis 155 relative to MBCVMA 510 by an angle β3, typically approximately 3.5 degrees with respect to the mutual orientation shown in FIG. 18C. In the mutual orientation of FIG. 18D, engagement surface 592 of MBCVMA 510 still engages hill B but does not further displace the intermediate geared ring 520 relative to base portion 504 and relative to MBCVMA 510.

It is seen that in the mutual orientation shown in FIG. 18D, the engaged gear teeth 632 and 562 of intermediate geared ring 520 and of base portion 504, respectively, which directly underlie the peak of hill A have further separated, defining a minimum separation therebetween D5, which is greater than D3. It is also seen that in the mutual orientation shown in FIG. 18D, the engaged gear teeth 632 and 562 of intermediate geared ring 520 and of base portion 504, respectively, which directly underlie the peak of hill B are in closer engagement, defining a minimum separation therebetween D6, which is less than D4. It is also appreciated that D6 is smaller than D5.

It is appreciated that the space between the engaged gear teeth remains partially filled with viscous fluid 700. It is also appreciated that due to the rotation of base portion 504 by angle β3, typically 3.5 degrees, and the displacement of the intermediate geared ring 520 relative to the base portion 504 produced by surface 592, the mutual orientations of intermediate geared ring 520 and base portion 504 have changed.

It is appreciated that in the mutual orientation shown in FIG. 18D, the rotation speed of the base portion 504 remains at or near a minimum due to the fact that the resistance to rotation of the base portion 504 is at a maximum, as the result of the displacement of the intermediate geared ring 520 relative to base portion 504 and relative to MBCVMA 510 in the viscous fluid 700. It is further appreciated that angle β3 is approximately equal to angle β2, indicating that the speed of rotation of the base portion 504 between the orientations of FIGS. 18C and 18D is generally the same as the speed of rotation of the base portion 504 between the orientations of FIGS. 18B and 18C.

Figure 18E:
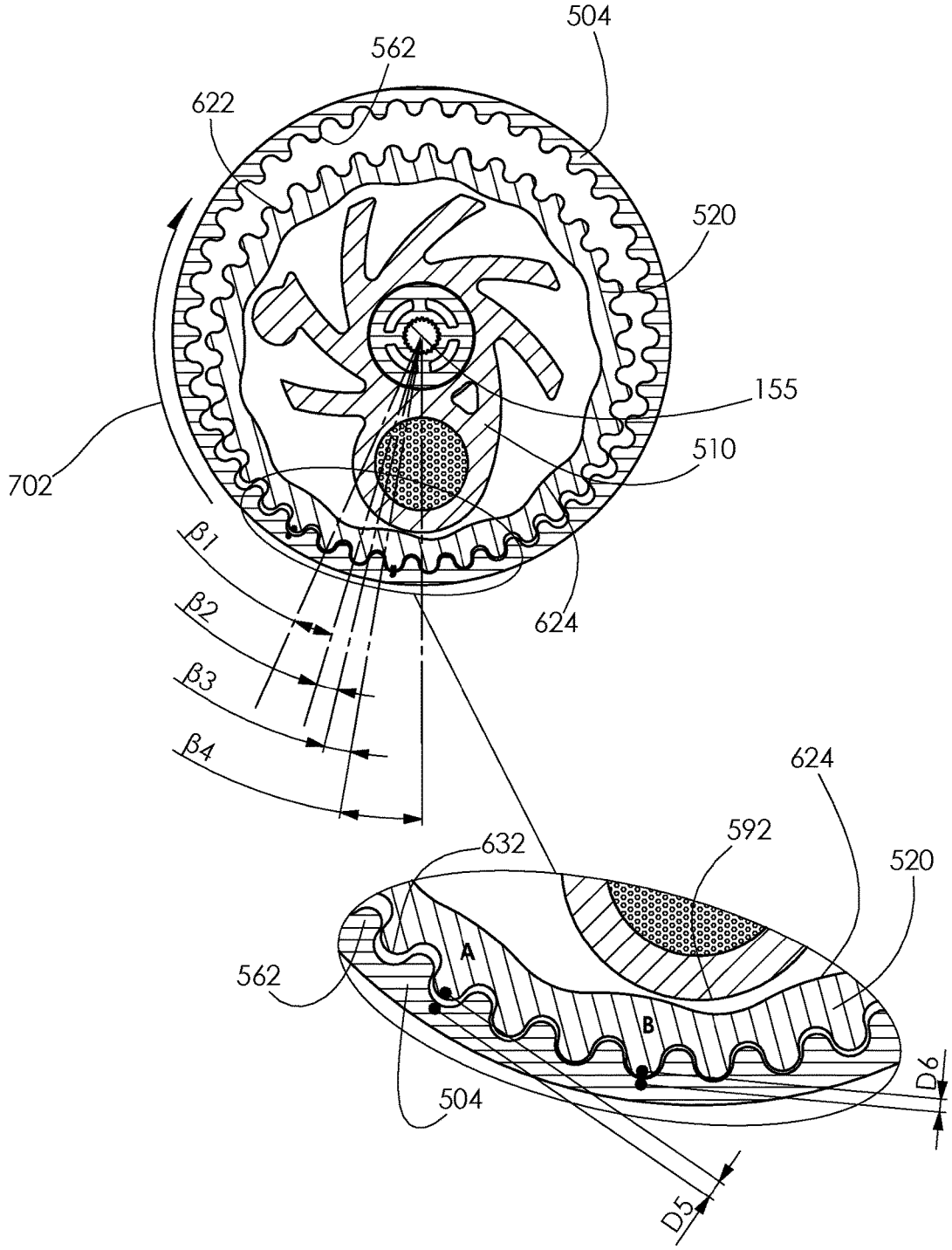

Reference is now made specifically to FIG. 18E, which shows the mutual orientations of MBCVM 510, intermediate geared ring 520 and base portion 504 at a stage wherein the base portion 504 is further rotated along arrow 702 about axis 155 relative to MBCVMA 510 by an angle β4, typically approximately 10 degrees with respect to the mutual orientation shown in FIG. 18D. It is appreciated that the mutual orientations of MBCVM 510, intermediate geared ring 520 and base portion 504 shown in FIG. 18E are for practical purposes identical to the mutual orientations of MBCVM 510, intermediate geared ring 520 and base portion 504 shown in FIG. 18A.

In the mutual orientation of FIG. 18E, engagement surface 592 of MBCVMA 510 no longer engages hill B and therefore does not further displace the intermediate geared ring 520 relative to base portion 504 and relative to MBCVMA 510.

It is seen that in the mutual orientation shown in FIG. 18E, the engaged gear teeth 632 and 562 of intermediate geared ring 520 and of base portion 504, respectively, which directly underlie the peak of hill A still define a minimum separation therebetween D5, which is identical to the separation D5 seen in FIG. 18D. It is also seen that in the mutual orientation shown in FIG. 18E, the engaged gear teeth 632 and 562 of intermediate geared ring 520 and of base portion 504, respectively, which directly underlie the peak of hill B still define a minimum separation therebetween D6, which is identical to the separation D6 seen in FIG. 18D. It is appreciated that the space between the engaged gear teeth remains partially filled with viscous fluid 700. It is also appreciated that notwithstanding the rotation of base portion 504 by angle β4, typically 10 degrees, no displacement of the intermediate geared ring 520 relative to the base portion 504 was produced by surface 592 and thus the mutual orientations of intermediate geared ring 520 and base portion 504 have not changed.

It is appreciated that in the mutual orientation shown in FIG. 18E, the rotation speed of the base portion 504 returns to be at or near a maximum due to the fact that the resistance to rotation of the base portion 504 is at a minimum, as the result of the absence of displacement of the intermediate geared ring 520 relative to base portion 504 in the viscous fluid 700 and as a result of the absence of physical contact between MBCVMA 510 and intermediate geared ring 520. It is further appreciated that angle β4 is substantially greater than angle β3, indicating that the speed of rotation of the base portion 504 between the orientations of FIGS. 18D and 18E is substantially greater than the speed of rotation of the base portion 504 between the orientations of FIGS. 18C and 18D.

Figure 19:
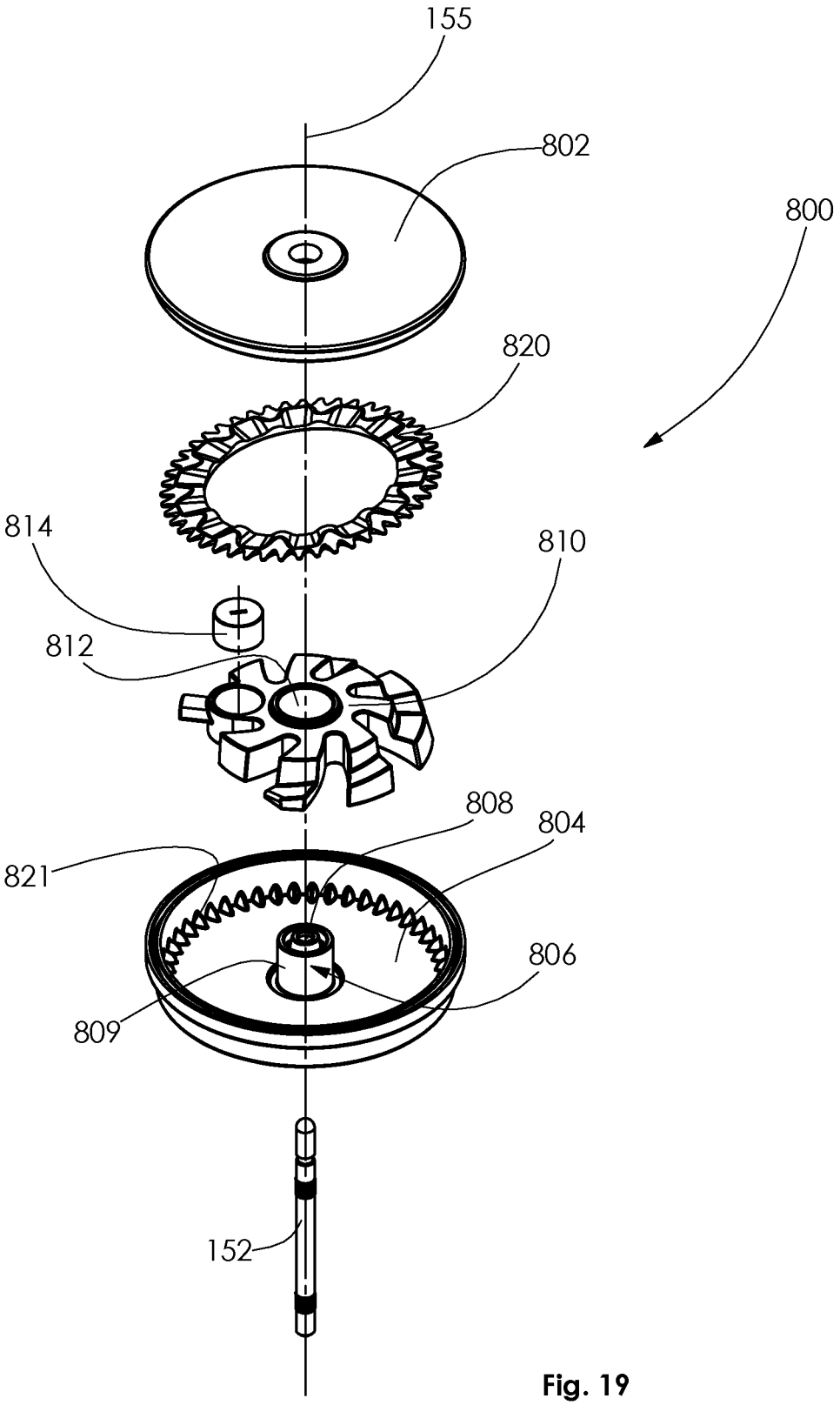
FIG. 19 is a simplified exploded view illustration of a second embodiment of a rotating, azimuth responsive, multiple rotation speed governor assembly (RARMRSGA) useful in the sprinkler of FIGS. 1A-2.

Reference is now made to FIG. 19, which is an exploded view illustration of a second embodiment, here designated by reference numeral 800, of a rotating, azimuth responsive, multiple rotation speed governor assembly (RARMRSGA) 150 forming part of the sprinkler of FIGS. 1A-2. As seen in FIG. 19, RARMRSGA 800 preferably includes a cover portion 802 and a base portion 804, to which the cover portion is sealingly and fixedly attached and which together define a sealed enclosure for containing a viscous fluid, typically polydimethylsiloxane, preferably having a viscosity of between 50,000 and 100,000 mPa·s. It is a particular feature of embodiments of the present invention that the viscous fluid does not fully fill the enclosure and that air is also present within the sealed enclosure.

Base portion 804 defines, inter alia a central hub 806, arranged about axis 155 and having a central aperture 808 through which extends splined axle 152 in fixed relationship therewith. Central hub 806 preferably defines a generally circularly cylindrical outer hub surface 809.

Disposed within the enclosure defined by mutually sealed cover portion 802 and base portion 804 is a magnet bearing centrifugal viscous material accelerator and geared ring tilter (MBCVMAGRT) 810, having a central generally circularly cylindrical bore 812 configured for mutually rotatable mounting of MBCVMAGRT 810 onto circularly cylindrical outer hub surface 809 for relatively low friction rotation of base portion 804 about axis 155 relative to MBCVMAGRT 810. A magnet 814, preferably a cylindrical neodymium magnet having a diameter of 8 mm and a height of 5 mm and arranged to have a polarity opposite to that of magnets 190 and 192, is fixedly mounted onto MBCVMAGRT 810. Magnet 814 provides, together with magnets 190 and 192, dampening of the rotary motion of RARMRSGA 800 and deflector 160 about axis 155, similar to the magnet dampening provided in the sprinkler described in U.S. Pat. No. 8,998,109, the disclosure of which is hereby incorporated by reference.

An intermittently discretely tiltable geared ring (IDTGR) 820 is disposed within an enclosure defined by mutually sealed cover portion 802 and base portion 804, intermediate MBCVMAGRT 810 and an interior corner geared surface 821 of base portion 804.

Cover portion 802 is illustrated in FIGS. 12A and 12B, described hereinabove and is there designated by reference numeral 502.

Figure 20A:
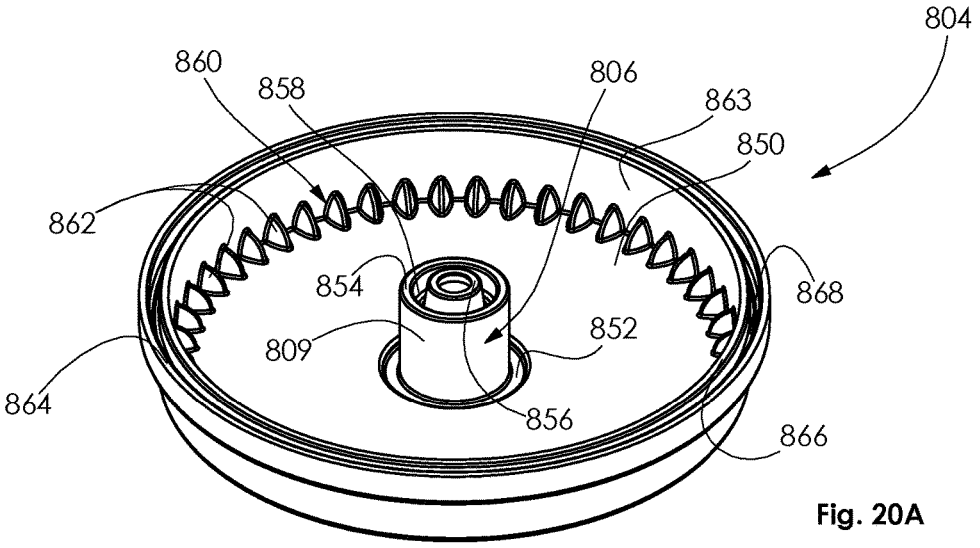
FIGS. 20A and 20B are simplified respective top perspective and top planar views of a base portion of the rotating, azimuth responsive, multiple rotation speed governor assembly (RARMRSGA) of FIG. 19.
Figure 20B:
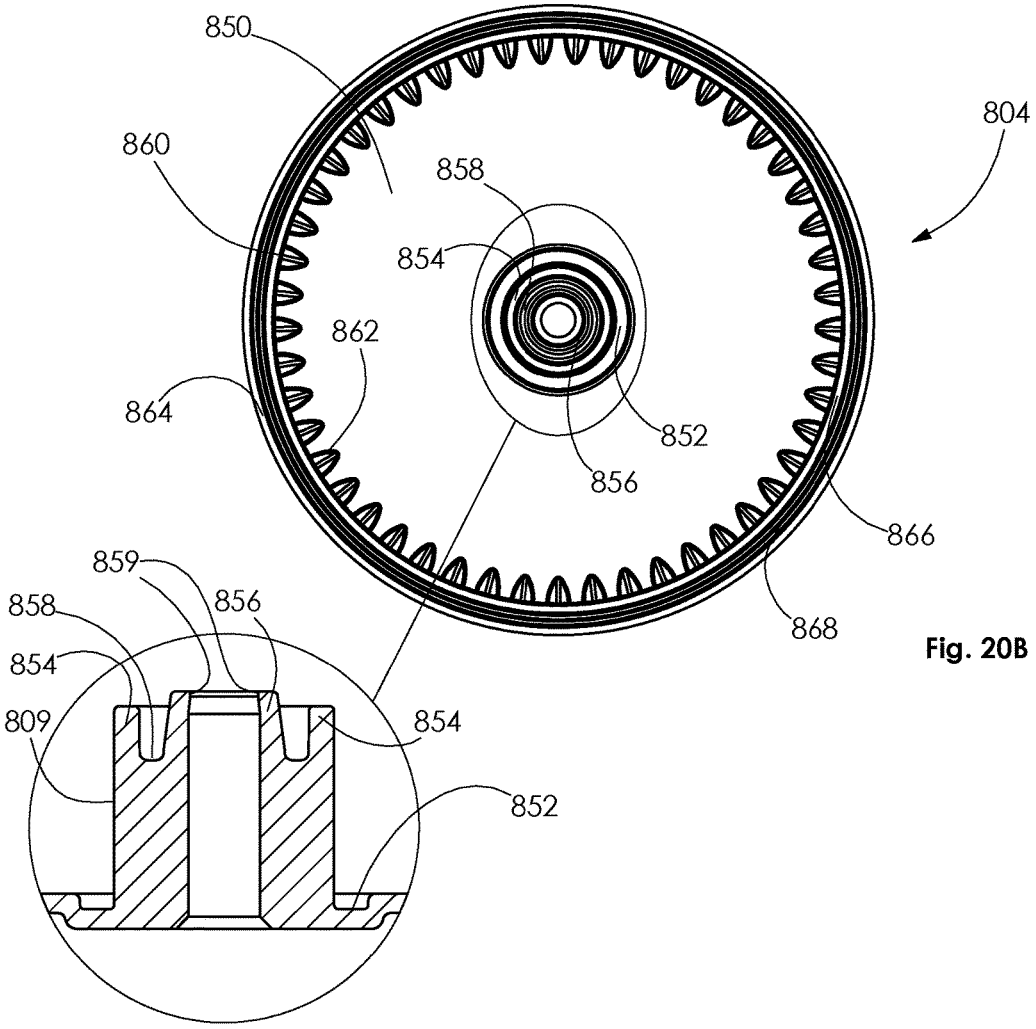
Figure 21A:
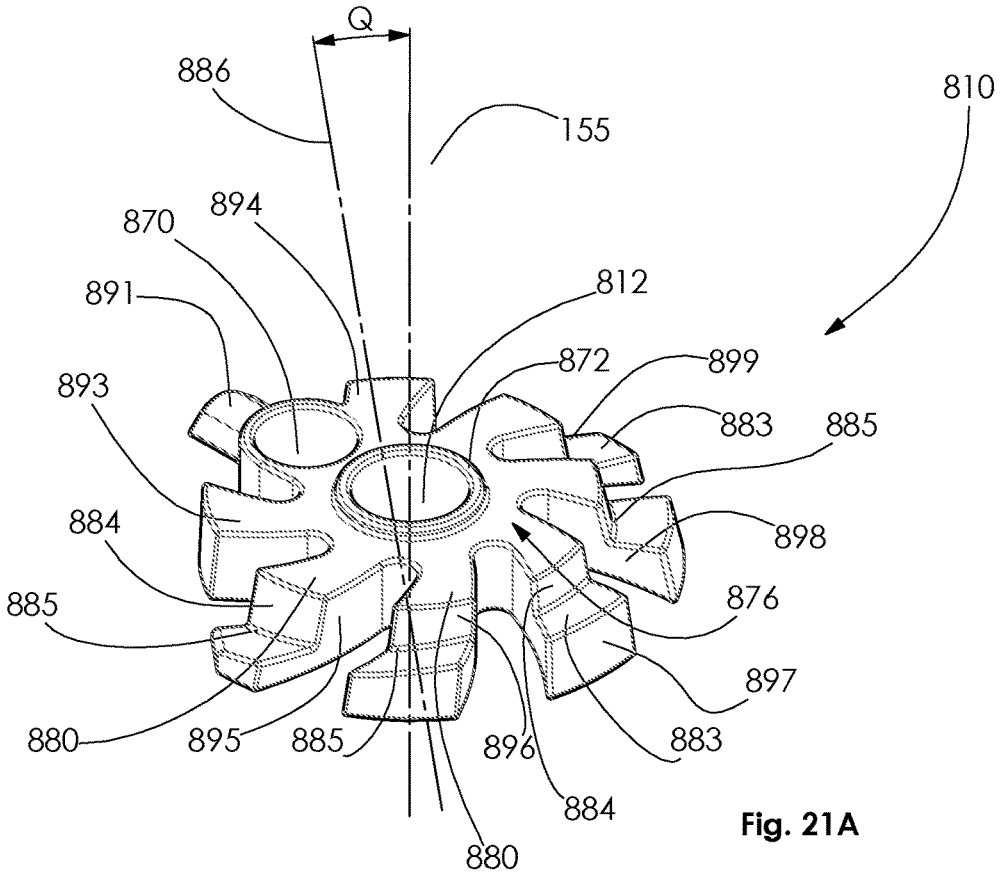
FIGS. 21A, 21B, 21C, 21D and 21E are, respectively, simplified top and bottom perspective, top and bottom plan view illustrations and a side section view illustration of a magnet bearing centrifugal viscous material accelerator (MBCVMA), forming part of the rotating, azimuth responsive, multiple rotation speed governor assembly (RARMRSGA) of FIG. 19, FIG. 21E, being taken along lines XXIE-XXIE of FIG. 21C.
Figure 21B:
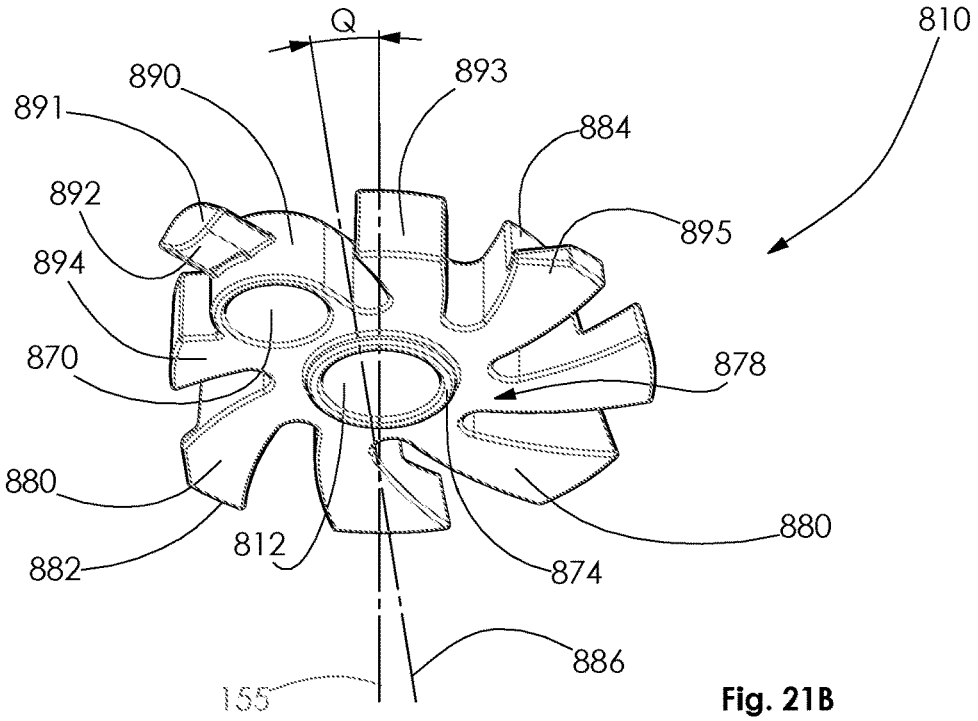
Figure 21C:
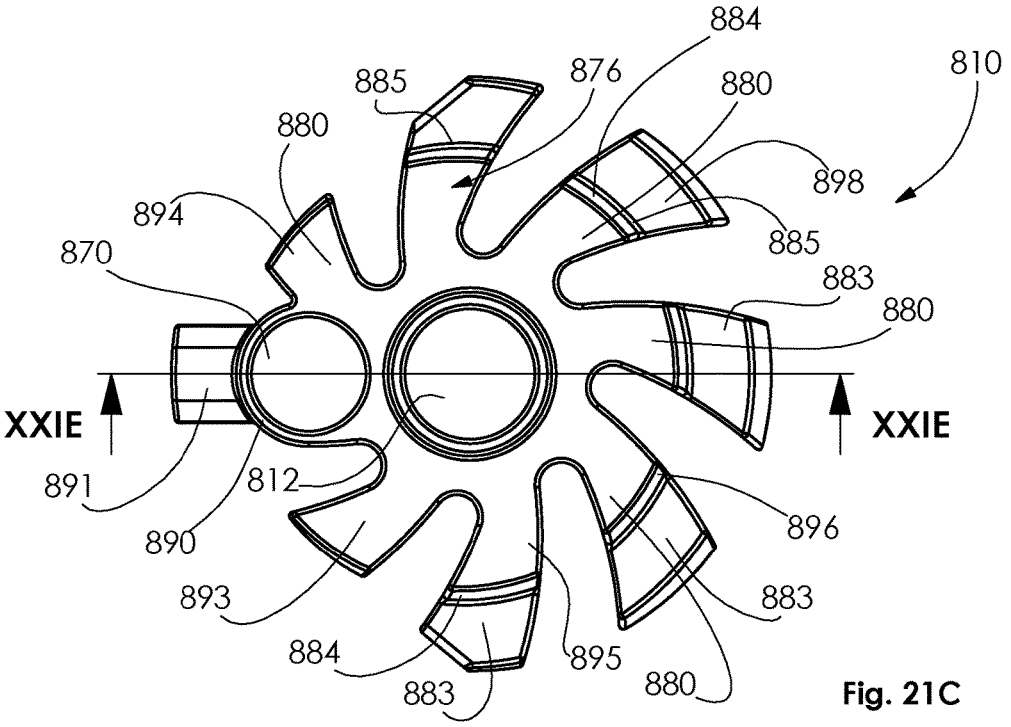
Figure 21D:
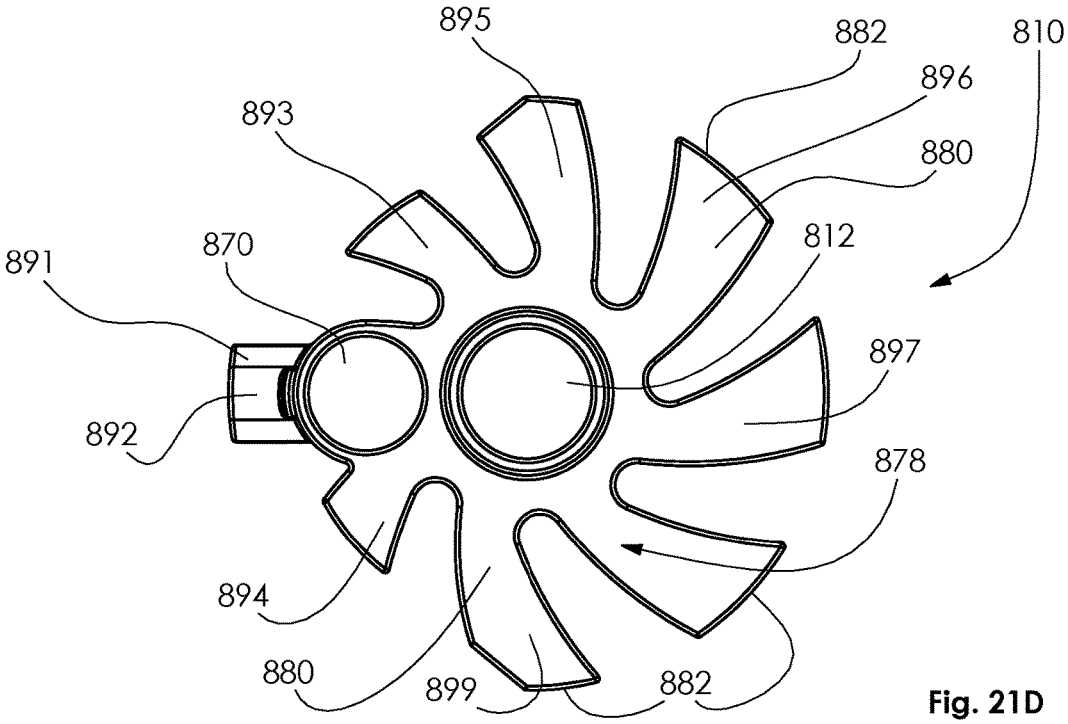
Figure 21E:
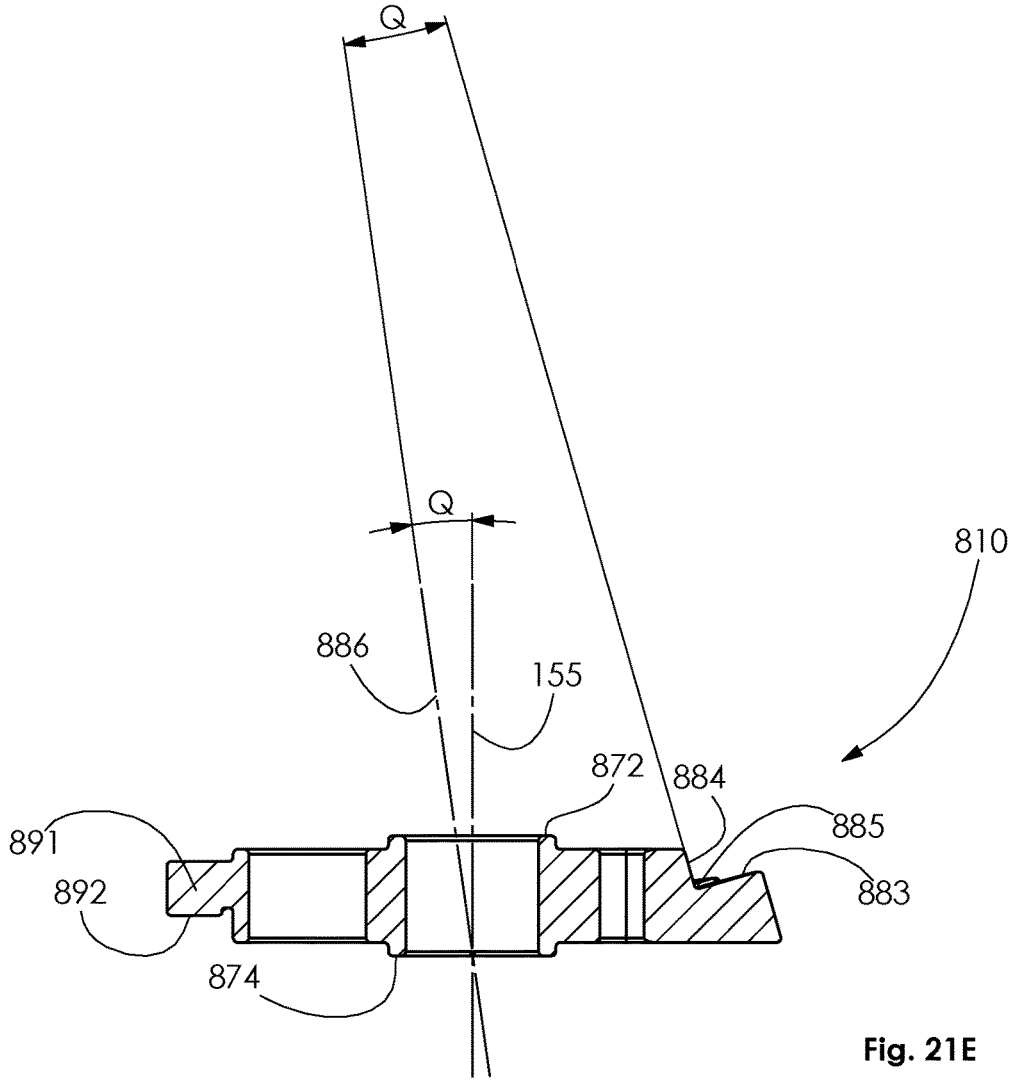

Base portion 804 is illustrated in FIGS. 20A and 20B. As seen in FIGS. 20A and 20B, base portion 804 includes a generally flat upward facing disk-like surface 850 surrounding a recessed central ring surface 852. Recessed central ring surface 852 surrounds central hub 806, which defines generally circularly cylindrical outer hub surface 809 (FIG. 19). Central hub 806 includes a pair of concentric mutually radially spaced upwardly directed rims 854 and 856, which define therebetween a recess 858. Upon ultrasonic sealing of cover portion 802 to base portion 804, circular rim 540 of cover portion 802 becomes welded to rims 854 and 856 about bore 828, thereby filling recess 858.

It is a particular feature of an embodiment of the present invention that rim 856 includes at least one radially inwardly directed portion 859 which extends in fixed axial locking engagement with circumferential recess 548 of splined axle 152.

A circular array 860 of radially inwardly facing corner gear teeth 862 surrounds surface 850 at the junction of surface 850 and an inner cylindrical wall 863. Cylindrical wall 863 terminates in a pair of concentric mutually spaced upwardly directed rims 864 and 866, which define therebetween a recess 868. Upon ultrasonic sealing of cover portion 802 to base portion 804, circular rim 530 of cover portion 802 becomes welded to rims 864 and 866 of base portion 804, thereby filling recess 868.

Reference is now made to FIGS. 21A, 21B, 21C, 21D and 21E, which are respectively simplified top and bottom perspective, top and bottom plan view illustrations and a side sectional view illustration of magnet bearing centrifugal viscous material accelerator and geared ring tilter (MBCVMAGRT) 810, forming part of the rotating, azimuth responsive, multiple rotation speed governor assembly (RARMRSGA) of FIG. 19.

As noted above with reference to FIG. 19, MBCVMAGRT 810 is formed with a central generally circularly cylindrical bore 812, configured for mutually rotatable mounting of MBCVMAGRT 810 onto circularly cylindrical outer hub surface 809 of base portion 804 for relatively low friction rotation of base portion 804 about axis 155 relative to MBCVMAGRT 810. A magnet 814 (not shown in FIGS. 21A-21E), preferably a cylindrical neodymium magnet having a diameter of 8 mm and a height of 5 mm and arranged to have a polarity opposite to that of magnets 190 and 192, is fixedly mounted onto MBCVMAGRT 810 at a magnet receiving aperture 870. It is appreciated that MBCVMAGRT 810 is preferably formed with a pair of axially protruding ring surfaces 872 and 874, which extend axially outwardly from respective generally flat surfaces 876 and 878, for relatively low friction rotational engagement between MBCVMAGRT 810 and respective cover portion 802 and base portion 804 of RARMRSGA 800.

It is a particular feature of an embodiment of the present invention that MBCVMAGRT 810 is formed with a plurality of radially outwardly and tangentially directed vanes 880, whose purpose is to direct the viscous material within the enclosure radially outwardly from MBCVMAGRT 810 towards IDTGR 820 and towards circular array 860 of radially inwardly facing corner gear teeth 862 on base portion 804, such that the viscous material provides resistance to mutual displacement of intermediate ring 820 and base portion 804 as well as to mutual displacement of intermediate ring 820 and base portion 804 relative to MBCVMAGRT 810, which is generally static. This resistance reduces the speed of rotation of the base member 804 and thus of shaft 152 about axis 155. Vanes 880 collectively define an interrupted circumferential edge 882 at surface 878.

It is an additional particular feature of an embodiment of the present invention that vanes 880 also collectively define an interrupted conical circumferential surface 883 and an interrupted conical circumferential surface 884, which intersects interrupted circumferential surface 883 along an interrupted line 885. Interrupted circumferential surfaces 883 and 884 and interrupted line 885 are each centered about an axis 886, which is angled with respect to axis 155 and intersects axis 155. Interrupted line 885 lies in a plane perpendicular to axis 886. At every point along interrupted line 885, the portions of a section extending through axis 886 at such point and through respective surfaces 883 and 884 lie perpendicular to each other. At every point along interrupted line 885, surface 884 defines an angle Q with respect to axis 886.

The geometrical relationship of axis 886 and rotation axis 155 and thus the geometrical orientation of interrupted circumferential surfaces 883 and 884 and interrupted line 885 is related to the geometry of IDTGR 820, as will be described hereinbelow, and is designed to provide rotatable positioning and support thereto. Interrupted circumferential surface 883 provides a uniplanar tilted lower support surface for IDTGR 820, as seen clearly in FIG. 23B and described hereinbelow. Interrupted circumferential surfaces 883 and 884 are hereafter sometimes referred to as IDTGR engagement surfaces.

As seen in FIGS. 21A-21E, magnet receiving aperture 870 is preferably located in a radially outwardly extending portion 890 of MBCVMAGRT 810. Preferably, a radially outwardly directed engagement protrusion 891 extends radially outwardly from portion 890 and defines an axially directed IDTGR engagement surface 892, which intermittently engages a facing surface portion of IDTGR 820 and forces it towards surface 850 while it remains in gear engagement with circular array 860 of radially inwardly facing corner gear teeth 862. As will be described hereinbelow in greater detail, IDTGR engagement surface 892 engages IDTGR 820 during rotation of base portion 804 relative to MBCVMAGRT 810 about axis 155.

It is a particular feature of this second embodiment of the present invention that engagement of MBCVMAGRT 810 with IDTGR 820 provides intermittent tilting of IDTGR 820, which intermittently slows rotation of the base portion 804.

It is noted that two of vanes 880, designated by reference numerals 893 and 894, which are adjacent on both sides to radially outwardly extending portion 890 of MBCVMAGRT 810 have a maximum radial extent from axis 886 equal to a distance from interrupted line 885 to axis 886. The remaining vanes 880 are designated by reference numerals 895, 896, 897, 898 and 899, respectively.

Reference is now made to FIGS. 22A, 22B, 22C and 22D, which illustrate IDTGR 820. As seen in FIGS. 22A-22D, IDTGR 820 is a generally circularly symmetric, generally flat ring having a circular outer circumference which is slightly less than that of inner cylindrical wall 863 of base portion 804. As see most clearly in FIG. 22D, IDTGR 820 has generally conical top and bottom-facing surfaces 930 and 932 which are both tilted outwardly and upwardly with respect to axis 886 when IDTGR 820 is situated on IDTGR engagement surfaces 883 of MBCVMAGRT 810. It is noted that bottom-facing surface 932 defines an angle Q with respect to a perpendicular to axis 886, which angle is equal to the angle of intersection of axes 886 and 155 and is also equal to the angle Q between surface 884 and axis 155 defined above.

Each of generally conical top and bottom-facing surfaces 930 and 932 intersect a generally conical radially inner facing edge surface 933. Generally conical radially inner facing edge surface 933 defines an angle Q with respect to axis 866, which is also equal to angle Q defined by bottom-facing surface 932 with respect to axis 886 and angle Q between surface 884 and axis 155 defined above.

Figure 22A:
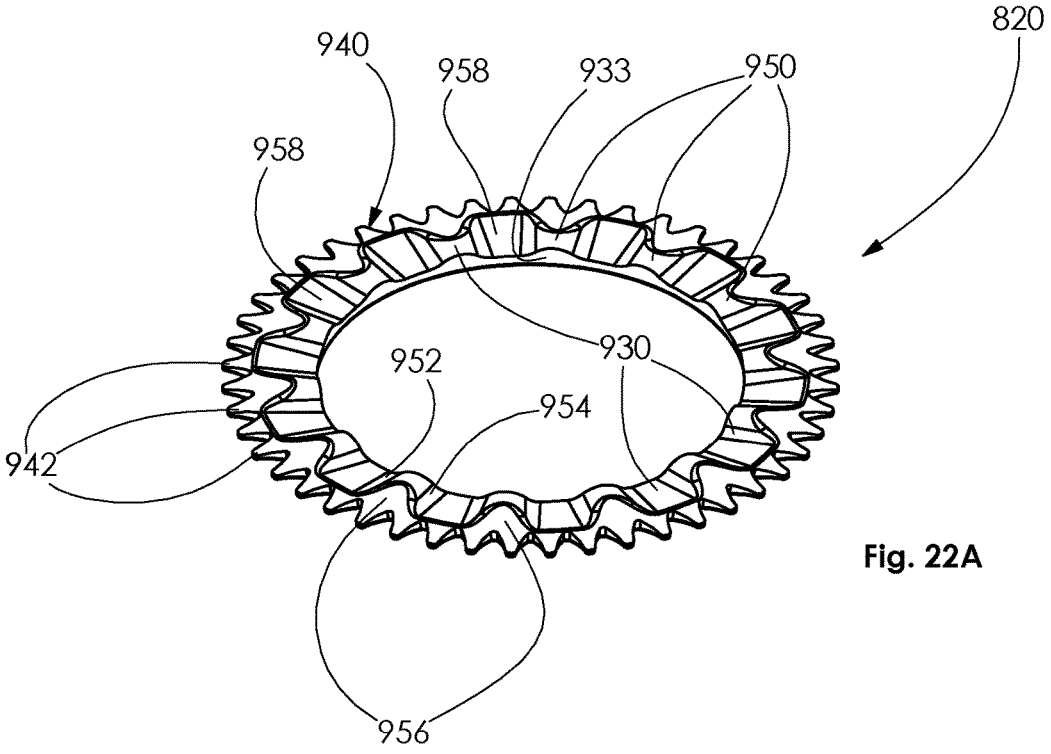
FIGS. 22A, 22B, 22C and 22D are, respectively, simplified top and bottom perspective, top plan view and sectional illustrations of a geared intermediate element, forming part of the rotating, azimuth responsive, multiple rotation speed governor assembly (RARMRSGA) of FIG. 19, FIG. 22D being taken along lines XXIID-XXIID in FIG. 22C.
Figure 22B:
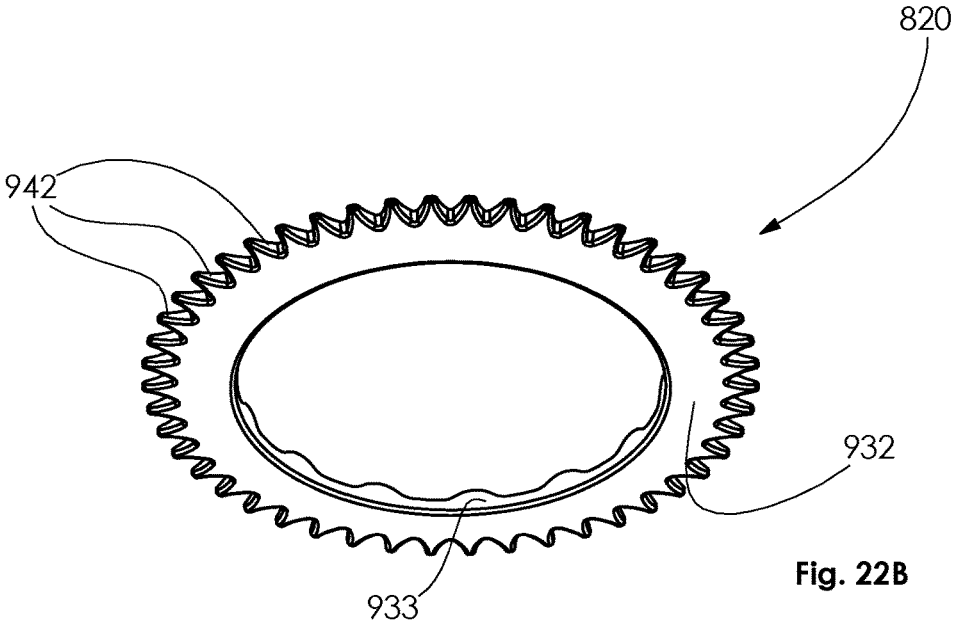
Figure 22C:
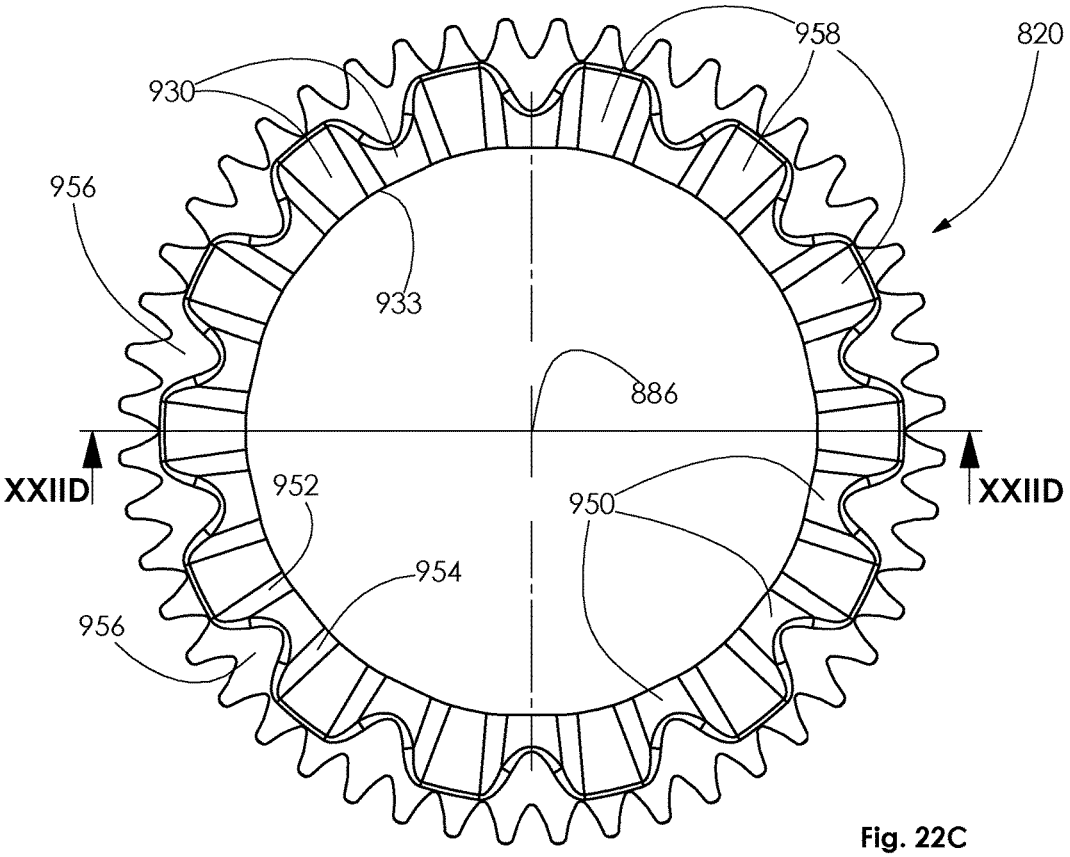
Figure 22D:
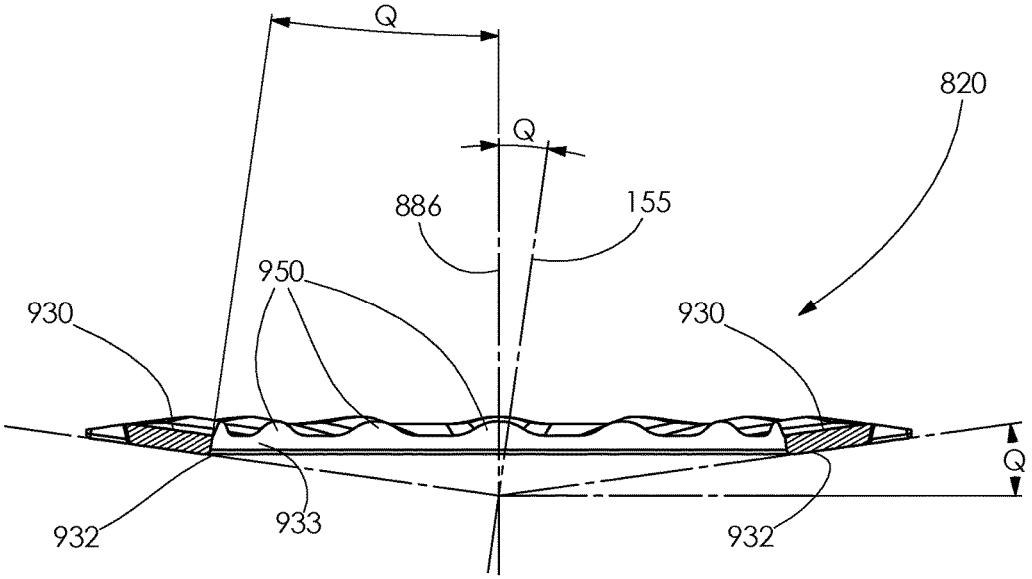

IDTGR 820 is preferably formed with an array 940 of teeth 942, which extend radially outwardly and upwardly in the sense of FIG. 22D and each have a generally triangular cross section in the plane of FIG. 22D. The number of teeth 942 in array 940 is preferably smaller than the number of corner gear teeth 862 formed on base portion 804 and the number of corner gear teeth 862 is not an integer multiple of the number of teeth 942. As will be described hereinbelow in greater detail, due to the tilted orientation of IDTGR 820 relative to base portion 804, only some of the teeth 942 engage gear teeth 862 at any point in the rotation of the base portion 804 about axis 155.

It is a particular feature of this embodiment of the present invention that top facing surface 930 includes a plurality of generally uniformally azimuthally-spaced protrusions 950. Preferably, the number of protrusions 950 is substantially less than the number of teeth 942 and the number of protrusions 950 corresponds to the number of desired slow rotation portions desired per full 360 degree rotation of base portion 804. Each protrusion 950 preferably includes rounded azimuthal side edge surfaces 952 and 954 and a tapered radially extending edge 956. Top facing surface 930 preferably includes valley surfaces 958, which may be flat, between adjacent protrusions 950.

Figure 23A:
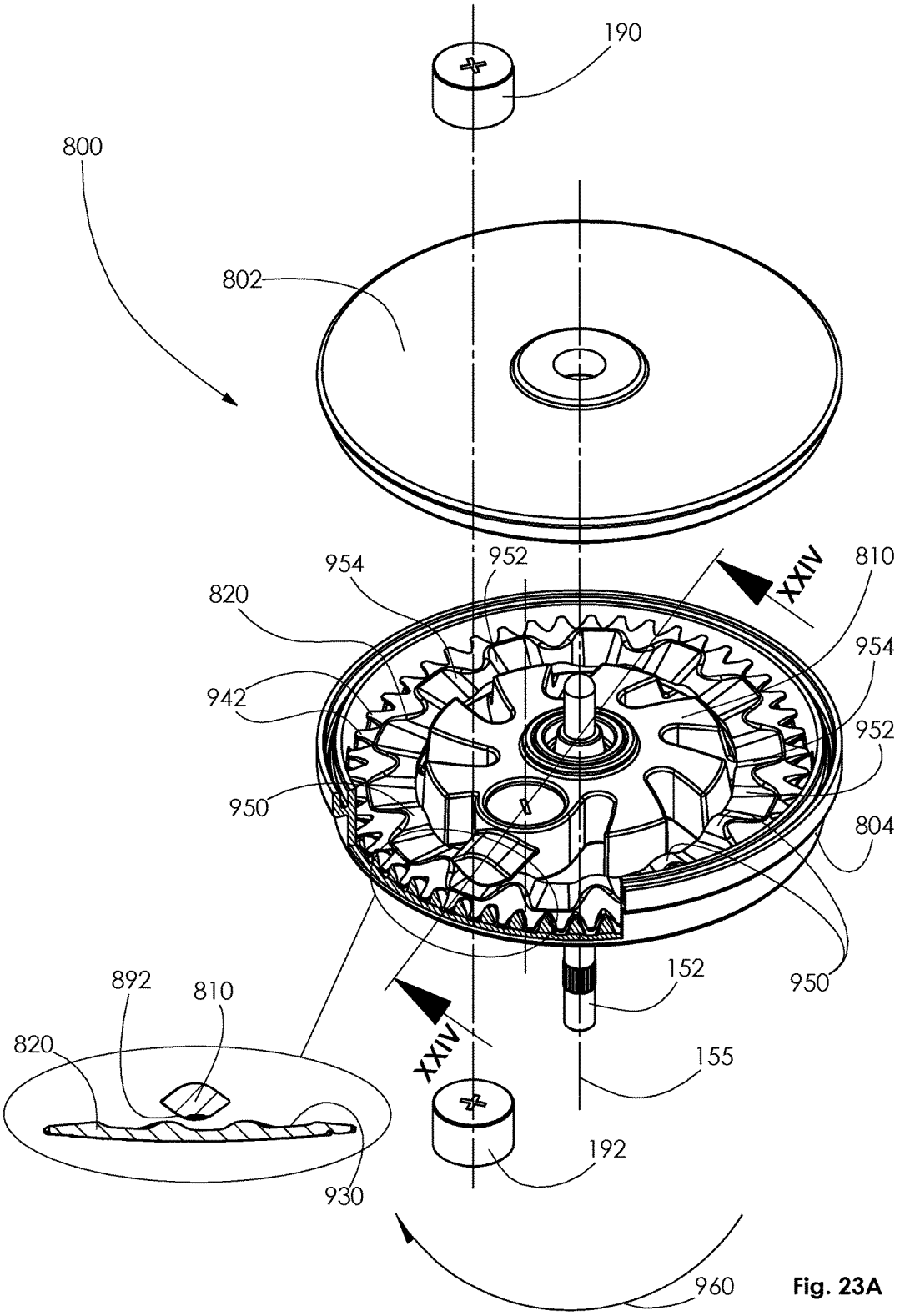
FIGS. 23A and 23B are, respectively, simplified pictorial and side view, partially exploded view illustrations of the first embodiment of the rotating, azimuth responsive, multiple rotation speed governor assembly (RARMRSGA) shown in FIG. 19.
Figure 23B:
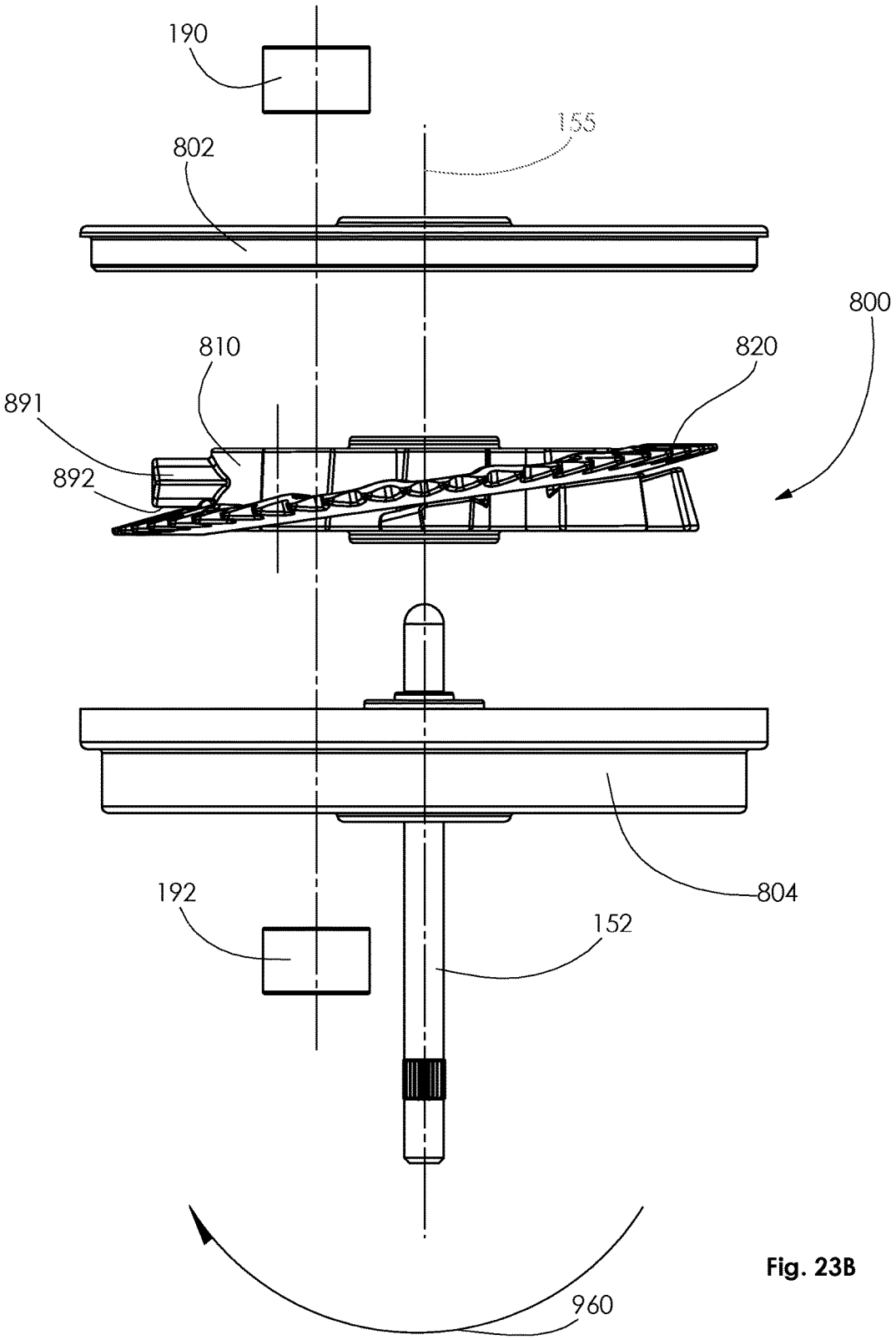

Reference is now made to FIGS. 23A and 23B, which are respectively simplified pictorial and side view, partially exploded view illustrations of the second embodiment of a rotating, azimuth responsive, multiple rotation speed governor assembly (RARMRSGA) shown in FIG. 19. FIG. 23A is partially cut-away for the sake of clarity.

As seen in FIGS. 23A and 23B, IDTGR 820 is always maintained in a tilted orientation relative to MBCVMAGRT 810 and to base portion 804. In this tilted orientation, a portion of IDTGR 820 underlies radially outwardly directed engagement protrusion 891 and is engaged by IDTGR engagement surface 892. As seen clearly, particularly in an enlargement forming part of FIG. 23A, top-facing surface 930 of IDTGR 820 is engaged by IDTGR engagement surface 892 and bottom-facing surface 832 of IDTGR 820 is engaged by upward-facing IDTGR engagement surfaces 883 of vanes 895, 896, 897, 898 and 899.

During operation of the sprinkler, base portion 804, which is fixedly mounted onto splined axle 152, rotates about axis 155, while MBCVMAGRT 810 is static. The engagement of teeth 942 of IDTGR 820 with inwardly facing corner gear teeth 862 on base portion 804 causes IDTGR 820 to rotate relative to MBCVMAGRT 810 about axis 886. It is a particular feature of this embodiment that this rotation requires IDTGR 820 to sequentially tilt as it approaches radially outwardly directed engagement protrusion 891. This sequential tilting encounters resistance from the viscous fluid within RARMRSGA 800, which slows the rotation of base portion 804.

It is a further, important particular feature of this embodiment that the provision of plurality of uniformally azimuthally-spaced protrusions 950 on top facing surface 930 provides intermittent further slowing of the rotation of base portion 804 at a plurality of azimuthal locations, whose azimuthal positions shift with each rotation. This further slowing is the result of sequential intermitted engagement of each protrusion 950 with IDTGR engagement surface 892 of radially outwardly directed engagement protrusion 891 of MBCVMAGRT 810. Each such engagement requires additional tilting of IDTGR 820 and corresponding displacement of the viscous fluid and results in concomitant discrete intermittent slowing of rotation of the base portion 804 about axis 155.

Reference is now made to FIGS. 24A, 24B, 24C, 24D and 24E, which are simplified sectional illustrations of five stages in the operation of the rotating, azimuth responsive, multiple rotation speed governor assembly (RARMRSGA) of FIGS. 19-23B, taken along lines XXIV-XXIV in FIG. 23A and fixed with respect to MBCVMAGRT 810. Line XXIV-XXIV is drawn to intersect the downwardmost part of IDTGR engagement surface 892 and axis 155.

Figure 24A:
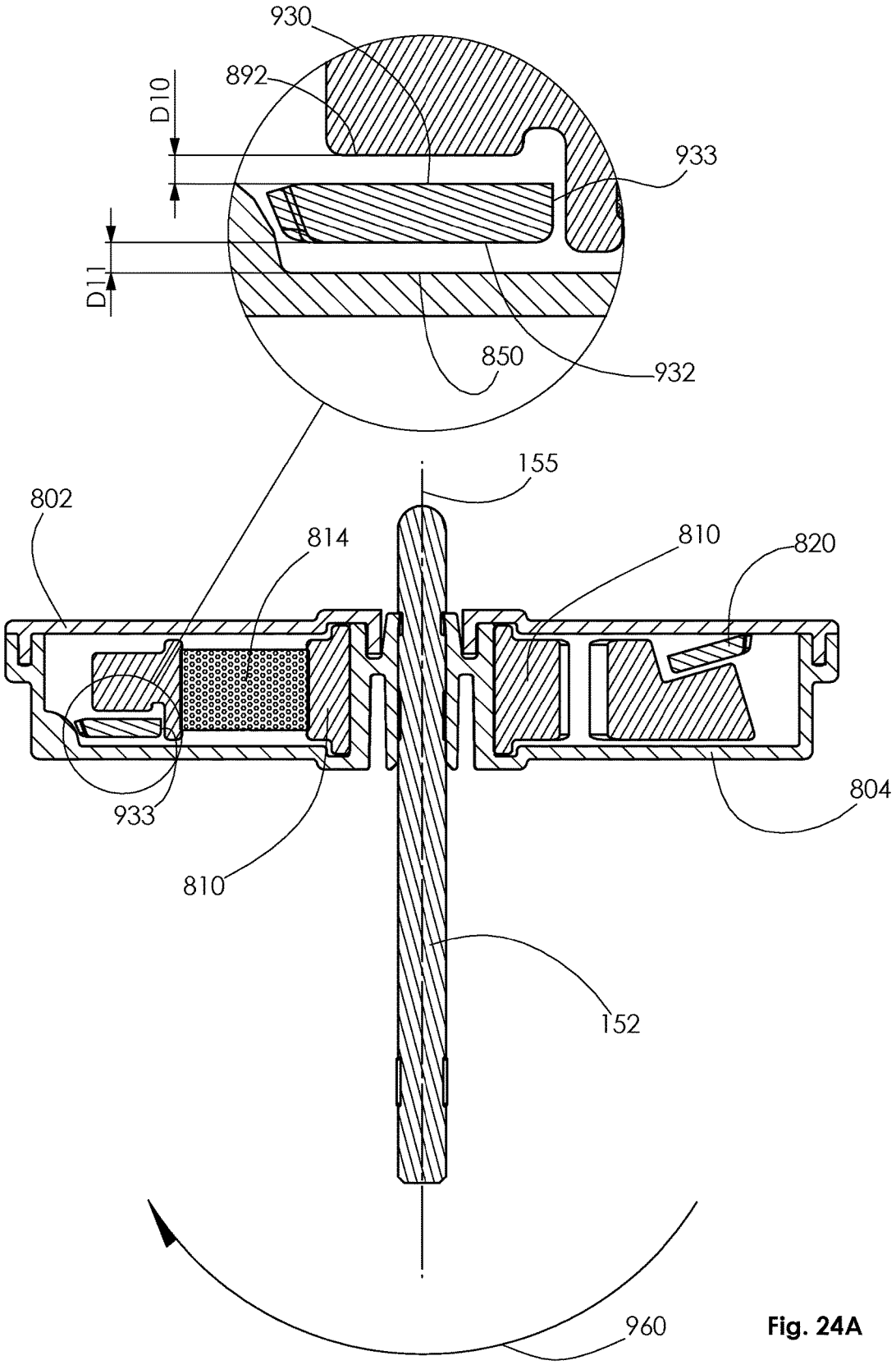
FIGS. 24A, 24B, 24C, 24D and 24E are simplified sectional illustrations of five stages in the operation of the rotating, azimuth responsive, multiple rotation speed governor assembly (RARMRSGA) of FIGS. 19-23B, taken along lines XXIV-XXIV in FIG. 23A.

Reference is now made specifically to FIG. 24A, which shows the mutual orientations of MBCVMAGRT 810, IDTGR 820 and base portion 804 at an arbitrary azimuthal orientation of base portion 804 with respect to MBCVMAGRT 810 about axis 155. It is appreciated that the base portion 804 rotates about axis 155 in a clockwise manner, indicated by an arrow 960, in all of FIGS. 23A-24E. It is appreciated that as a result of the rotation of base portion 804 about axis 155, IDTGR engagement surface 892 intermittently engages top facing surface 930 of IDTGR 820 at protrusions 950.

In the mutual orientation as seen in the section appearing in FIG. 24A, IDTGR engagement surface 892 has recently become disengaged from a protrusion 950 of IDTGR 820. It is seen that in the mutual orientation shown in FIG. 24A, defined at an azimuthal location which lies in a valley between protrusions 950, the distance between IDTGR engagement surface 892 and top facing surface 930 of IDTGR 820 is a near maximum distance D10 and the distance between the bottom facing surface 932 of IDTGR 820 and the generally flat upward facing disk-like surface 850 of base portion 804 is a near maximum distance D11.

It is appreciated that in the mutual orientation as seen in the section appearing in FIG. 24A, the rotation speed of the base portion 804 is at a maximum due to the fact that the resistance to rotation of the base portion is at a minimum since IDTGR engagement surface 892 does not engage the IDTGR 820.

Figure 24B:
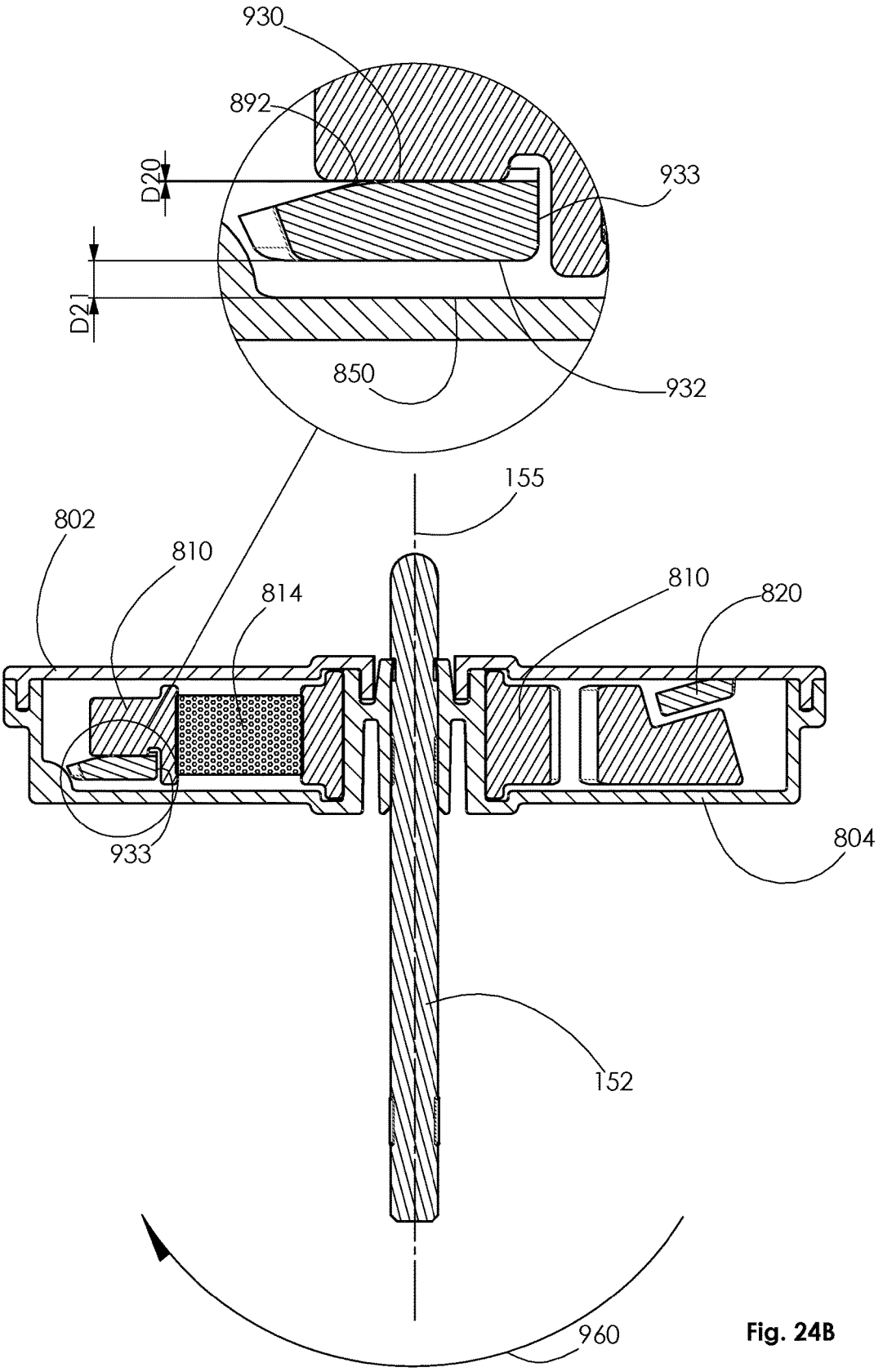

Reference is now made specifically to FIG. 24B, which is a section showing the mutual orientations of MBCVMAGRT 810, IDTGR 820 and base portion 804 at a stage wherein the base portion 804 is rotated clockwise in the sense of FIG. 23A along arrow 960 about axis 155 relative to MBCVMAGRT 810 with respect to the mutual orientation shown in FIG. 24A. In the mutual orientation as seen in the section of FIG. 24B, IDTGR engagement surface 892 of MBCVMAGRT 810 initially engages a protrusion 950, corresponding to rounded azimuthal side edge surface 952 of an adjacent protrusion 950 along rotation direction 960.

It is seen that in the mutual orientation as seen in the section appearing in FIG. 24B, the distance between IDTGR engagement surface 892 and top facing surface 930 of IDTGR 820 is a minimum distance D20, which is equal to or close to zero, and the distance between the bottom facing surface 932 of IDTGR 820 and the generally flat upward facing disk-like surface 850 of base portion 804 is a near maximum distance D21, which is typically slightly greater than D11.

It is appreciated that the space between the IDTGR 820 and the generally flat upward facing disk-like surface 850 of base portion 804 remains partially filled with viscous fluid. It is thus appreciated that notwithstanding the rotation of base portion 804, the mutual orientations of IDTGR 820 and base portion 804 have not significantly changed.

It is appreciated that in the mutual orientation as seen in the section appearing in FIG. 24B, the rotation speed of the base portion 804 remains at a maximum due to the fact that the resistance to rotation of the base portion is at a minimum.

Figure 24C:
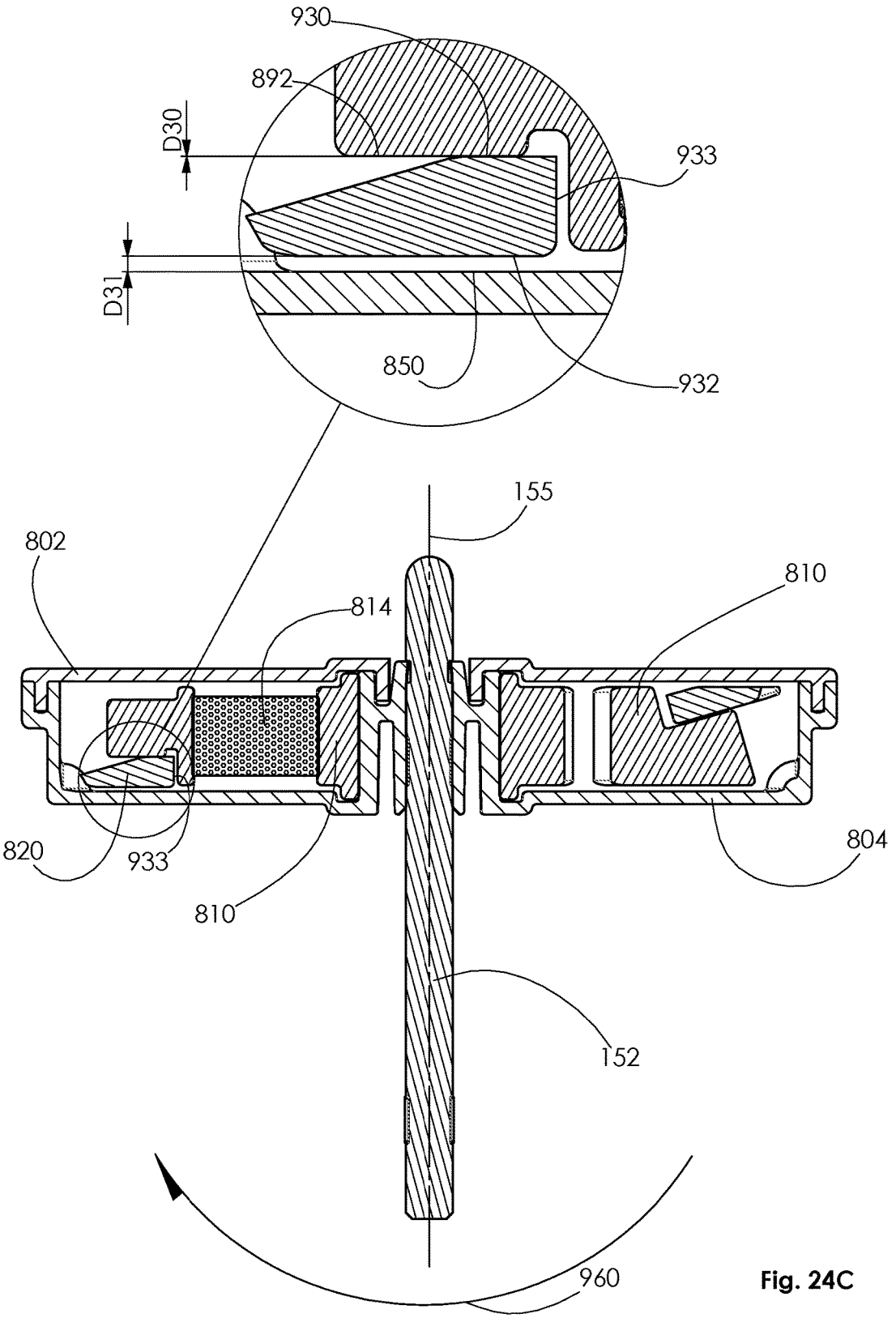

Reference is now made specifically to FIG. 24C, which shows the mutual orientations of MBCVMAGRT 810, IDTGR 820 and base portion 804 at a stage wherein the base portion 804 is rotated clockwise in the sense of FIG. 23A along arrow 960 about axis 155 relative to MBCVMAGRT 810 with respect to the mutual orientation shown in FIG. 24B. In the mutual orientation of FIG. 24C, IDTGR engagement surface 892 of MBCVMAGRT 810 engages protrusion 950.

It is seen that in the mutual orientation as seen in the section appearing in FIG. 24C, the distance between IDTGR engagement surface 892 and top facing surface 930 of IDTGR 820 is a minimum distance D30, which is equal to or close to zero, and the distance between the bottom facing surface 932 of IDTGR 820 and the generally flat upward facing disk-like surface 850 of base portion 804 is a minimum distance D31.

It is appreciated that the space between the IDTGR 820 and the generally flat upward facing disk-like surface 850 of base portion 804 remains partially filled with viscous fluid. It is thus appreciated that due to further rotation of base portion 804, the mutual orientations of IDTGR 820 and base portion 804 have significantly changed.

It is appreciated that in the mutual orientation as seen in the section appearing in FIG. 24C, the rotation speed of the base portion 804 is at or near a minimum due to the fact that the resistance to rotation of the base portion is at a maximum.

Figure 24D:
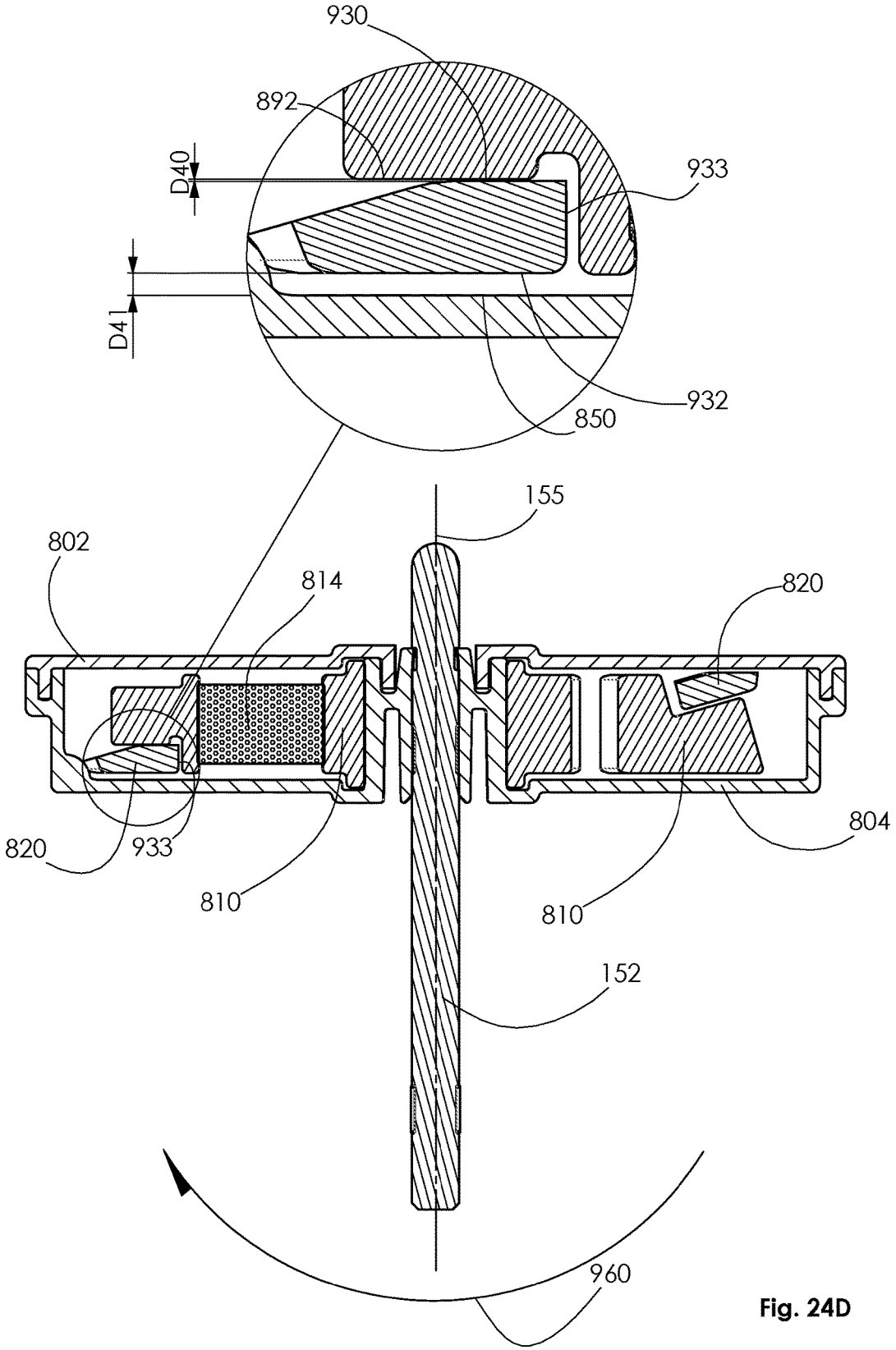

Reference is now made specifically to FIG. 24D, which is a section showing the mutual orientations of MBCVMAGRT 810, IDTGR 820 and base portion 804 at a stage wherein the base portion 804 is rotated clockwise in the sense of FIG. 23A along arrow 960 about axis 155 relative to MBCVMAGRT 810 with respect to the mutual orientation shown in FIG. 24C. In the mutual orientation as seen in the section appearing in FIG. 24D, IDTGR engagement surface 892 of MBCVMAGRT 810 still engages protrusion 950.

It is seen that in the mutual orientation as seen in the section appearing in FIG. 24D, the distance between IDTGR engagement surface 892 and top facing surface 930 of IDTGR 820 is a minimum distance D40, which is equal to or close to zero, and the distance between the bottom facing surface 932 of IDTGR 820 and the generally flat upward facing disk-like surface 850 of base portion 804 is near a minimum distance D41.

It is appreciated that the space between the IDTGR 820 and the generally flat upward facing disk-like surface 850 of base portion 804 remains partially filled with viscous fluid. It is thus appreciated that due to further rotation of base portion 804, the mutual orientations of IDTGR 820 and base portion 804 have not significantly changed.

It is appreciated that in the mutual orientation as seen in the section appearing in FIG. 24D, the rotation speed of the base portion 804 is at or near a minimum due to the fact that the resistance to rotation of the base portion is at a maximum.

Figure 24E:
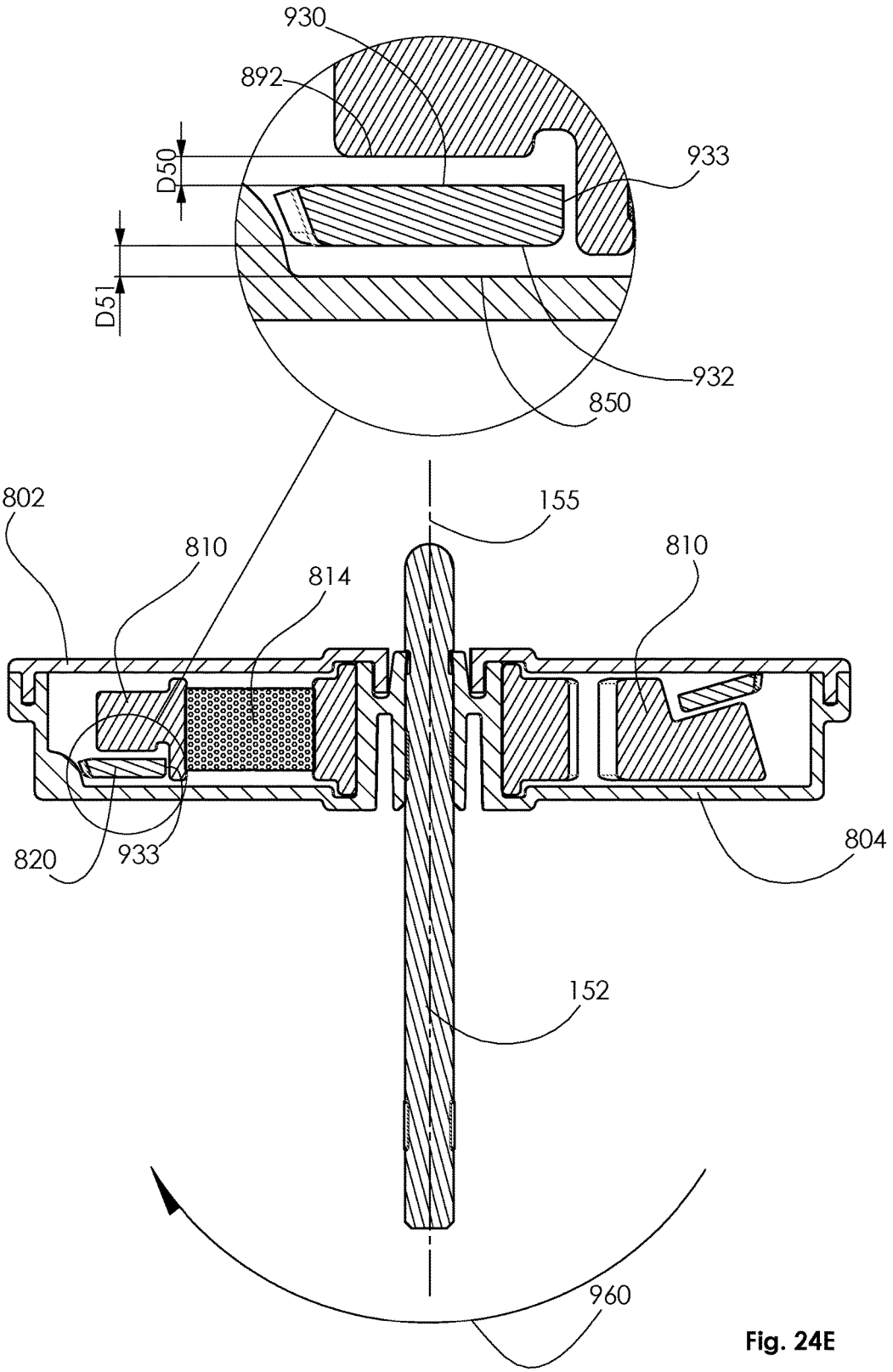

Reference is now made specifically to FIG. 24E, which is a section showing the mutual orientations of MBCVMAGRT 810, IDTGR 820 and base portion 804 at a stage wherein the base portion 804 is rotated clockwise in the sense of FIG. 23A along arrow 960 about axis 155 relative to MBCVMAGRT 810 with respect to the mutual orientation shown in FIG. 24D. The mutual orientation of FIG. 24E is identical to the mutual orientation of FIG. 24A.

Accordingly, in the mutual orientation as seen in the section appearing in FIG. 24E, defined at an azimuthal location which lies in a valley between protrusions 950, the distance between IDTGR engagement surface 892 and top facing surface 930 of IDTGR 820 is a near maximum distance D50 and the distance between the bottom facing surface 932 of IDTGR 820 and the generally flat upward facing disk-like surface 850 of base portion 804 is a near maximum distance D51.

It is appreciated that in the mutual orientation shown in FIG. 24E, the rotation speed of the base portion 804 is at a maximum due to the fact that the resistance to rotation of the base portion is at a minimum since IDTGR engagement surface 892 does not engage the IDTGR 820.

It is appreciated that in the orientation shown in FIGS. 24A and 24E, the portion of surface 933 azimuthally aligned with the downwardmost part of IDTGR engagement surface 892 is parallel to axis 155, as seen clearly in FIG. 22D. It is noted that FIG. 22D is taken along section line XXIID-XXIID in FIG. 22C, which shows an orientation of IDTGR 820 relative to axis 155, which is identical to the orientation of IDTGR 820 shown in FIGS. 23A and 24A wherein section line XXIV-XXIV intersects the downwardmost part of IDTGR engagement surface 892 and axis 155.

It will be appreciated by persons skilled in the art that the present invention is not limited to the features which have been particularly shown and described hereinabove and includes combinations and sub-combinations of such features as well as modifications and variations thereof, which are not in the prior art.

The invention claimed is:

1. A sprinkler comprising:

a fixed base defining a water inlet and a nozzle;

a rotating assembly arranged for rotation relative to said fixed base about a rotation axis and including a water stream director, receiving a pressurized stream of water from said nozzle and directing it in a generally radially outward direction; and a rotation speed governing assembly operatively associated with said rotating assembly and operative to intermittently reduce a speed of rotation of said rotating assembly, so as to thereby increase a radial range of said stream, said rotational speed governing assembly including:

a rotating enclosure rotating together with said rotating assembly and enclosing:

a viscous material;

a first element; and a second element, said rotating enclosure and said second element rotating about said rotation axis relative to said first element, said first element being formed with a plurality of radially outwardly and tangentially directed vanes for directing said viscous material within said enclosure radially outwardly from said first element towards said second element and towards an interior geared surface of said rotating enclosure, such that said viscous material provides resistance to mutual displacement of said second element and said rotating enclosure as well as to mutual displacement of said second element and said rotating enclosure relative to said first element, thereby reducing a speed of rotation of said rotating enclosure about said rotation axis.

2. A sprinkler according to claim 1 and wherein said second element comprises a ring having a plurality of protrusions arranged on a surface thereof at mutually azimuthally locations thereon.

3. A sprinkler according to claim 1 and wherein said rotation speed governing assembly comprises a top magnet supporting housing portion and a bottom magnet supporting housing portion.

4. A sprinkler according to claim 3 and wherein said housing portions are removably mounted onto said fixed base.

5. A sprinkler according to claim 3 and also comprising first and second magnets, arranged to have the same polarity, which are fixedly mounted in mutual coaxial arrangement at locations arranged about an axis parallel and radially spaced from said rotation axis onto said top and bottom magnet support housing portions.

6. A sprinkler according to claim 1 and wherein said rotation speed governing assembly comprises a rotating, azimuth responsive, multiple rotation speed governor assembly (RARMRSGA).

7. A sprinkler according to claim 6 and wherein said rotating enclosure is fixedly mounted onto an axle and is arranged for rotational movement together with said rotating assembly about said rotation axis and relative to said fixed base.

8. A sprinkler according to claim 7 and wherein a speed of rotation of said water stream director about said rotation axis is governed by said multiple rotation speed governor assembly, which rotates together therewith.

9. A sprinkler according to claim 8 and also comprising a ratcheted deflector, which is rotatably mounted for single direction, ratchet controlled rotation about said rotation axis relative to said fixed base.

10. A sprinkler according to claim 9 and wherein said ratcheted deflector comprises a generally disk-like element including a generally planar, generally circular inner plate having a top surface, a bottom surface and a circumferential edge and having, extending outwardly from the circumferential edge a plurality of mutually equally azimuthally spaced deflector portions, each of which defines a downward-facing deflector surface.

11. A sprinkler according to claim 6 and wherein said rotating, azimuth responsive, multiple rotation speed governor assembly includes a cover portion and a base portion, to which said cover portion is sealingly and fixedly attached and which together define said enclosure for containing said viscous fluid, which viscous fluid does not fully fill said enclosure.

12. A sprinkler according to claim 11 and wherein said first element comprises a magnet bearing centrifugal viscous material accelerator (MBCVMA) disposed within said enclosure, said MBCVMA having a central generally circularly cylindrical bore configured for mutually rotatable mounting of said MBCVMA onto a circularly cylindrical outer hub surface for rotation of said enclosure about said rotation axis, said MBCVMA having fixedly mounted therein a magnet.

13. A sprinkler according to claim 12 and wherein said second element comprises an intermediate geared ring disposed within said enclosure intermediate said MBCVMA and said interior geared surface of said enclosure.

14. A sprinkler according to claim 12 and wherein said magnet is located in a magnet receiving aperture located in a radially outwardly extending portion of said MBCVMA, which portion defines a first radially outwardly directed engagement surface, which surface engages said second element and urges and retains said second element in gear engagement with said interior geared surface of said enclosure, wherein said radially outwardly directed engagement surface intermittently engages said second element during rotation of said enclosure relative to said MBCVMA about said rotation axis.

15. A sprinkler according to claim 14 and wherein said MBCVMA is formed with a radially outward extending spacer portion, which is azimuthally spaced from said radially outwardly extending portion and defines a second radially outwardly directed engagement surface that preferably intermittently engages said second element during rotation of said enclosure relative to said MBCVMA about said rotation axis, coincidentally in time with engagement of said outwardly directed engagement surface with said second element.

16. A sprinkler according to claim 15 and wherein said radially outwardly directed surfaces are formed with mutually circumferentially aligned recesses.

17. A sprinkler comprising:

a fixed base defining a water inlet and a nozzle;

a ring;

a rotating assembly arranged for rotation relative to said fixed base about a rotation axis and including a water stream director, receiving a pressurized stream of water from said nozzle and directing it in a generally radially outward direction; and a rotation speed governing assembly operatively associated with said rotating assembly and operative to intermittently reduce a speed of rotation of said rotating assembly, so as to thereby increase a radial range of said stream, said rotational speed governing assembly including:

a rotating enclosure rotating together with said rotating assembly and enclosing:

a viscous material;

a first element; and a second element, said rotating enclosure and said second element rotating about said rotation axis relative to said first element, said fixed base comprising an externally threaded hollow base portion having at least one nozzle retaining bayonet mount protrusion formed on a lower, outer cylindrical surface thereof and having a transverse recess and a top surface, said hollow base portion defining a nozzle-receiving bore for receiving said nozzle, said hollow base portion including a plurality of snap fit fingers having undercut engagement edges and a ring receiving and retaining seat, said ring receiving and retaining seat being formed above said nozzle-receiving bore, said ring receiving and retaining seat being configured for fixed mounting therein of said ring and retention thereof by said plurality of snap fit fingers having undercut engagement edges.

18. A sprinkler according to claim 17 and wherein a bottom of said nozzle is configured to define a bayonet connector rim portion including at least one cutout, at least one retaining surface including a protrusion, at least one sloping engagement surface, at least one sloping disengagement surface and at least one downward-facing engagement surface for removable bayonet engagement with at least one retaining bayonet mount protrusion of said fixed base.

19. A sprinkler according to claim 17 and wherein said water stream director is formed with a support and rotary engagement surface for engagement with said ring during operation of the sprinkler.

20. A sprinkler according to claim 19 and wherein said engagement surface is defined by a protrusion having a pointed azimuthal clockwise end.

* * * * *